US006783923B2

(12) United States Patent
Tatsuta et al.

(10) Patent No.: US 6,783,923 B2
(45) Date of Patent: Aug. 31, 2004

(54) SILVER HALIDE COLOR PHOTOSENSITIVE MATERIAL AND PHOTOGRAPHIC PRODUCT

(75) Inventors: Takeichi Tatsuta, Kanagawa (JP); Yoichi Suga, Tokyo (JP); Kohzaburoh Yamada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 40 days.

(21) Appl. No.: 10/619,427

(22) Filed: Jul. 16, 2003

(65) Prior Publication Data

US 2004/0018454 A1 Jan. 29, 2004

(30) Foreign Application Priority Data

Jul. 17, 2002 (JP) ..... 2002-208817
Jul. 17, 2002 (JP) ..... 2002-208818
Jun. 17, 2003 (JP) ..... 2003-172608

(51) Int. Cl.[7] ..... G03C 1/46

(52) U.S. Cl. ..... 430/506; 430/495; 430/500; 430/501; 430/502; 430/503; 430/504; 430/508; 430/505

(58) Field of Search ..... 430/506, 495, 430/500, 501, 502, 503, 504, 505, 508

(56) References Cited

U.S. PATENT DOCUMENTS 5,166,042 A * 11/1992 Nozawa ..... 430/504

* cited by examiner

*Primary Examiner*—Geraldine Letscher
(74) *Attorney, Agent, or Firm*—Birch, Stewart, Kolasch & Birch, LLP

(57) ABSTRACT

A silver halide color photosensitive material comprising at least one red-sensitive silver halide emulsion layer, at least one green-sensitive silver halide emulsion layer and at least one blue-sensitive silver halide emulsion layer, on a support. The photosensitive material has an indicated speed of 800 or higher, and an ISO speed of 1.25 times the indicated speed or higher.

19 Claims, 2 Drawing Sheets

SILVER HALIDE COLOR PHOTOSENSITIVE MATERIAL AND PHOTOGRAPHIC PRODUCT

CROSS-REFERENCE TO RELATED APPLICATIONS

This application is based upon and claims the benefit of priority from the prior Japanese Patent Applications No. 2002-208817, filed Jul. 17, 2002; No. 2002-208818, filed Jul. 17, 2002; and No. 2003-172608, filed Jun. 17, 2003, the entire contents of all of which are incorporated herein by reference.

BACKGROUND OF THE INVENTION

1. Field of the Invention

The present invention relates to a color photosensitive material. Particularly, the present invention relates to a color photosensitive material, especially a color negative film for still photography, which is suitable for photographing in cloudy weather or of night scenes.

2. Description of the Related Art

In recent years, the use of zooming in compact cameras is being advanced. It is now the main current to use high zooming units enabling zooming to a magnification of 3 or 4. Such zooming units are useful for light heartedly enjoying of photographing, but the current situation is that the image quality is not always satisfactory. For example, there are units whose lens F-value exceeds 10 on its telescopic side, which are likely to cause under-exposure. Further, there often occur units whose electronic flash range is so short that the flash light cannot reach an intended location to thereby cause under-exposure.

Advanced Photo System (hereinafter simply referred to as "APS") whose image size was smaller than that of the conventional 135-format was put on sale in 1996. Taking advantage of the smaller format, miniaturization of camera is being promoted. There are units whose electronic flash has been miniaturized in accordance with the camera miniaturization. With respect to the APS, the ratio of failure photograph caused by non-reaching of electronic flash light tends to increase.

An ordinary photographer who uses a compact type camera or a single-use camera usually photographs a subject in a dim scene by use of auxiliary light like a flashlight. Photography with the flashlight, however, has the following problems:

(1) flashlight photography is prohibited or not acceptable in a quiet and calm situation;

(2) flashlight tends to cause red-eye effect, especially in photography with the compact type camera;

(3) flashlight photography causes an unnatural print picture because of too high contrast;

(4) flashlight tends to make unusual shadows of a main subject in front of a wall;

(5) if the color temperatures of the flashlight and the background light are largely different, a print picture tends to have color failure due to mixed light of the flashlight and the background light;

(6) a photo film is exposed to the unexpected flashlight reflected on a glass, a window, a mirror or the like, which are located in a photographed area; and (7) flashlight photography causes a dark background if the amount of the flashlight is not controlled properly.

A skillful photographer is able to deal with the above problems by use of special photography equipments. For instance, multiple flashlight sources are able to solve the problem (4) above. It is possible to solve the problem (5) by attaching a color conversion filter or a light balancing filter, which is adapted to the color temperature of the background light, to the flashlight emission window. In addition, bounced flashlight is utilized to solve the problem (6) above.

However, it is difficult to solve the above problems for an ordinary photographer who usually uses a compact type camera or a single-use camera. Moreover, flashlight photography is impossible in the situation where the supplementary light is prohibited or not acceptable because of ill-manner.

In order to solve these problems it is desirable to have a satisfactory print picture without the flashlight and any special operation by an ordinary photographer. Without the flashlight, however, many cameras will cause under exposure of main subjects. Moreover, an ordinary photographer finds it difficult to obtain a satisfactory print picture of a low color temperature scene, because a color correction process in printing operation can not correct the color temperature properly.

In recent years, highly sensitive photosensitive materials are placed on market in succession in accordance with the progress of the technology of photosensitive materials for photographing. Highly sensitive films are "usable in photographing in dark scenes", so that the frequency of use thereof in dark indoor places is increasing. On the other hand, especially in Japan, fluorescent lamps are very often installed as indoor illuminants, and scenes illuminated by fluorescent lamps are printed greenish. The higher the speed of the film, the greater the influence of the background light source on the film. Accordingly, the occurrence of greenish printing attributed to fluorescent lamps is greater with ISO-400 films than with ISO-100 films and greater with ISO-800 films than with ISO-400 films. Fuji Photo Film Co., Ltd. have developed color negative film "Superia X-tra 800" realizing a color reproduction that is faithful to human sight, thereby having improved the light source compatibility with respect to ISO-800 film. This color negative film, although having succeeded in conspicuously reducing the failure caused by non-reaching of electronic flash light and the defect of color tint attributed to fluorescent lamps, often encounters feeling of poor speed in cloudy weather.

Further speed increase is demanded for coping with these failures. However, further speed increase is likely to suffer side effects such as deterioration of graininess and hence may not be favorable from the viewpoint of versatility.

Moreover, improvement of graininess is likely to lead to an increase of coating silver quantity and an increase of film thickness, which are unfavorable from the viewpoint of realization of rapid development processing and replenishment reduction for processing solutions.

BRIEF SUMMARY OF THE INVENTION

The object of the present invention is to provide a silver halide color photosensitive material, especially a color negative film for still photography, which is free from under-exposure even in the use in compact cameras and single-use cameras which enables obtaining excellent photographs over a wide exposure range, and which ensures excellent rapid processability.

Another object of the present invention is to provide a silver halide color photosensitive material, especially a color negative film for still photography, which enables obtaining excellent photographs over a wide exposure range without causing under-exposure, even in photographing a dim scene, such as in indoor or night photography, by use of compact cameras or single-use cameras without auxiliary light.

The inventors have found, as a result of extensive and intensive efforts, that the object of the present invention can be attained by the following means.

(1) A silver halide color photosensitive material comprising at least one red-sensitive silver halide emulsion layer, at least one green-sensitive silver halide emulsion layer and at least one blue-sensitive silver halide emulsion layer, on a support, wherein the silver halide color photosensitive material has ISO speed of 1000 or higher, and has the ISO speed of 1.25 times an indicated speed or higher.

(2) The silver halide color photosensitive material according to item (1) mentioned above, wherein the ISO speed is 1250 or higher and 2.8 times the indicated speed or higher (3) The silver halide color photosensitive material according to item (1) or (2) mentioned above, wherein the following formula is satisfied;

$$\log_{10}H_B-\log_{10}H_G\leqq-0.20$$

wherein $H_B$, $H_G$ are exposure amounts corresponding to the points whose diffuse densities are (minimum density+0.15) in characteristic curves for blue and green;

wherein the characteristic curves for blue and green are obtained by gray exposure for 1/100 sec to an emulsion side surface by use of an ISO daylight illuminant under the condition regulated by ISO 5800, by measuring blue and green diffuse density (ISO status M) after development.

(4) The silver halide color photosensitive material according to any one of items (1) to (3) mentioned above, wherein each of the red-sensitive silver halide emulsion layer, the green-sensitive silver halide emulsion layer and the blue-sensitive silver halide emulsion layer is composed of at least two layers having different speeds comprising a highest speed and a lowest speed, and at least one of the layers having the highest speeds do not substantially contain a DIR compound capable of releasing a development inhibitor and/or a precursor of a development inhibitor.

(5) The silver halide color photosensitive material according to any one of items (1) to (4) mentioned above, wherein the photosensitive material contains a compound capable of undergoing a one-electron oxidation to thereby form a one-electron oxidation product thereof, wherein the one-electron oxidation product is capable of releasing further one or more electrons.

(6) The silver halide color photosensitive material according to any one of items (1) to (5) mentioned above, wherein the green-sensitive silver halide emulsion layer has a weight-averaged wavelength ($\lambda_G$) of spectral sensitivity distribution satisfying the relationship 520 nm$<\lambda_G\leqq$580 nm, and wherein the red-sensitive silver halide emulsion layer has a weight-averaged wavelength ($\lambda_{-R}$) of spectral sensitivity distribution of magnitude of interlayer effect exerted thereupon, in the range of 500 nm to 600 nm, by other silver halide emulsion layers satisfying the relationship 500 nm$<\lambda_{-R}\leqq$560 nm, and wherein $\lambda_G-\lambda_{-R}$ is 5 nm or greater.

(7) The silver halide color photosensitive material according to any one of items (1) to (6) mentioned above, wherein the silver halide color photosensitive material is a color negative film for still photography.

(8) A photographic product into which the silver halide color photosensitive material according to any one of (1) to (7) mentioned above is built, and which comprises an exposure mechanism including a photographic lens and a shutter.

BRIEF DESCRIPTION OF THE DRAWINGS

The above objects and advantages of the present invention will become easily understood by one of ordinary skill in the art when the following detailed description would be read in connection with the accompanying drawings.

DETAILED DESCRIPTION OF THE INVENTION

Figure 1:
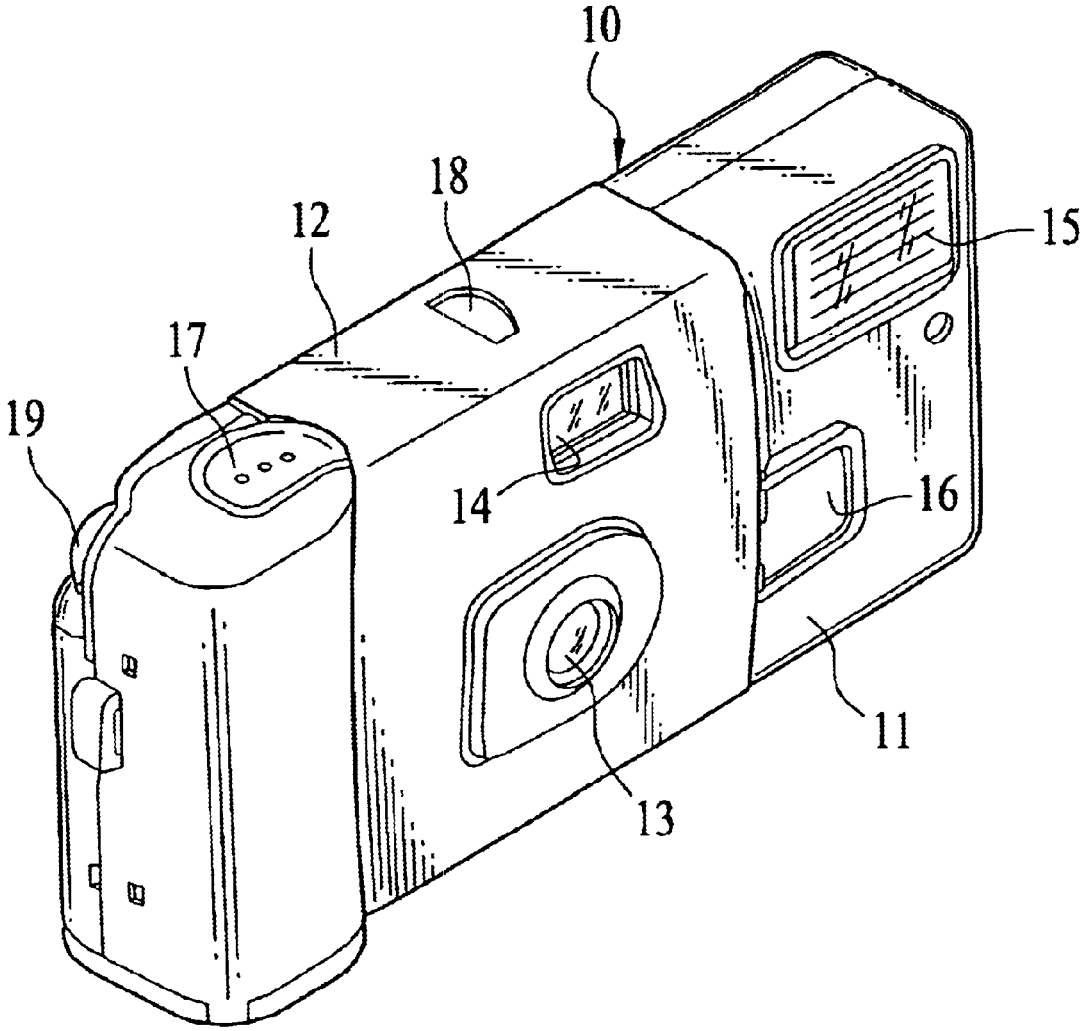
FIG. 1 is a front perspective view of a lens-fitted photo film unit as an example of a single-use camera.

The present invention will be described in detail below.

The silver halide color photosensitive material of the present invention exhibits excellent photographic properties even at under-exposure.

In the present invention, the indicated speed is defined as follows.

The indicated speed refers to the sensitivity indicated on a package or packing material of color photosensitive material. The indicated speeds include the CAS code (Camera Auto-sensing Code: according to standards of Photosensitive Material Industrial Association) with respect to the 135-format, the speed recorded on data disk (specified in System Specifications for the Advanced Photo System) with respect to APS, and the speed recorded in a bar code on a light-shielding sheet or a tape to adhere the photo film to the light-shielding sheet and a photo filmstrip with respect to the 120/220 format. The mechanically readable indicated speed in the present invention stands for an indication that is optically, electrically or magnetically readable by a machine such as a camera or a printer. Examples of the indicated speed are CAS code, data disc and a bar code, but not limited to those listed. The mechanically readable indicated speed also includes an indication readable by an optical character reader (OCR), even through a user can recognize such indication.

When the speed indicated on a package or the like (speed which can be perceived by user's visual inspection) is different from the CAS code or the speed defined on data disk, the CAS code or the speed defined on data disk is regarded as the indicated speed of the present invention.

For the purpose of preventing under-exposure in indoor photography and night photography with the flashlight, the ISO speed of the color photosensitive material of the present invention (developed by the processing described in Example 1) is 1.25 times the indicated speed or greater, preferably 1.5 times the indicated speed or greater, and more preferably 2 times the indicated speed or greater. That is, when the indicated speed is 800, the ISO speed is 1000 or greater, preferably 1200 or greater, and more preferably 1600 or greater. The ISO speed of the color photosensitive material of the present invention is 1000 or greater, preferably 1200 or greater, and more preferably 1600 or greater.

Higher speed is preferable for photography in a dim scene, such as an indoor scene, with no auxiliary light. This is because indoor lighting equipment tends to be top light that has lower vertical illuminance than horizontal illuminance, so that illuminance of the main subject becomes 1 to 3 steps darker than the background. Since a center weighed photometory device, often used for the compact type camera, is largely influenced by the background light, under-exposure of the main subject often happens when an ordinary photo film is used in photographing a dim scene, such as a night or indoor scene, without an auxiliary light.

Accordingly, it is preferable to control the actual exposure amount more than the exposure amount that is designed by a camera. In order to realize this, the ISO speed of the color photosensitive material of the present invention is preferably 2.8 times the indicated speed or more, and more preferably 3.5 times the indicated speed or more. The ISO speed of the color photosensitive material is preferably 1250 or greater, more preferably 1600 or greater, most preferably 2400 or greater.

The ISO speed of the color photosensitive material of the present invention is not 16 times the indicated speed or more because of the possibility of frequent over-exposure.

The ISO speed stands for the actual speed, namely the speed of the color negative film for still photography that is regulated by ISO 5800-1987. More concretely, the ISO speed is defined as $\{2/(H_G+H_S)^{1/2}\}$, wherein $H_B$, $H_G$, $H_R$ are the exposure amounts to the speed points of blue, green and red, and wherein $H_S$ is the maximum value among the exposure amounts $H_B$, $H_G$, $H_R$ (lowest speed).

The exposure amount and the speed point are determined on the basis of the speed measurement method for the color negative film for still photography that is regulated by ISO 5800-1987. Particulars not described in the regulation are described below. The ISO daylight illuminant with the color temperature of about 5500K as the standard illuminant is adapted as the sensitometry illuminant. Exposure for 1/100 sec is carried out through a gray scale with no density step. After 5 to 10 days under the temperature and humidity conditions regulated by ISO since the exposure, development is carried out by the development process recommended to a consumer by a manufacturer, for instance the process described in Embodiment 1. Then, the characteristic curves are obtained by measuring blue, green and red diffuse density (ISO status M). The speed points of blue, green and red correspond to the points in the characteristic curves at which the diffuse transmission density of each color is (minimum density+0.15). The exposure amounts $H_B$, $H_G$, $H_R$ are defined as the exposure amounts at the speed points of blue, green and red. By use of the exposure amounts, the ISO speed is calculated.

The color negative film of the present invention preferably has wide latitude. Although an ordinary color negative film for still photography has a latitude from 4EV to 8EV in the over-exposure side, the latitude of the color negative film of the present invention is preferably 5EV or greater, more preferably 6EV or greater, most preferably 7EV or greater.

In the present invention, the latitude means the linear range in the characteristic curve. The latitude in the over-exposure side is obtained by the formula $\log_2(H_{G2MAX}-H_G)$ [EV], wherein $H_G$ is the exposure amount corresponding to the green speed point in the characteristic curve in calculating the ISO speed, wherein $H_{G2}$ is an exposure amount smaller than $H_G$, and wherein $H_{G2MAX}$ is the maximum value of $H_{G2}$ to satisfy that the difference between the characteristic curve and the line to connect the two points corresponding to $H_G$ and $H_{G2}$ in the characteristic curve is −0.05 to 0.05 over the range between the two points corresponding to $H_G$ and $H_{G2}$.

If photography is carried out without the flashlight, the photographed image tends to have a low color temperature in which the blue component of the scene light is lower than the green component. When the scene with low color temperature is photographed by use of the compact type camera in which the sensitivity characteristic curve of a photometry device (such as SPD device) is similar to the green sensitivity, the photographed image tends to have low blue component. As a result, the print picture is not satisfactory because of a dull picture or blue ridge patterns. Thus, the photosensitive material preferably has high blue sensitivity. The value $\log_{10}H_B-\log_{10}H_G$ is preferably −0.2 or less, more preferably −0.25 or less, most preferably −0.3 or less.

The color photosensitive material of th present invention preferably has at least two red-sensitive silver halide emulsion layers having different speeds to each other, at least two green-sensitive silver halide emulsion layers having different speeds to each other and at least two blue-sensitive silver halide emulsion layers having different speeds to each other, and at least one of the layers having the highest speeds does not substantially contain a DIR compound capable of releasing a development inhibitor and/or a precursor of a development inhibitor.

The DIR compound, although its graininess enhancing effect is marked, would cause a speed drop. Hence, it is preferred substantially not to contain the DIR compound in a highest-speed layer of color negative having high speed. Herein, the terminology "substantially not to contain" defines that the content is 1 mol % or less based on all the couplers contained in the relevant layer.

In the designing of a color photosensitive material of high speed and excellent graininess, it is important to render the development of silver halide emulsion of highest-speed layer as rapid as possible so as to realize high speed and to promptly cause all the couplers of highest-speed layer to undergo color formation. In particular, it is preferred that no DIR compound be contained in highest-speed layers of the green-sensitive layer and/or red-sensitive layer whose visual effects are marked.

As the DIR compound, use is made of a compound which reacts with developing agent oxidation products obtained by development to thereby release a development inhibitor or a precursor thereof. For example, use can be made of DIR (development inhibitor releasing) couplers, DIR-hydroquinone, couplers capable of releasing DIR-hydroquinone or a precursor thereof, and the like.

The color formation density (status M) of highest-speed layer is within 1, preferably within 0.7, more preferably within 0.5.

Although the speed and graininess can be reconciled by virtue of the above constitution, there would occur such a demerit that the interlayer effect exerted by other layers is diminished to result in a decrease of color saturation. However, as a result of actual preparation of color photosensitive materials and use thereof in an actual test photographing, it was found that the merit of high speed was extremely large as compared with the demerit of color saturation decrease on the under side.

The compound capable of undergoing a one-electron oxidation to thereby form a one-electron oxidation product thereof, wherein the one-electron oxidation product is capable of releasing further one or more electrons which is contained in the color photosensitive material of the invention is a compound selected from those of types 1 to 5 as follows:

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent bond cleavage reaction, and the compound has, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond-forming reaction;

(Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction; and (Type 5)

A compound having a formula: X—Y wherein X represents a reducing group, and Y represents a splitting-off group, wherein the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing one electron.

Among the compounds of types 1, and 3 to 5, preferable ones are "compounds having, in its molecular, an adsorptive group to silver halide" or "compounds having, in its molecular, a partial structure of spectral sensitizing dye". More preferable compounds are "compounds having, in its molecular, an adsorptive group to silver halide".

The compounds of types 1 to 5 will now be described in detail.

With respect to the compound of type 1, the expression "bond cleavage reaction" specifically refers to the cleavage of a carbon-carbon bond, carbon-silicon bond, carbon-hydrogen bond, carbon-boron bond, carbon-tin bond, or carbon-germanium bond. Cleavage of carbon-hydrogen bond may further accompany the above bond cleavage. The compound of type 1 is a compound capable of undergoing a one-electron oxidation to thereby form a one-electron oxidation product. The one-electron oxidation product only thereafter capable of undergoing a bond cleavage reaction to thereby further release two or more electrons (preferably three or more electrons). In another expression, the one-electron oxidation product of the compound of type 1 is capable of being oxidized with further two or more electrons (preferably three or more electrons).

Among the compounds of type 1, preferable compounds are represented by the general formula (A), general formula (B), general formula (1), general formula (2) or general formula (3):

(A)

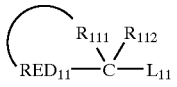

-continued (B)

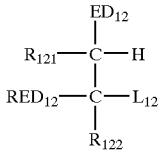

In the general formula (A), $RED_{11}$ represents a one-electron oxidizable reducing group; $L_{11}$ represents a split-off group. $R_{112}$ represents a hydrogen atom or substituent. $R_{111}$ represents a nonmetallic atomic group capable of forming, together with carbon atom (C) and $RED_{11}$, a specific 5- or 6-mememered cyclic structure, wherein the 5- or 6-mememerd cyclic structure means a tetrahydro form, hexahydro form or octahydro form of a 5- or 6-membered aromatic ring (including an aromatic heterocycle).

In the general formula (B), $RED_{12}$ represents a one-electron oxidizable reducing group; $L_{12}$ represents a split-off group. Each of $R_{121}$ and $R_{122}$ represents a hydrogen atom or substituent. $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

These compounds are those which, after a one-electron oxidation of the reducing group represented by $RED_{11}$ or $RED_{12}$ of the general formula (A) or general formula (B), can spontaneously split $L_{11}$ or $L_{12}$ through a bond cleavage reaction, namely, cleave the C (carbon atom)-to-$L_{11}$ bond or the C (carbon atom)-to-$L_{12}$ bond to thereby further release two or more electrons, preferably three or more electrons.

(1)

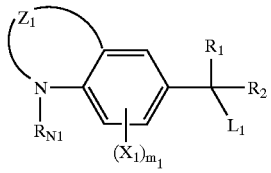

(2)

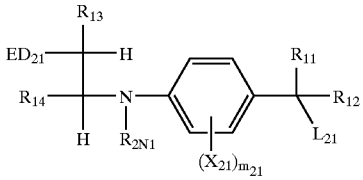

(3)

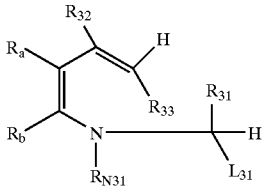

In the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{32}$, $R_{33}$, $R_{31}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

These compounds are those which, after a one-electron oxidation, can spontaneously split $L_1$, $L_{21}$ or $L_{31}$ through a bond cleavage reaction, namely, cleave the C (carbon atom)-to-$L_1$ bond, the C (carbon atom)-to-$L_{21}$ bond or the C (carbon atom)-to-$L_{31}$ bond to thereby further release two or more electrons, preferably three or more electrons.

First, the compound represented by the general formula (A) will be described in detail below.

In the general formula (A), the reducing group represented by $RED_{11}$ that is capable of being oxidized with one-electron, is a group capable of bonding with $R_{111}$ described later to thereby form a specific ring. The reducing group can be, for example, a divalent group corresponding to a monovalent group, as mentioned below, having one hydrogen atom removed therefrom at a position that is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (for example, 5-to 7-membered monocyclic or condensed heterocycle containing at least one hetero atom selected from the group consisting of a nitrogen atom, sulfur atom, oxygen atom and selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group (the substitution position of the heterocyclic group is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or a salt thereof, sulfonylcarbamoyl group, acylcarbamoyl group, sulfamoylcarbamoyl group, carbazoyl group, oxalyl group, oxamoyl group, cyano group, carbonimidoyl group, thiocarbamoyl group, hydroxyl group, alkoxy groups (including a group containing ethyleneoxy or propyleneoxy repeating units), aryloxy group, heterocyclic oxy group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or a salt thereof, sulfamoyl group, acylsulfamoyl group, sulfonylsulfamoyl group or a salt thereof, and group containing a phosphoramide or phosphoric ester structure. These substituents may be further substituted with these substituents.

In the general formula (A), $L_{11}$ represents a split-off group that can be split off through a bond cleavage only after a one-electron oxidation of the reducing group represented by $RED_{11}$. Specifically, $L_{11}$ represents, for example, a carboxyl group or a salt thereof, silyl group, hydrogen atom, triarylboron anion, trialkylstannyl group, trialkylgermyl group or a group of the formula $—CR_{C1}R_{C2}R_{C3}$.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$represents a silyl group, specifically, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

When $L_{11}$ represents a triarylboron anion, the aryl thereof is preferably a substituted or unsubstituted phenyl, wherein the substituent can be any of those which may be had by $RED_{11}$. When $L_{11}$ represents a trialkylstannyl group or a trialkylgermyl group, the alkyl thereof is a substituted or unsubstituted linear, branched or cyclic alkyl having 1 to 24 carbon atoms, wherein the substituent can be any of those which may be had by $RED_{11}$.

When $L_{11}$ represents a group of the formula $—CR_{C1}R_{C2}R_{C3}$, each of $R_{C1}$, $R_{C2}$ and $R_{C3}$ independently represents any of a hydrogen atom, alkyl group, aryl group, heterocyclic group, alkylthio group, arylthio group, alkylamino group, arylamino group, heterocyclic amino group, alkoxy group, aryloxy group and hydroxyl group. These may be bonded with each other to thereby form a cyclic structure. Each of these may further have a substituent. The substituent can be any of those which may be had by $RED_{11}$. Provided however that, when one of $R_{C1}$, $R_{C2}$ and $R_{C3}$ represents a hydrogen atom or alkyl group, the remaining two do not represent a hydrogen atom or alkyl group. It is preferred that each of $R_{C1}$, $R_{C2}$ and $R_{C3}$ independently represent an alkyl group, aryl group (especially, phenyl), alkylthio group, arylthio group, alkylamino group, arylamino group, heterocyclic group, alkoxy group or hydroxyl group. Specific examples thereof include phenyl, p-dimethylaminophenyl, p-methoxyphenyl, 2,4-dimethoxyphenyl, p-hydroxyphenyl, methylthio, phenylthio, phenoxy, methoxy, ethoxy, dimethylamino, N-methylanilino, diphenylamino, morpholino, thiomorpholino and hydroxyl. Examples of groups having a cyclic structure formed by mutual bonding of these include 1,3-dithiolan-2-yl, 1,3-dithian-2-yl, N-methyl-1,3-thiazolidin-2-yl and N-benzylbenzothiazolidin-2-yl.

Preferred groups of the formula $—CR_{C1}R_{C2}R_{C3}$ can be, for example, trityl, tri(p-hydroxyphenyl)methyl, 1,1-diphenyl-1-(p-dimethylaminophenyl)methyl, 1,1-diphenyl-1-(methylthio)methyl, 1-phenyl-1,1-(dimethylthio)methyl, 1,3-dithiolan-2-yl, 2-phenyl-1,3-dithiolan-2-yl, 1,3-dithian-2-yl, 2-phenyl-1,3-dithian-2-yl, 2-methyl-1,3-dithian-2-yl, N-methyl-1,3-thiazolidin-2-yl, 2-methyl-3-methyl-1,3-thiazolidin-2-yl, N-benzylbenzothiazolidin-2-yl, 1,1-diphenyl-1-dimethylaminomethyl and 1,1-diphenyl-1-morpholinomethyl group. It is also preferred that the group of the formula —$CR_{C1}R_{C2}R_{C3}$ be the same group as the residue resulting from removal of $L_{11}$ from the general formula (A) as a consequence of selection within the above scopes with respect of the $R_{C1}$, $R_{C2}$ and $R_{C3}$.

In the general formula (A), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided, however, that $R_{112}$ and $L_{11}$ do not represent the same group.

In the general formula (A), $R_{111}$ represents a group of nonmetallic atoms capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring (including an aromatic heterocycle). Herein, the terminology "hydro form" means a cyclic structure resulting from partial hydrogenation of an internal carbon to carbon double bond (or a carbon to nitrogen double bond) of an aromatic ring (including an aromatic heterocycle). The tetrahydro form refers to a structure resulting from hydrogenation of two carbon to carbon double bonds (or carbon to nitrogen double bonds). The hexahydro form refers to a structure resulting from hydrogenation of three carbon to carbon double bonds (or carbon to nitrogen double bonds). The octahydro form refers to a structure resulting from hydrogenation of four carbon to carbon double bonds (or carbon to nitrogen double bonds). As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (A) of the present invention will be described below.

In the general formula (A), $L_{11}$ preferably represents a carboxyl group or a salt thereof, or hydrogen atom. More preferably, $L_{11}$ is a carboxyl group or a salt thereof.

As a counter ion of the salt, there can preferably be mentioned an alkali metal ion or an ammonium ion. An alkali metal ion (especially $Li^+$, $Na^+$ or $K^+$ ion) is most preferred.

When $L_{11}$ represents a hydrogen atom, it is preferred that the compound represented by the general formula (A) has an intramolecular base moiety. By virtue of the action of the base moiety, the compound represented by the general formula (A) is oxidized, and, thereafter the hydrogen atom represented by $L_{11}$ is deprotonized to thereby enable further release of an electron therefrom.

Herein, the base refers to, for example, a conjugated base of acid exhibiting a pKa value of about 1 to about 10. As the base, there can be mentioned, for example, any of nitrogen-containing heterocycles (pyridines, imidazoles, benzimidazoles, thiazoles, etc.), anilines, trialkylamines, an amino group, carbon acids (active methylene anion, etc.), a thioacetate anion, carboxylate (—$COO^-$), sulfate (—$SO_3^-$) and an amine oxide (>$N^+(O^-)$—). Preferred base is a conjugated base of acid exhibiting a pKa value of about 1 to about 8. Carboxylate, sulfate and an amine oxide are more preferred. Carboxylate is most preferred. When these bases have an anion, a counter cation may be had thereby. The counter cation can be, for example, an alkali metal ion, an alkaline earth metal ion, a heavy metal ion, an ammonium ion or a phosphonium ion.

These bases are linked at an arbitrary position thereof to the compound represented by the general formula (A). The position at which the base moiety is bonded may be any of $RED_{11}$, $R_{111}$ and $R_{112}$ of the general formula (A). Also, the bases may be linked at substituents of these groups.

When $L_{11}$ represents a hydrogen atom, it is preferred that the hydrogen atom and the base moiety be linked to each other through an atomic group consisting of 8 or less atoms. More preferably, the linkage is made by an atomic group consisting of 5 to 8 atoms. Herein, what is counted as a linking atomic group refers to an atomic group which links the hydrogen atom to the central atom of base moiety (namely, an atom having an anion, or an atom having a lone electron pair) by a covalent bond. For example, with respect to carboxylate, two atoms of —C—$O^-$ are counted. With respect to sulfate, two atoms of S—$O^-$ are counted. Also, the carbon atom represented by C in the general formula (A) is included in the count.

In the general formula (A), when $L_{11}$ represents a hydrogen atom and when $RED_{11}$ represents an aniline whose nitrogen atom forms a 6-membered monocyclic saturated ring structure (for example, a piperidine ring, piperazine ring, morpholine ring, thiomorpholine ring or selenomorpholine ring) together with $R_{111}$, it is preferred that the compound have an adsorptive group acting on silver halides in its molecule. It is more preferred that the compound simultaneously have an intramolecular base moiety, the base moiety and the hydrogen atom linked to each other through an atomic group consisting of 8 or less atoms.

In the general formula (A), it is preferred that $RED_{11}$ represents an alkylamino group, arylamino group, heterocyclic amino group, aryl group, or aromatic or nonaromatic heterocyclic group. As the heterocyclic group, preferred group is, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred group is an arylamino group (especially an anilino) or aryl group (especially an phenyl). When $RED_{11}$ represents an aryl group, it is preferred that the aryl group has at least one electron-donating group (the number of electron-donating groups is preferably 4 or less, more preferably 1 to 3). Herein, the electron-donating group specifically refers to a hydroxyl group, alkoxy group, mercapto group, sulfonamido group, acylamino group, alkylamino group, arylamino group, heterocyclic amino group, active methine group, electron-excessive aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (A) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a circular structure. When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (A) via its nitrogen atom. More preferably, the substituent is an alkylamino group, hydroxyl group, active methine group, or nonaromatic nitrogen-containing heterocyclic group that is bonded to the carbon atom of the general formula (A) via its nitrogen atom. Most preferably, the substituent is an alkylamino group, or nonaromatic nitrogen-containing heterocyclic group that is bonded to the carbon atom of the general formula (A) via its nitrogen atom.

In the general formula (A), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group. More preferably, $R_{112}$ represents any of a hydrogen atom, alkyl group, alkoxy group, hydroxy group, phenyl group, or alkylamino group.

In the general formula (A), $R_{111}$ preferably represents a group of nonmetallic atoms capable of forming the following specific 5- or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring. The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (B) will be described in detail.

With respect to the $RED_{12}$ and $L_{12}$ of the general formula (B), not only the meanings but also the preferred ranges thereof are the same as those of the $RED_{11}$ and $L_{11}$ of the general formula (A), respectively. Provided, however, that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (A). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (B), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excessive aromatic heterocyclic group (e.g., indolyl, pyrrolyl or indazolyl), a nonaromatic nitrogen-containing heterocyclic group that is bonded to the carbon atom of the general formula (B) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group. $ED_{12}$ preferably represents a hydroxyl group, alkoxy group, mercapto group, sulfonamido group, alkylamino group, arylamino group, active methine group, electron-excessive aromatic heterocyclic group, nonaromatic nitrogen-containing heterocyclic group that is bonded to the carbon atom of the general formula (B) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (B) via its nitrogen atom, or phenyl group substituted with any of these electron-donating groups (e.g., p-hydroxyphenyl, p-dialkylaminophenyl or o,p-dialkoxyphenyl).

In the general formula (B), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure of a 5- to 7-membered monocyclic or condensed-ring nonaromatic carbon ring or heterocycle. When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring, oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring. When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring. When $R_{122}$ and $R_{121}$ form a cyclic structure, the thus formed cyclic structure can be, for example, a cyclohexane ring or cyclopentane ring.

Those which are more preferred among the compounds of the general formula (A) of the present invention are represented by the following general formulae (10) to (12). Those which are more preferred among the compounds of the general formula (B) are represented by the following general formulae (13) and (14):

(10)

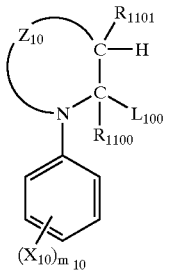

(11)

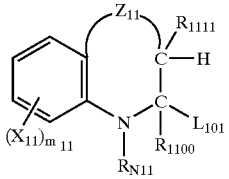

(12)

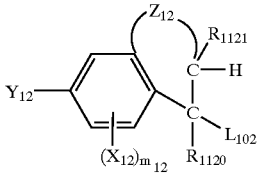

(13)

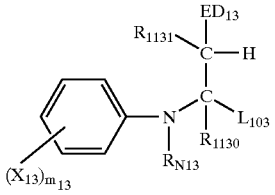

-continued (14)

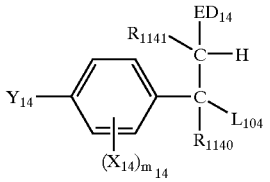

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (A). With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (B). With respect to the $ED_{13}$ and $ED_{14}$, not only the meanings but also the preferred ranges thereof are the same as those of the $ED_{12}$ of the general formula (B). Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$ or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$ refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (A). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc. Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, dialkylamino) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle. When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred example of the compounds of the general formula (13). As the cyclic structure formed by $R_{1131}$ and $X_{13}$ in the general formula (13), there can be mentioned, for example, any of an indoline ring (in which case, $R_{113}$, represents a single bond), tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred. As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring. Of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred example of the compounds of the general formula (14). As the cyclic structure formed by the bonding of $R_{114}$, and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

Now, the general formulae (1) to (3) will be described.

In the general formulae (1) to (3), each of $R_1$, $R_2$, $R_{11}$, $R_{12}$ and $R_{31}$ independently represents a hydrogen atom or substituent. With respect to these, not only the meanings but also the preferred ranges thereof are the same as those of the $R_{112}$ of the general formula (A). Each of $L_1$, $L_{21}$ and $L_{31}$ independently represents a split-off group, which can be any of those mentioned as examples in the above description of the $L_{11}$ of the general formula (A). The preferred ranges thereof are also the same as mentioned there. Each of $X_1$ and $X_{21}$ represents a substituent capable of substituting on the benzene ring. Each thereof independently represents any of those mentioned as the substituent examples with respect to substituted $RED_{11}$ of the general formula (A). Each of $m_1$ and $m_{21}$ is an integer of 0 to 3, preferably 0 to 2, and more preferably 0 or 1.

Each of $R_{N1}$, $R_{N21}$ and $R_{N31}$ represents a hydrogen atom or substituent capable of substituting on the nitrogen atom. The substituent can preferably be any of an alkyl group, aryl group and heterocyclic group. These groups may further have a substituent. This substituent can be any of those which may be had by the $RED_{11}$ of the general formula (A). Each of $R_{N1}$, $R_{N21}$ and $R_{N31}$ preferably represents a hydrogen atom, alkyl group or aryl group, more preferably a hydrogen atom or alkyl group.

Each of $R_{13}$, $R_{14}$, $R_{32}$, $R_{33}$, $R_a$ and $R_b$ independently represents a hydrogen atom or substituent capable of substituting on the carbon atom. The substituent can be any of those that may be had by the $RED_{11}$ of the general formula (A). The substituent can preferably be, for example, an alkyl group, aryl group, acyl group, alkoxycarbonyl group, carbamoyl group, cyano group, alkoxy group, acylamino group, sulfonamido group, ureido group, thioureido group, alkylthio group, arylthio group, alkylsulfonyl group, arylsulfonyl group or sulfamoyl group.

In the general formula (1), $Z_1$ represents an atomic group capable of forming a 6-membered ring together with the nitrogen atom and the two carbon atoms of the benzene ring. The 6-membered ring formed with $Z_1$ is a nonaromatic carbon ring condensed with the benzene ring of the general formula (1). Specifically, the atomic group can be any of a tetrahydroquinoline ring, tetrahydroquinoxaline ring and tetrahydroquinazoline ring, which ring structures include the benzene ring to which the atomic group condenced. These may have a substituent. The substituent can be any of those mentioned as examples when the $R_{112}$ of the general formula (A) represents a substituent, and the preferred range thereof is also the same as mentioned there.

In the general formula (1), $Z_1$ preferably represents an atomic group capable of forming a tetrahydroquinoline ring or tetrahydroquinoxaline ring together with the nitrogen atom and the two carbon atoms of the benzene ring.

In the general formula (2), $ED_{21}$ represents an electron-donating group. With respect to the $ED_{21}$, not only the meaning but also the preferred range thereof is the same as those of the $ED_{12}$ of the general formula (B).

In the general formula (2), any two of $R_{N21}$, $R_{13}$, $R_{14}$, $X_{21}$ and $ED_{21}$ may be bonded with each other to thereby form a cyclic structure. The cyclic structure formed by $R_{N21}$ and $X_{21}$ is preferably a 5- to 7-membered nonaromatic carbon ring or heterocycle condensed with the benzene ring of the general formula (2). For example, it can be a tetrahydroquinoline ring, tetrahydroquinoxaline ring, indoline ring or 2,3-dihydro-5,6-benzo-1,4-thiazine ring. Preferably, it is a tetrahydroquinoline ring, tetrahydroquinoxaline ring or indoline ring.

In the general formula (3), when $R_{N31}$ represents a group other than aryl group, $R_a$ and $R_b$ are bonded with each other to thereby form an aromatic ring. Herein, this aromatic ring is an aryl group. Herein, the aromatic group is an aryl group (e.g., phenyl or naphthyl) or an aromatic heterocyclic group (e.g., a pyridine ring, pyrrole ring, quinoline ring or indole ring). An aryl group is preferred. The aromatic ring group may have a substituent. The substituent can be any of those mentioned when $X_1$ of the general formula (1) represents a substituent, and the preferred range thereof is also the same as mentioned there.

In the general formula (3), it is preferred that $R_a$ and $R_b$ be bonded with each other to thereby form an aromatic ring (especially a phenyl group).

In the general formula (3), $R_{32}$ preferably represents, for example, a hydrogen atom, alkyl group, aryl group, hydroxyl group, alkoxy group, mercapto group or amino group. When $R_{32}$ represents a hydroxyl group, it is a preferred mode that simultaneously $R_{33}$ represents an electron-withdrawing group. This electron-withdrawing group refers to any of an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. Of these, an acyl group, alkoxycarbonyl group, carbamoyl group and cyano group are preferred.

The compound of type 2 will be described below.

The compound of type 2 is a compound capable of undergoing a one-electron oxidation to thereby form a one-electron oxidation product and capable of, only thereafter, undergoing a bond cleavage reaction to thereby further release another electron. That is, the one-electron oxidation product of the compound of type 2 is capable of being oxidized with a further one-electron oxidation. Herein, the expression "bond cleavage reaction" refers to the cleavage of a carbon-carbon bond, carbon-silicon bond, carbon-hydrogen bond, carbon-boron bond, carbon-tin bond, or carbon-germanium bond. Cleavage of carbon-hydrogen bond may accompany the above bond cleavage.

Provided that the compound of type 2 has, in its molecule, two or more (preferably two to six, more preferably two to four) groups adsorptive to silver halide. More preferably, the compound of type 2 has a nitrogen-containing heterocyclic group substituted with two or more mercapto groups, as its adsorptive group. The number of adsorptive group is preferably 2 to six, and more preferably two to four.

Among the compounds of type 2, those preferred are represented by general formula (C):

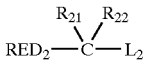

(C)

Herein, the compound of the general formula (C) is, after the one-electron oxidation of the reducing group represented by $RED_2$, $L_2$ is spontaneously split off through a bond cleavage reaction, namely, the C (carbon atom)-to-$L_2$ bond is cleaved, so that further another electron can be released.

With respect to $RED_2$ of the general formula (C), not only the meaning but also the preferred range thereof is the same as those of the $RED_{12}$ of the general formula (B). $L_2$ has the same meaning as described for $L_{11}$ of the general formula (A). The preferable range of $L_2$ is also the same as that of $L_{11}$. When $L_2$ represents a silyl group, the compound of the general formula (C) has, in its molecule, a nitrogen-containing heterocyclic group that is substituted by two or more mercapto groups, as an adsorptive group. Each of $R_{21}$ and $R_{22}$ represents a hydrogen atom or substituent. With respect to these, not only the meanings but also the preferred ranges thereof are the same as those of the $R_{112}$ of the general formula (A). $RED_2$ and $R_{21}$ may be bonded with each other to thereby form a cyclic structure.

The thus formed cyclic structure is preferably a 5- to 7-membered monocyclic or condensed-ring nonaromatic carbon ring or heterocycle, which may have a substituent. Provided, however, that the cyclic structure is not one corresponding to a tetrahydro form, hexahydro form or octahydro form of an aromatic ring or aromatic heterocycle. The substituent can be any of those mentioned as substituent examples with respect to substituted $RED_{11}$ of the general formula (A). The cyclic structure is preferably a cyclic structure corresponding to a dihydro form of an aromatic or aromatic heterocycle. Preferable example of the cyclic structure, for example, is a 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofuran ring, benzo-α-pyran ring, 1,2-dihydroquinoline ring, 1,2-dihydroquinazoline ring and 1,2-dihydroquinoxaline ring.

Of these, a 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring and 1,2-dihydroquinoxaline ring are preferred. An indoline ring, benzimidazoline ring, benzothiazoline ring and 1,2-dihydroquinoline ring are more preferred. An indoline ring is most preferred.

The compound of type 3 will be described below.

The compound of type 3 is a compound characterized in that it can undergo a one-electron oxidation to thereby form a one-electron oxidation product, the one-electron oxidation product being capable of releasing further one or more electrons after going through a subsequent bond-forming reaction. The bond-forming process refers to the formation of bond between atoms, for example, of carbon-carbon bond, carbon-nitrogen bond, carbon-sulfur bond or carbon-oxygen bond.

The compound of type 3 is preferably a compound characterized in that it can undergo a one-electron oxidation to thereby form a one-electron oxidation product, the one-electron oxidation product subsequently reacting with a reactive group moiety (a carbon to carbon double bond moiety, a carbon to carbon triple bond moiety, an aromatic group moiety or a benzo-condensed nonaromatic heterocyclic group moiety) which coexists in the molecule to thereby form a bond, followed by further release of one or more electrons.

The one-electron oxidation product formed by the one-electron oxidation of the compound of type 3 refers to a cation radical species, which may undergo splitting of a proton to thereby form a neutral radical species. This one-electron oxidation product (cation radical species or neutral radical species) reacts with a carbon to carbon double bond moiety, a carbon to carbon triple bond moiety, an aromatic group moiety and a benzo-condensed nonaromatic heterocyclic group moiety which coexists in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the compound of type 3 resides in this respect.

More specifically, the compound of type 3 is characterized in that the bond-forming reaction after the one-electron oxidation leads to formation of a new radical species of cyclic structure, from which the second electron is further released directly or through splitting of a proton to thereby cause an oxidation thereof.

Furthermore, the compounds of type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds of type 3 include one exhibiting such a capability that, without undergoing such a tautomeric reaction, further one or more, generally two or more, electrons are directly released from the two-electron oxidation product, resulting in oxidation thereof.

The compound of type 3 is preferably represented by the general formula (D):

$$RED_3\text{-}L_3\text{-}Y_3 \quad (D)$$

In the general formula (D), $RED_3$ represents a one-electron oxidizable reducing group, $Y_3$ represents a reactive moiety that reacts with one-electron oxidized $RED_3$. Specifically, $Y_3$ represents an organic group having a carbon-carbon double bond moiety, carbon-carbon triple bond moiety, aromatic moiety or benzo-condensed nonaromatic heterocyclic group. $L_3$ represents a linking group that links between $RED_3$ and $Y_3$.

In the general formula (D), $RED_3$ has the same meaning as $RED_{12}$ of the general formula (B).

In the general formula (D), $RED_3$ preferably represents an arylamino group, heterocyclic amino group, aryloxy group, arylthio group, aryl group, or aromatic or nonaromatic heterocyclic group (especially preferably a nitrogen-containing heterocyclic group). More preferably, $RED_3$ represents an arylamino group, heterocyclic amino group, aryl group, or aromatic or nonaromatic heterocyclic group. With respect to the heterocyclic group, it is preferred to use, for example, a tetrahydroquinoline ring group, tetrahydroquinoxaline ring group, tetrahydroquinazoline ring group, indoline ring group, indole ring group, carbazole ring group, phenoxazine ring group, phenothiazine ring group, benzothiazoline ring group, pyrrole ring group, imidazole ring group, thiazole ring group, benzimidazole ring group, benzimidazoline ring group, benzothiazoline ring group or 3,4-methylenedioxyphenyl-1-yl ring group.

An arylamino group (especially anilino), an aryl group (especially phenyl) or an aromatic or nonaromatic heterocyclic group is most preferred as $RED_3$.

When $RED_3$ represents an aryl group, it is preferred that the aryl group has at least one electron-donating group. Herein, the electron-donating group specifically refers to a hydroxyl group, alkoxy group, mercapto group, alkylthio group, sulfonamido group, acylamino group, alkylamino group, arylamino group, heterocyclic amino group, active methine group, electron-excessive aromatic heterocyclic group (e.g., indolyl, pyrrolyl or indazolyl), or a nonaromatic nitrogen-containing heterocyclic group that is bonded to $L_3$ via its nitrogen atom (e.g., pyrrolidinyl, indolinyl, piperidinyl, piperazinyl, morpholino or thiomorpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a cyclic structure.

When $RED_3$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to $L_3$ via its nitrogen atom. More preferably, the substituent is an alkylamino group, hydroxyl group, active methine group, or nonaromatic nitrogen-containing heterocyclic group that is bonded to $L_3$ via its nitrogen atom. Most preferably, the substituent is an alkylamino group, or nonaromatic nitrogen-containing heterocyclic group that is bonded to $L_3$ via its nitrogen atom.

When the reactive group represented by $Y_3$ is an organic substituted group having a carbon to carbon double bond or a carbon to carbon triple bond moiety, the substituent of the substituted organic group can preferably be any of, for example, an alkyl group (preferably having 1 to 8 carbon atoms), aryl group (preferably having 6 to 12 carbon atoms), alkoxycarbonyl group (preferably having 2 to 8 carbon atoms), carbamoyl group, acyl group and electron-donating group. Herein, the electron-donating group refers to any of an alkoxy group (preferably having 1 to 8 carbon atoms), hydroxyl group, amino group, alkylamino group (preferably having 1 to 8 carbon atoms), arylamino group (preferably having 6 to 12 carbon atoms), heterocyclic amino group (preferably having 2 to 6 carbon atoms), sulfonamido group, acylamino group, active methine group, mercapto group, an alkylthio group (preferably having 1 to 8 carbon atoms), arylthio group (preferably having 6 to 12 carbon atoms) and aryl group having any of these groups as a substituent (the number of carbon atoms of the aryl moiety is preferably in the range of 6 to 12). The hydroxyl group may be protected with a silyl group, for example, a trimethylsilyloxy group, t-butyldimethylsilyloxy group, triphenylsilyloxy group, triethylsilyloxy group or phenyldimethylsilyloxy group. Examples of the carbon to carbon double bond moiety and carbon to carbon triple bond moiety are vinyl group and ethynyl group, respectively.

When $Y_3$ represents an organic group comprising a carbon to carbon double bond moiety having a substituent, the substituent thereof is more preferably, for example, an alkyl group, phenyl group, acyl group, cyano group, alkoxycarbonyl group, carbamoyl group or electron-donating group. Herein, the electron-donating group preferably refers to any of an alkoxy group, hydroxyl group (which may be protected with a silyl group), amino group, alkylamino group, arylamino group, sulfonamido group, active methine group, mercapto group, alkylthio group and phenyl group having any of these electron-donating groups as a substituent, among the substituents mentioned above.

When the carbon to carbon double bond moiety has a hydroxyl group as a substituent, $Y_3$ contains a partial structure of the formula $>C_1{=}C_2(\text{—}OH)\text{—}$. This may be tautomerized into a partial structure of the formula $>C_1H\text{—}C_2(=O)\text{—}$. Further, in this structure, it is preferred that the substituent on $C_1$ carbon be an electron-withdrawing group. In this instance, $Y_3$ has a partial structure of "active methylene group" or "active methine group". The electron-withdrawing groups capable of providing this partial structure of active methylene group or active methine group are the same as mentioned in the above description of "active methine groups".

When $Y_3$ represents an organic group having a carbon to carbon triple bond moiety having a substituent, the substituent is preferably, for example, an alkyl group, phenyl group, alkoxycarbonyl group, carbamoyl group or electron-donating group. Herein, the electron-donating group preferably refers to any of an alkoxy group, amino group, alkylamino group, arylamino group, heterocyclic amino group, sulfonamido group, acylamino group, active methine group, mercapto group, alkylthio group and phenyl group having any of these electron-donating groups as a substituent.

When $Y_3$ represents an organic group having an aromatic group moiety, the aromatic group is preferably an indole ring group or an aryl group (especially preferably a phenyl group) having an electron-donating group as a substituent. Herein, the electron-donating group preferably refers to a hydroxyl group (the hydroxyl group may be protected with a silyl group), alkoxy group, amino group, alkylamino group, active methine group, sulfonamido group or mercapto group.

When $Y_3$ represents a benzo-condensed organic group having a nonaromatic heterocyclic moiety, the benzo-condensed nonaromatic heterocyclic group is preferably one having an aniline structure as an internal partial structure, which can be, for example, an indoline ring group, 1,2,3,4-tetrahydroquinoline ring group, 1,2,3,4-tetrahydroquinoxaline ring group or 4-quinolone ring group.

In the general formula (D), the reactive group represented by $Y_3$ is more preferably an organic group containing a carbon to carbon double bond moiety, aromatic group moiety or benzo-condensed nonaromatic heterocyclic group. Still more preferably, the reactive group is an organic group having a carbon to carbon double bond moiety, phenyl group having an electron-donating group as a substituent, indole ring group, or benzo-condensed nonaromatic heterocyclic group having an aniline structure as an internal partial structure. Herein, it is more preferred that the carbon to carbon double bond moiety have at least one electron-donating group as a substituent.

When the reactive group represented by $Y_3$ of the general formula (D) has the same partial structure as that of the reducing group represented by $RED_3$ of the general formula (D) as a result of selection within the range described hereinbefore, also, preferred examples of the compounds of the general formula (D) are provided thereby.

In the general formula (D), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, —$NR_N$—, —C(=O)—, —$SO_2$—, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (A). The linking group represented by $L_3$ can engage in linkage by replacing one arbitrary hydrogen atom of each of the groups represented by $RED_3$ and $L_3$ at an arbitrary position thereof.

The linking group represented by $L_3$ of the general formula (D) is preferably such that, when the cationic radical species ($X^{+}$.) formed as a result of oxidation of $RED_3$ of the general formula (D) or radical species (X.) formed through splitting of proton therefrom reacts with the reactive group represented by $Y_3$ of the general formula (D) to thereby form a bond, the relevant atomic groups engaging therein can form a 3- to 7-membered cyclic structure including $L_3$. From this viewpoint, it is preferred that the radical species ($X^{+}$. or X.), the reactive group represented by $Y_3$ and the group $L_3$ be linked to each other by a group of 3 to 7 atoms.

As a preferred example of $L_3$, there can be mentioned a divalent linking group selected from a single bond, alkylene group (especially methylene, ethylene or propylene), an arylene group (especially phenylene), —C(=O)— group, —O— group, —NH— group, —N(alkyl group)-group and combinations thereof.

Among the compounds of the general formula (D), preferred compounds are represented by the following general formulae (D-1) to (D-4):

(D-1)

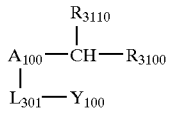

(D-2)

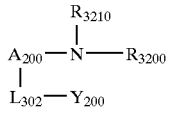

(D-3)

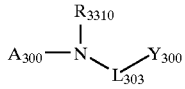

(D-4)

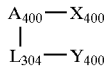

In the general formulae (D-1) to (D-4), each of $A_{100}$, $A_{200}$ and $A_{400}$ represents an arylene group or divalent heterocyclic group, and $A_{300}$ represents an aryl group or a heterocyclic group. The preferred range thereof is the same as that of $RED_3$ of the general formula (D). Each of $L_{301}$, $L_{302}$, $L_{303}$ and $L_{304}$ represents a linking group. With respect to these, not only the meanings but also the preferred ranges thereof are the same as those of $L_3$ of the general formula (D). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (D). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. $R_{3110}$ and $A_{100}$; $R_{3210}$ and $A_{200}$; and $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

Among the compounds of the general formulae (D-1) to (D-4), the compounds of the general formulae (D-2), (D-3) and (D-4) are preferred. The compounds of the general formulae (D-2) and (D-3) are more preferred.

The compound of type 4 will be described below.

The compound of type 4 is a compound having a circular structure substituted with a reducing group, which compound can undergo a one-electron oxidation of the reducing group and thereafter a cleavage reaction of the circular structure to thereby further release one or more electrons.

In the compound of type 4, the cyclic structure is cleaved after a one-electron oxidation. Herein, the cyclic cleavage reaction refers to the following scheme of reaction:

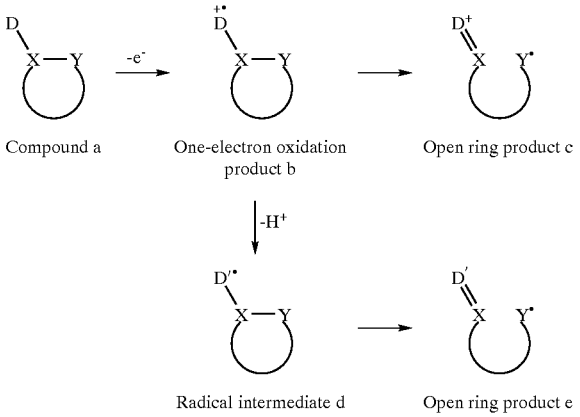

In the formulae, the compound a represents a compound of type 4. In the compound a, D represents a reducing group, and X and Y represent atoms forming a bond of the circular structure which is cleaved after a one-electron oxidation. First, the compound a undergoes a one-electron oxidation to thereby form a one-electron oxidation product b. Then, the D—X single bond is converted to a double bond, and simultaneously the X—Y bond is cleaved to thereby form an open-ring product c. An alternative route wherein a proton is split from the one-electron oxidation product b to thereby form a radical intermediate d, from which an open-ring product e is similarly formed, may be taken. One or more electrons are further released from the thus formed open-ring product c or e. The characteristic of this compound of the present invention resides in this respect.

The cyclic structure of the compound of type 4 refers to a nonaromatic, saturated or unsaturated, monocyclic or condensed-ring, 3- to 7-membered carbon ring or heterocycle. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

The compound of type 4 is preferably represented by the general formula (E) or (F):

(E)

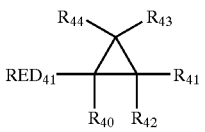

(F)

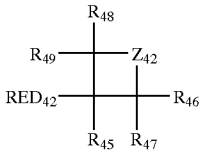

With respect to $RED_{41}$ and $RED_{42}$ of the general formulae (E) and (F), not only the meanings but also the preferred ranges thereof are the same as those of $RED_{12}$ of the general formula (B). Each of $R_{40}$ to $R_{44}$ and $R_{45}$ to $R_{49}$ represents a hydrogen atom or substituent. The substituent can be any of those which may be had by $RED_{12}$. In the general formula (F), $Z_{42}$ represents $—CR_{420}R_{421}—$, $—NR_{423}—$ or —O—. Each of $R_{420}$ and $R_{421}$ represents a hydrogen atom or substituent, and $R_{423}$ represents a hydrogen atom, alkyl group, aryl group or heterocyclic group.

In the general formula (E), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that a case wherein at least one thereof be a donating group. It is also preferred that a case wherein $R_{41}$ and $R_{42}$; or $R_{43}$ and $R_{44}$ be simultaneously electron-withdrawing groups. The electron-withdrawing groups are the same as those mentioned in the above description of active methine group. More preferably, at least one of $R_{41}$ to $R_{44}$ is a donating group. Most preferably, at least one of $R_{41}$ to $R_{44}$ is a donating group while, a group(s) that is not a donating group among $R_{41}$ to $R_{44}$, is (are) a hydrogen atom or alkyl group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring (the 5-membered aromatic ring may be monocyclic or in the form of condensed rings), a nonaromatic nitrogen-containing heterocyclic group that is bonded to the carbon atom of the general formula (E) via its nitrogen atom and phenyl group substituted with at least one electron-donating group (wherein the electron-donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the phenyl group via its nitrogen atom). Of these, an alkylamino group, arylamino group, 5-membered aromatic heterocyclic group having one nitrogen atom in its ring (wherein the aromatic heterocycle refers to an indole ring, pyrrole ring or carbazole ring), and a phenyl group substituted with at least one electron-donating group (in particular, a phenyl group substituted with three or more alkoxy groups or a phenyl group substituted with a hydroxyl group, alkylamino group or arylamino group), are more preferred. An arylamino group, 5-membered aromatic heterocyclic group having one nitrogen atom in its ring (wherein the 5-membered aromatic heterocyclic group represents a 3-indolyl group), and a phenyl group substituted with at least one electron-donating group (in particular, a trialkoxyphenyl group or a phenyl group substituted with an alkylamino group or arylamino group), are most preferred.

In the general formula (F), the preferred range of $R_{45}$ is the same as described above with respect to $R_{40}$ of the general formula (E). Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{420}R_{421}$— or —$NR_{423}$—, and more preferably represents —$NR_{423}$—. Each of $R_{420}$ and $R_{421}$ preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having, in its molecule, a group adsorptive to silver halides" or "compounds each having, in its molecule, a partial structure of spectral sensitizing dye". More preferably, the compounds of types 1, 3 and 4 according to the present invention are "compounds each having, in its molecule, a group adsorptive to silver halides". The compound of type 2 is a "compound having, in its molecule, two or more groups adsorptive to silver halides". The compounds of types 1 to 4 are more preferably "compounds each having a nitrogen-containing heterocyclic group substituted with two or more mercapto groups as an adsorptive group".

With respect to the compounds of types 1 to 4 according to the present invention, the adsorptive group to silver halides refers to a group directly adsorbed onto silver halides or a group capable of promoting the adsorption onto silver halides. For example, the adsorptive group is a mercapto group (or a salt thereof), thione group (—C(═S)—), heterocyclic group containing at least one atom selected from a nitrogen atom, sulfur atom, selenium atom and tellurium atom, sulfido group, cationic group or ethynyl group. Provided however that, with respect to the compound of type 2 according to the present invention, a sulfido group is not included in the adsorptive groups thereof.

The terminology "mercapto group (or a salt thereof)" as the adsorptive group means not only a mercapto group (or a salt thereof) per se but also, preferably, a heterocyclic, aryl or alkyl group substituted with at least one mercapto group (or a salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(═S)—NH— group) or a group containing a partial structure of the thioamido group, namely, a linear or cyclic thioamido group, thioureido group., thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group.

The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the α-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "═N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—". Preferably, the sulfido group is a group having a partial structure of alkyl (or alkylene) —S— alkyl (or alkylene), aryl (or arylene) —S— alkyl (or alkylene), or aryl (or arylene) —S— aryl (or arylene). This sulfido group may be in the form of a cyclic structure or —S—S— group. As examples of sulfido groups forming a cyclic structure, there can be mentioned groups containing a thiolane ring, 1,3-dithiolane ring, 1,2-dithiolane ring, thiane ring, dithiane ring, tetrahydro-1,4-thiazine ring (thiomorpholine ring) or the like. Among the sulfido groups, groups having a partial structure of alkyl (or alkylene) —S-alkyl (or alkylene) are especially preferred.

The cationic group as the adsorptive group refers to a group containing a quaternary nitrogen atom. For example, it is a group containing an ammonio group or a nitrogen-containing heterocyclic group containing a quaternary nitrogen atom. However, the cationic group does not become part of an atomic group forming a dye structure (for example, cyanine chromophore). Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of JP-A-11-95355.

In the present invention, it is preferred that the adsorptive group be a nitrogen-containing heterocyclic group substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Examples of such compounds may include a compound possessing in its molecule two or more adsorptive groups having the above mercapto group or thione group as a partial structure (e.g., a ring forming thioamido group, alkylmercapto group, arylmercapto group or heterocyclic mercapto group), and a compound possessing at least one adsorptive group having, in the adsorptive group per se, two or more mercapto groups or thione groups as a partial structure (e.g., a dimercapto-substituted nitrogen-containing heterocyclic group).

As examples of adsorptive groups having two or more mercapto groups as a partial structure (e.g., dimercapto-substituted nitrogen-containing heterocyclic groups), there can be mentioned a 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo[1,5-a]pyrimidine group, 2,6,8-trimercaptopurine group, 6,8-dimercaptopurine group, 3,5,7-trimercapto-s-triazolotriazine group, 4,6-dimercaptopyrazolopyrimidine group and 2,5-dimercaptoimidazole group. Of these, a 2,4-dimercaptopyrimidine group, 2,4-dimercaptotriazine group and 3,5-dimercapto-1,2,4-triazole group are especially preferred.

Although substitution with the adsorptive group may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$.

The partial structure of spectral sensitizing dye refers to a group containing a chromophore of spectral sensitizing dye, and refers to a residue resulting from removal of an arbitrary hydrogen atom or substituent from a spectral sensitizing dye compound. Although substitution with the partial structure of spectral sensitizing dye may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_{11}$ to $RED_{42}$. Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964. Further, all the dyes described on pages 7 to 14 of JP-A-11-95355 (U.S. Pat. No. 6,054,260) per se are applicable.

With respect to the compounds of types 1 to 4 according to the present invention, the total number of carbon atoms is preferably in the range of 10 to 60, more preferably 10 to 50, most preferably 11 to 40, and optimally 12 to 30.

With respect to the compounds of types 1 to 4 according to the present invention, a one-electron oxidation of the compounds is induced upon exposure of the silver halide photographic photosensitive material using the compounds. After the subsequent reaction, another electron, or two or more electrons depending on the type of compound are released to thereby cause further oxidation. The oxidation potential with respect to the first electron is preferably about 1.4 V or below, more preferably 1.0 V or below. This oxidation potential is preferably higher than 0 V, more preferably higher than 0.3 V. Thus, the oxidation potential is preferably in the range of about 0 to about 1.4 V, more preferably about 0.3 to about 1.0 V.

Herein, the oxidation potential can be measured in accordance with the cyclic voltammetry technique. Specifically, a sample compound is dissolved in a solution consisting of a 80%:20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1 V/sec with the use of a glassy carbon disk as a working electrode, a platinum wire as a counter electrode and a calomel electrode (SCE) as a reference electrode. The oxidation potential vs. SCE is determined at the peak potential of cyclic voltammetry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2 V, more preferably −0.7 to −2 V, and most preferably −0.9 to −1.6 V.

With respect to, among the compounds of types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds of types 1 to 4 according to the present invention will be listed below, which however in no way limit the scope of the present invention.

1

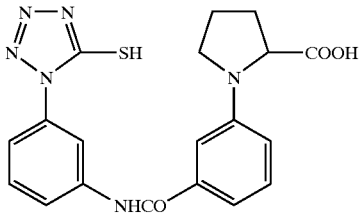

2

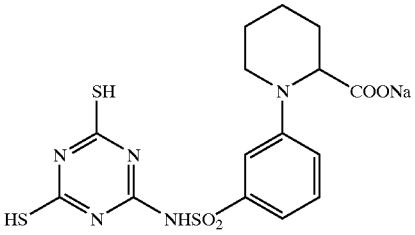

3

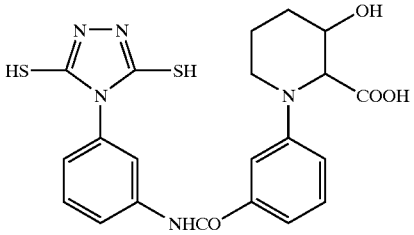

4

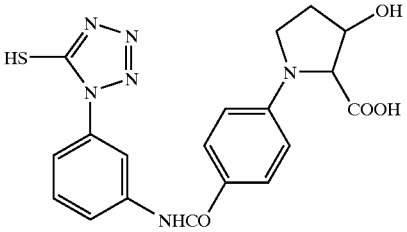

5

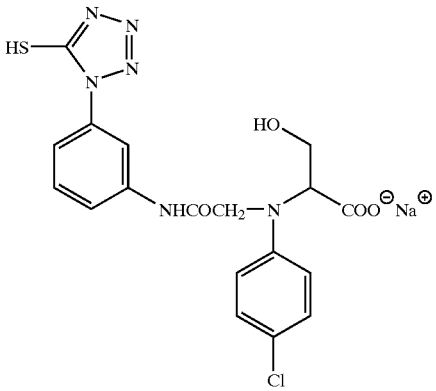

6

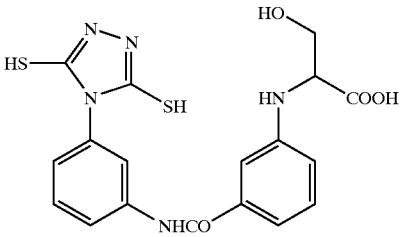

7

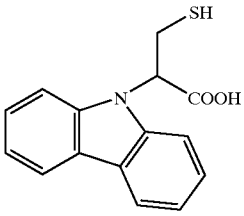

8

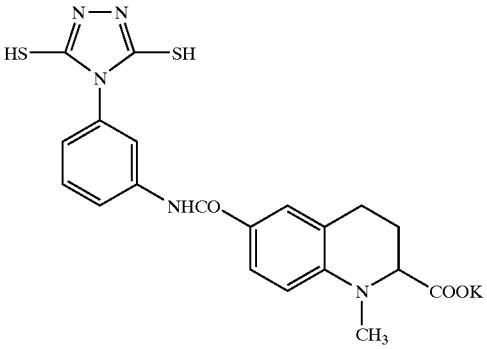

-continued
9
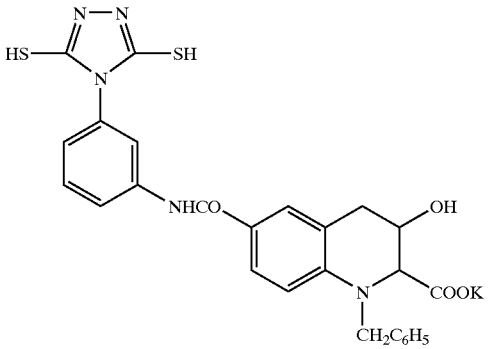
10
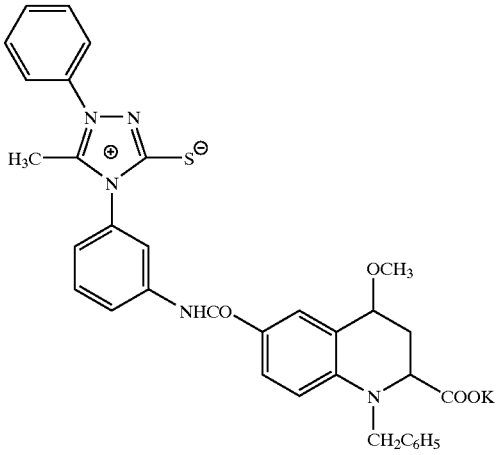
11
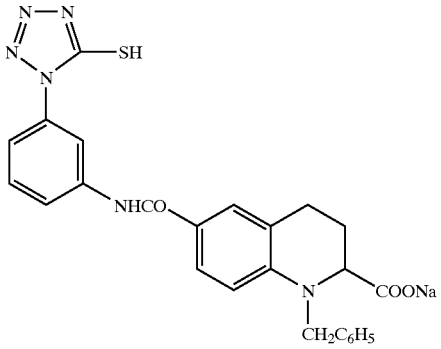
12
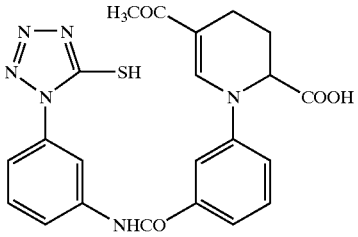
13
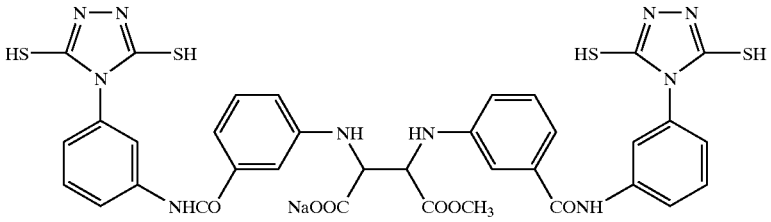
14
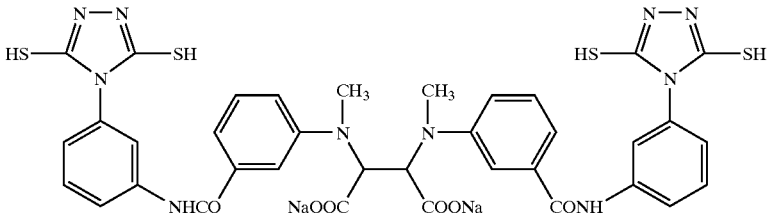
15
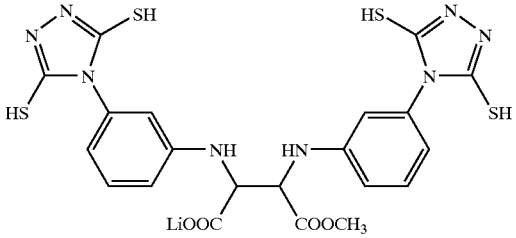
16
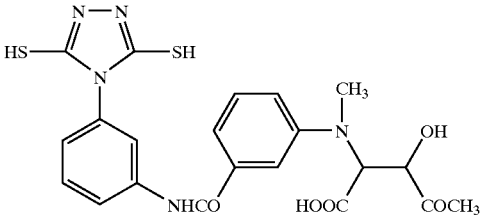

-continued
17
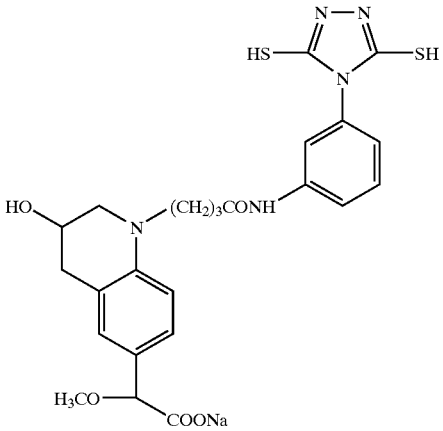
18
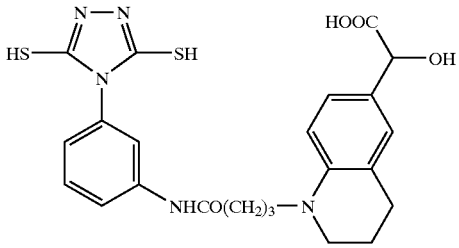
19
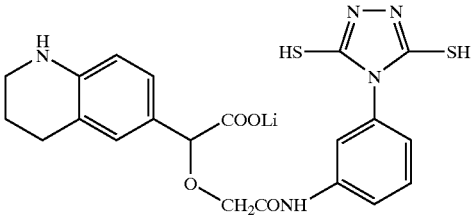
20
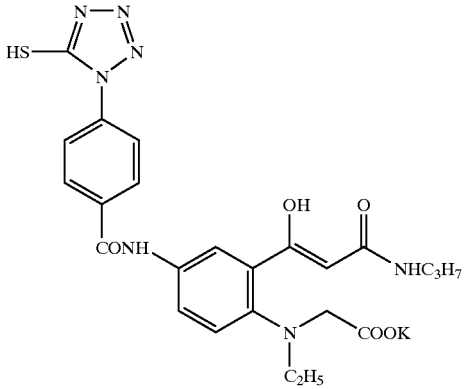
21
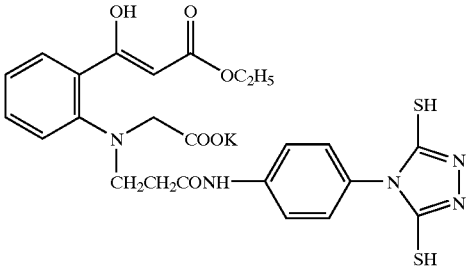
22
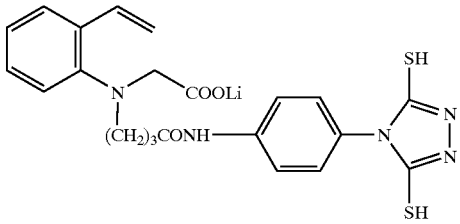
23
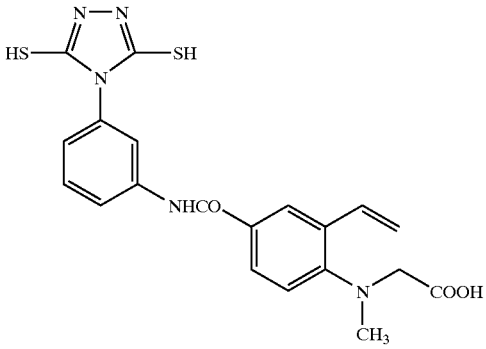
24
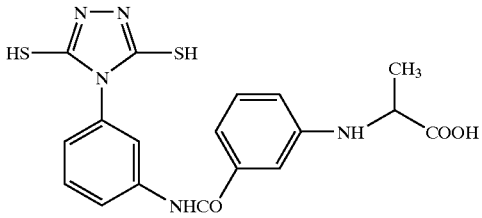

-continued
25
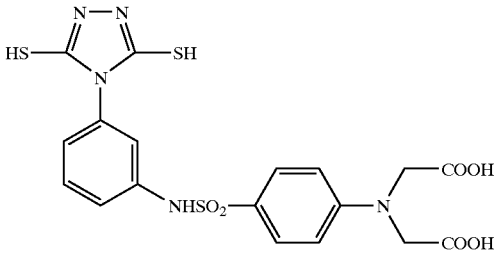
26
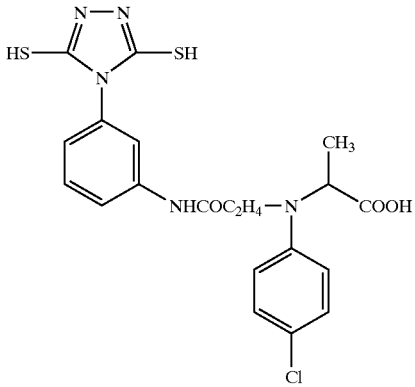
27
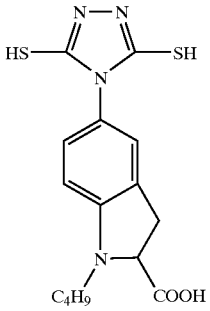
28
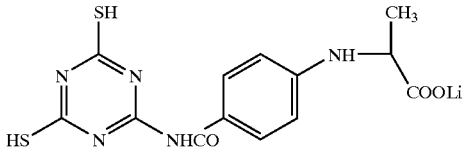
29
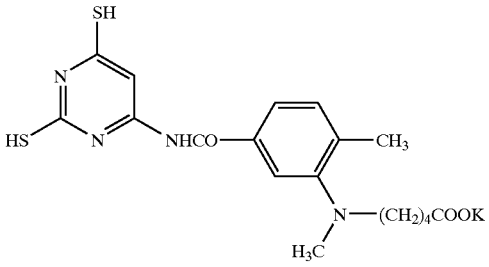
30
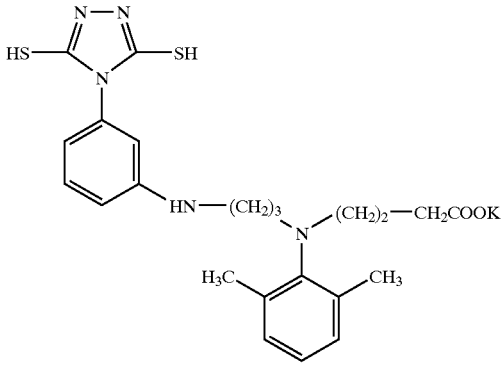
31
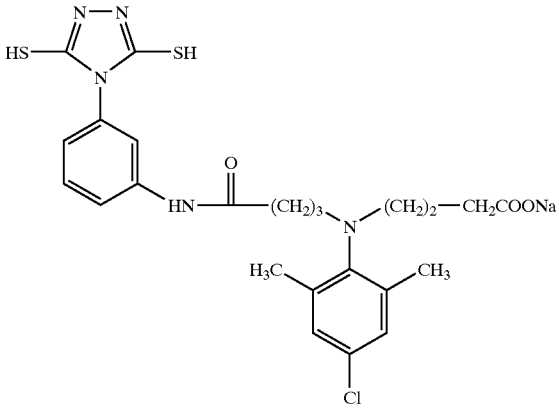
32
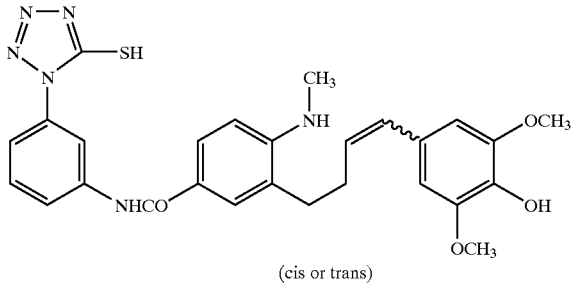

-continued
33
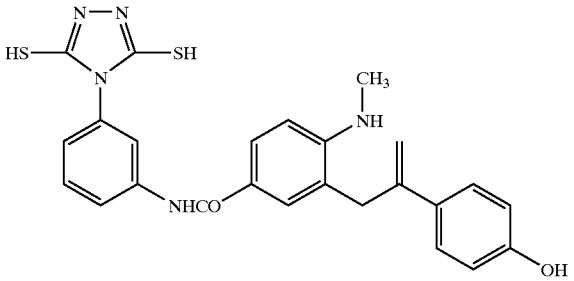
34
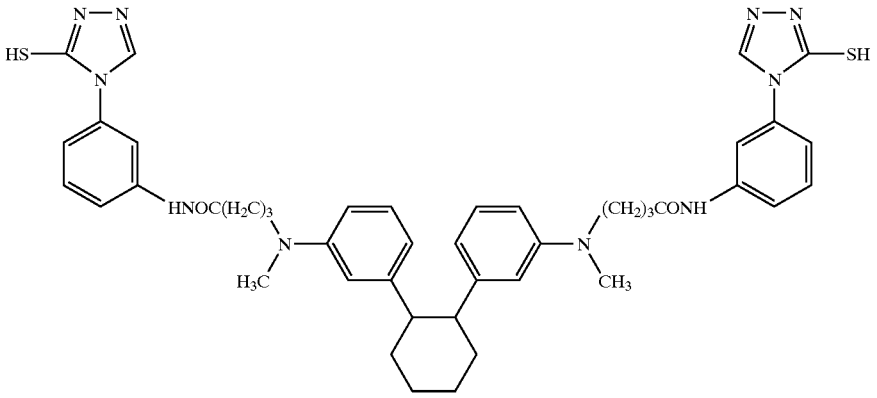
35
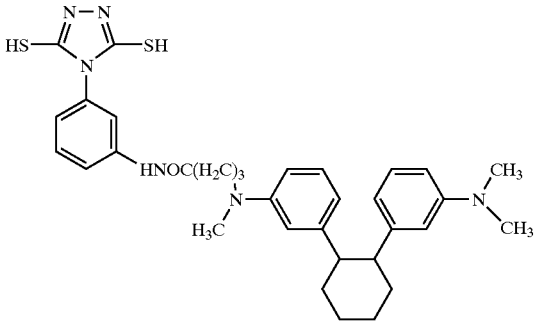
36
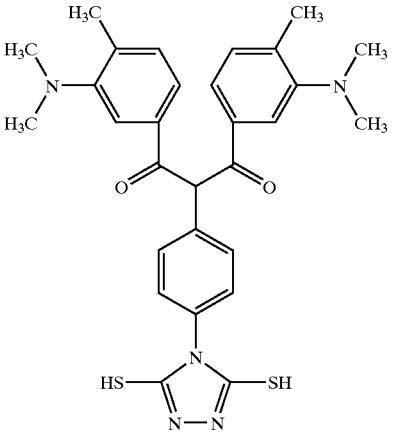
37
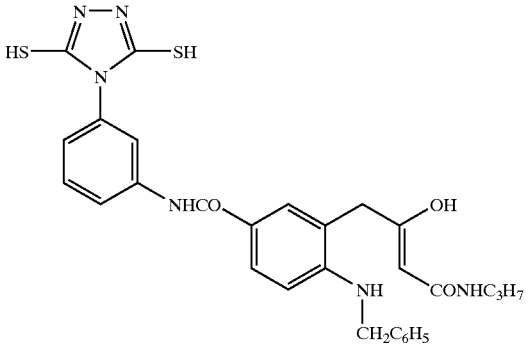
38
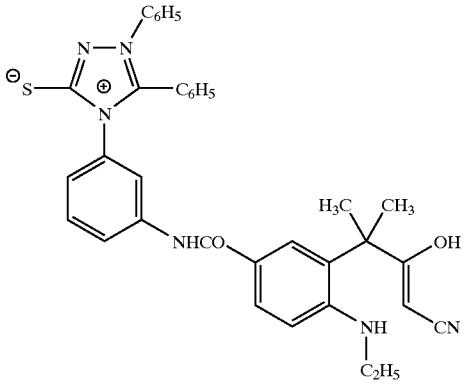

-continued
39
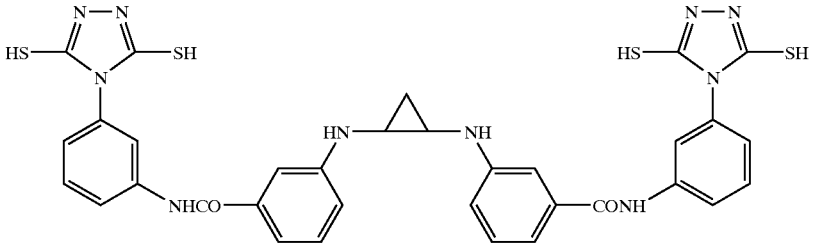
40
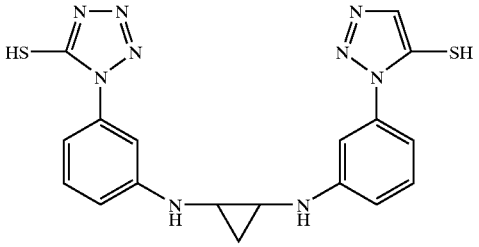
41
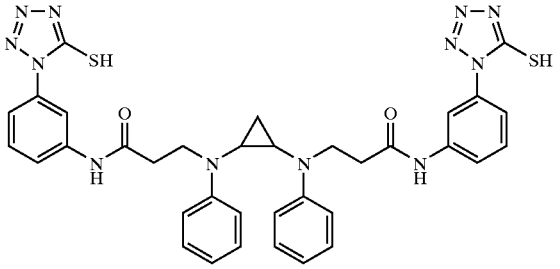
42
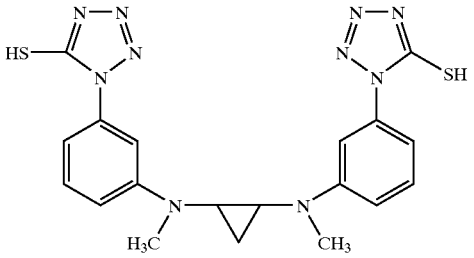
43
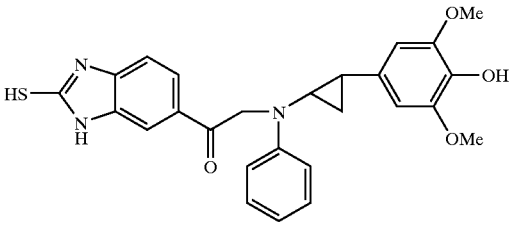
44
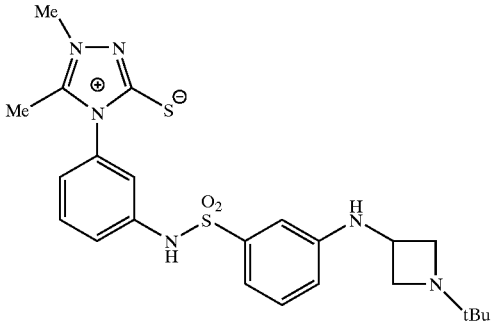
45
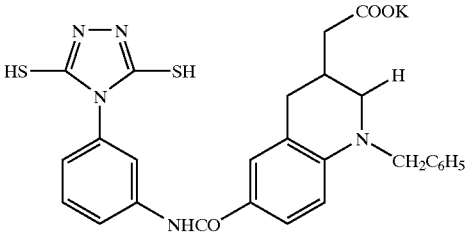
46
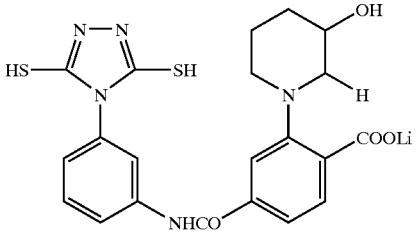
47
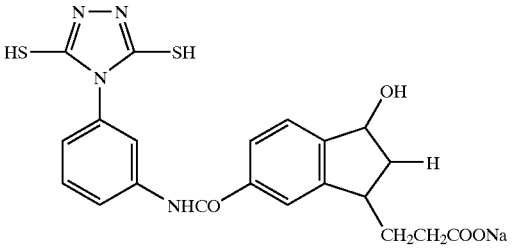

-continued
48
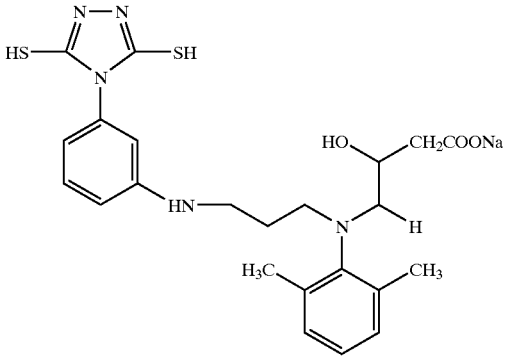
49
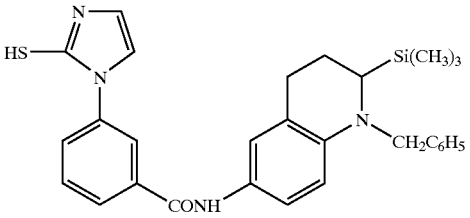
50
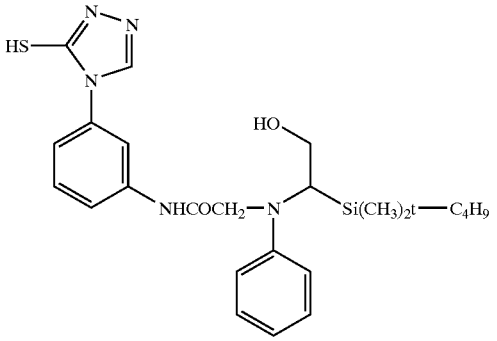
51
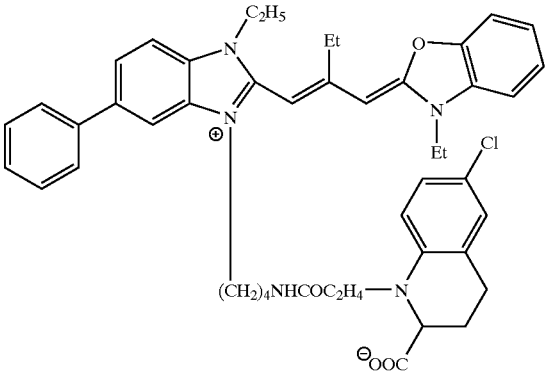
52
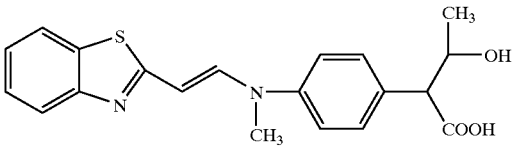
53
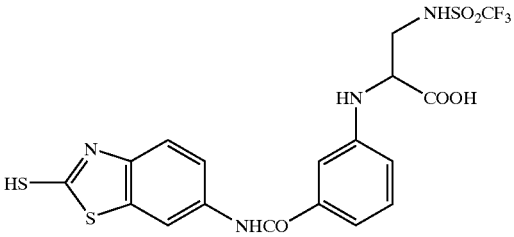
54
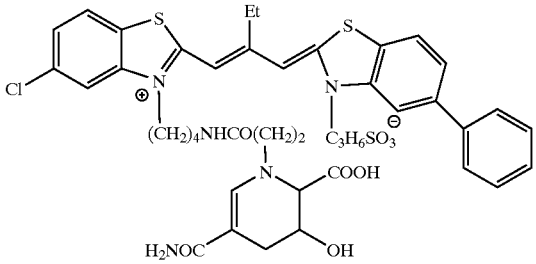
55
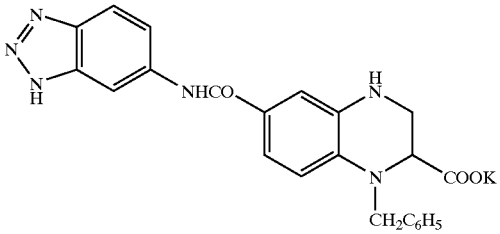
56
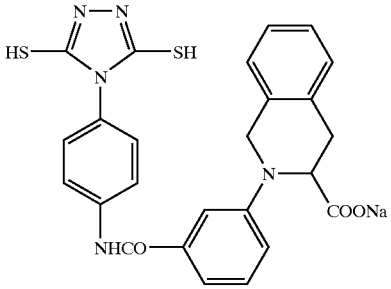
57
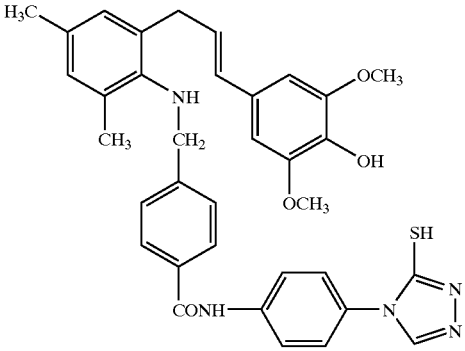

-continued

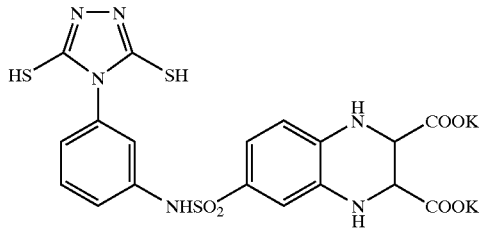

The compounds of types 1 to 4 according to the present invention are the same as those described in detail in Japanese Patent Applications Nos. 2002-192373, 2002-188537, 2002-188536 and JP-A-2003-75950, the disclosures of which are incorporated herein by reference. The specific compounds disclosed in the specifications of these patent applications can also be mentioned as specific examples of the compounds of types 1 to 4 according to the present invention. Further, examples of synthesis of the compounds of types 1 to 4 according to the present invention are also the same as those described in these patent applications.

The compound of type 5 will be described below.

The compound of type 5 is represented by X—Y, wherein X represents a reducing group and Y represents a split-off group. The compound of type 5 is such a compound that the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing another electron. The reaction when such compound as type 5 is oxidized may be represented by the following formulae:

$$X{-}Y \xrightarrow[(-e^-)]{\text{Oxidation}} (X{-}Y)^{+\bullet} \xrightarrow{\text{Cleavage}} X\bullet + Y^+ \xrightarrow[(-e^-)]{\text{One-electron release}} X^+$$

The oxidation potential of the compound of type 5 is preferably in the range of 0 to 1.4 V, more preferably 0.3 to 1.0 V. The oxidation potential of the radical X. formed according to the above reaction formula is preferably in the range of −0.7 to −2.0 V, more preferably −0.9 to −1.6 V.

The compound of type 5 is preferably represented by the general formula (G):

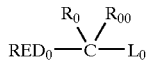

(G)

In the general formula (G), $RED_0$ represents a reducing group. $L_0$ represents a split-off group, and each of $R_0$ and $R_{00}$ represents a hydrogen atom or substituent. $RED_0$ and $R_0$, and also $R_0$ and $R_{00}$ may be bonded with each other to thereby form a ring structure. $RED_0$ represents the same groups as those represented by $RED_2$ of the general formula (C), and the preferred ranges thereof are also the same. $R_0$ and $R_{00}$ respectively represent the same groups as those represented by $R_{21}$ and $R_{22}$ of the general formula (C), and the preferred ranges thereof are also the same. Provided, however, that each of $R_0$ and $R_{00}$ does not represent the same groups as those represented by $L_0$, except for a hydrogen atom. $RED_0$ and $R_0$ may be bonded with each other to thereby form a ring structure. This ring structure can be, for example, any of those formed by bonding between $RED_2$ and $R_{21}$ of the general formula (C), and the preferred ranges thereof are also the same. Examples of the ring structures formed by bonding between $R_0$ and $R_{00}$ include a cyclopentane ring and a tetrahydrofuran ring. $L_0$ of the general formula (G) represents the same groups as those represented by $L_2$ of the general formula (C), and the preferred ranges thereof are also the same.

Each of the compounds of the general formula (G), although preferably having, in its molecule, an adsorptive group to silver halides or a partial structure of spectral sensitizing dye, does not simultaneously have two or more adsorptive groups in its molecule when $L_0$ represents a group other than a silyl group. Provided, however, that with respect to the sulfide group as an adsorptive group, two or more thereof may be had, irrespective of $L_0$.

The adsorptive groups to silver halides possessed by the compounds of the general formula (G) can be, for example, those which may be had by the compounds of types 1 to 4 according to the present invention. Furthermore, the adsorptive groups include a selenoxo group (—C═Se—), a telluroxo group (—C═Te—), a seleno group (—Se—), a telluro group (—Te—) and an active methine group. Herein, the selenoxo group (—C═Se—) and telluroxo group (—C═Te—) respectively refer to Se and Te derivatives of a compound having a thione group (—C═S—) and, as mentioned above with respect to thione groups, may be groups containing a selenoamido group (—C═Se—NH—) and a telluramido group (—C═Te—NH—), respectively. The seleno group (—Se—) and telluro group (—Te—) also respectively refer to Se and Te derivatives of a compound having a sulfido group (—S—), and can be, for example, any of Se and Te substitution products of compounds having a sulfido group. The active methine group refers to a methine group substituted with two electron-withdrawing groups. Herein, the electron-withdrawing group refers to an acyl group, alkoxycarbonyl group, aryloxycarbonyl group, carbamoyl group, alkylsulfonyl group, arylsulfonyl group, sulfamoyl group, trifluoromethyl group, cyano group, nitro group or carbonimidoyl group. The above two electron-withdrawing groups may be bonded with each other to thereby form a ring structure.

The adsorptive groups possessed by the compounds of the general formula (G) are preferably a mercapto group (or its salt), thione group (—C═S—), heterocyclic group containing at least one atom selected from a nitrogen atom, sulfur atom, selenium atom and tellurium atom, and sulfido group. More preferably, the adsorptive groups are a nitrogen-containing heterocyclic group substituted with mercapto, and a nitrogen-containing heterocyclic group having a —NH— group capable of forming iminosilver (>NAg) as a partial structure of the heterocycle. These are the same as those described with respect to the preferred range of adsorptive groups which may be possessed by the compounds of types 1 to 4. Although the site of adsorptive group substitution in the general formula (G) is not limited, the substitution is preferably effected at $RED_0$ or $R_0$, more preferably $RED_0$.

The partial structure of spectral sensitizing dye which may be had by the compounds of the general formula (G) is the same as the partial structure of spectral sensitizing dye which may be had by the compounds of types 1 to 4 according to the present invention.

Specific examples of the compounds of the general formula (G) will be set out below, to which however the present invention is in no way limited.

G-1

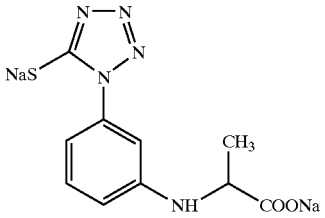

G-2

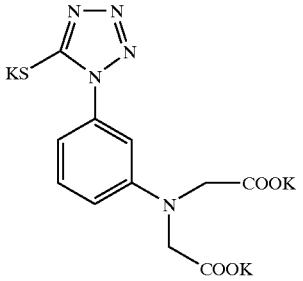

G-3

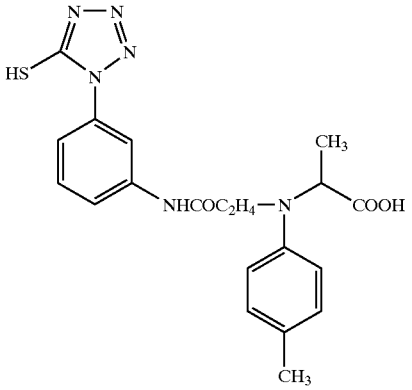

G-4

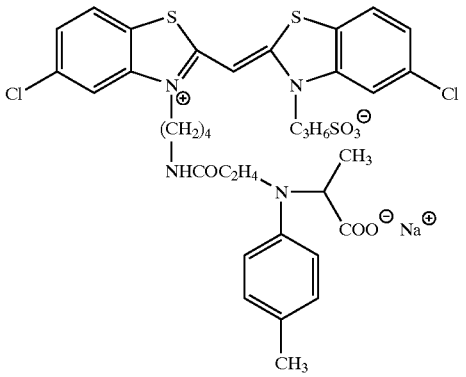

-continued

G-5

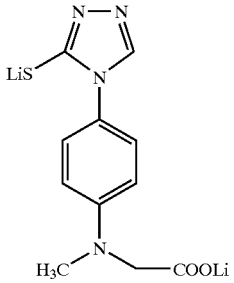

G-6

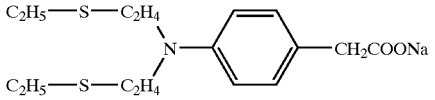

G-7

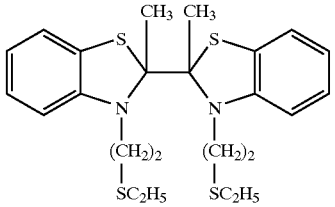

G-8

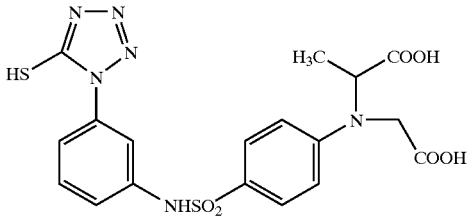

G-9

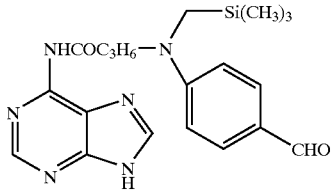

G-10

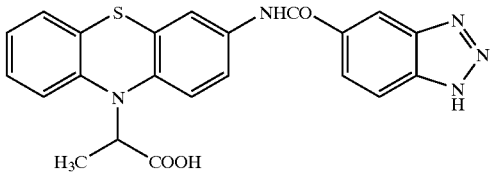

G-11

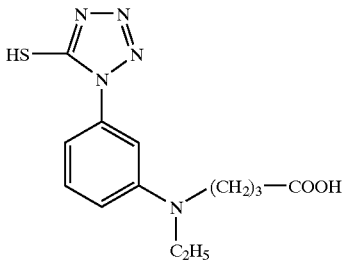

-continued
G-12
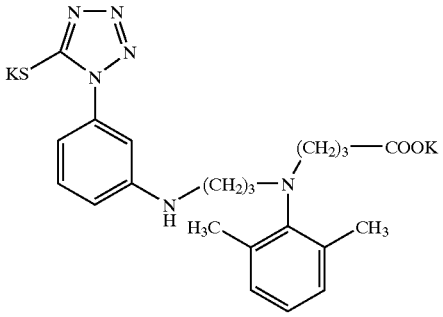
G-13
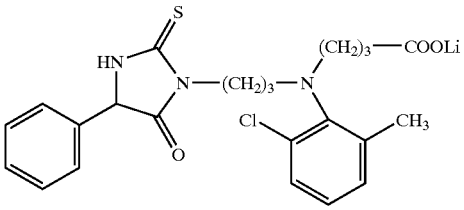
G-14
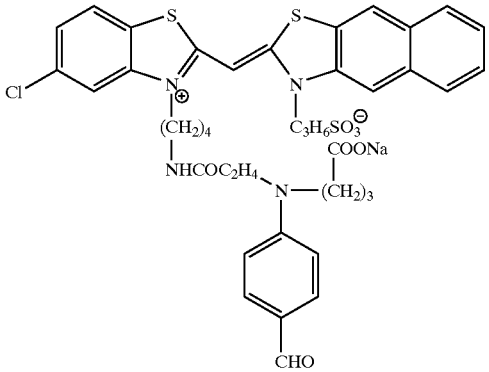
G-15
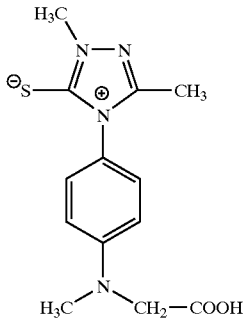
G-16
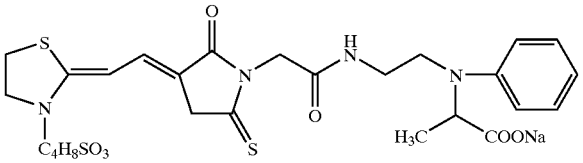
G-17
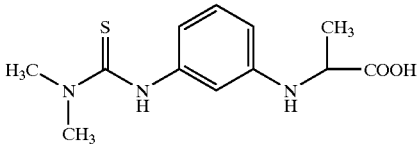
-continued
G-18
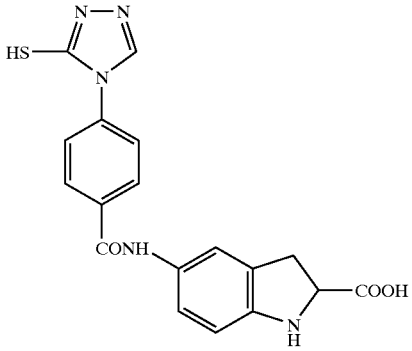
G-19
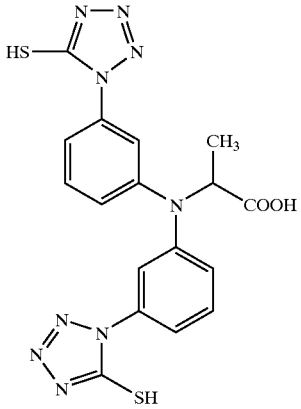
G-20
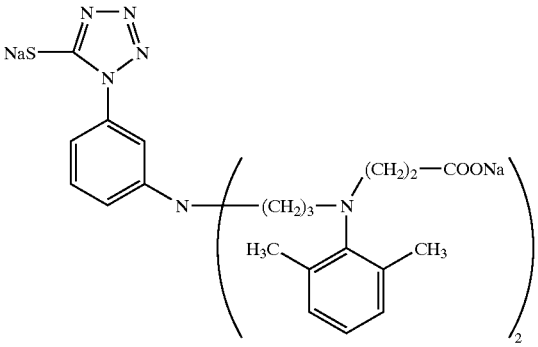
G-21
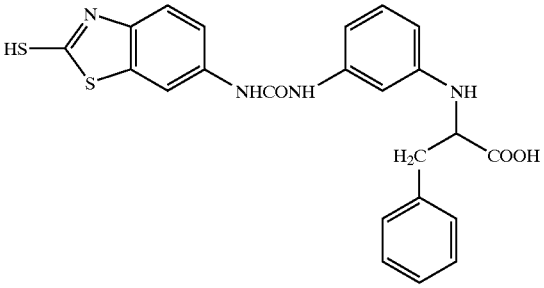

-continued

G-22

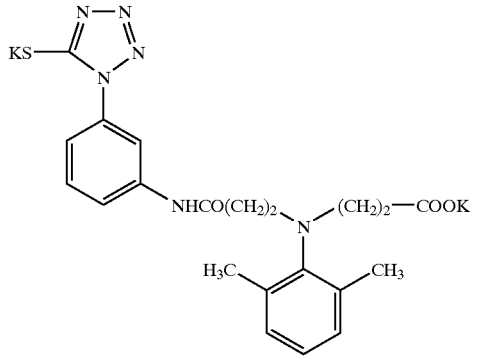

G-23

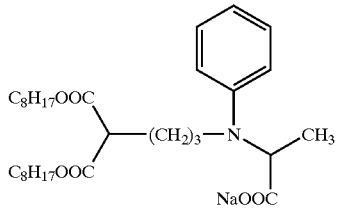

G-24

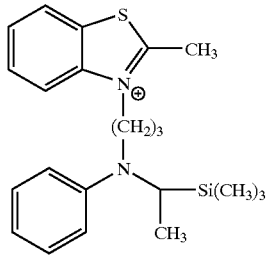

Specific examples of the compounds of the general formula (G) further include examples of compounds described as "one photon two electrons sensitizers" or "deprotonating electron-donating sensitizers" in the patent publications and specifications of, for example, JP-A-9-211769 (compounds PMT-1 to S-37 listed in Tables E and F on pages 28 to 32), JP-A-9-211774, JP-A-11-95355 (compounds INV 1 to 36), Japanese Patent Application KOHYO Publication 2001-500996 (compounds 1 to 74, 80 to 87 and 92 to 122), U.S. Pat. Nos. 5,747,235 and 5,747,236, EP 786692A1 (compounds INV 1 to 35), EP 893732A1 and U.S. Pat. Nos. 6,054,260 and 5,994,051, the disclosures of which are incorporated herein by reference.

The compound of types 1 to 5 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of types 1 to 5 according to the present invention may preferably be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of types 1 to 5 according to the present invention is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

In the silver halide color photosensitive material of the present invention, the weight-averaged wavelength of spectral sensitivity distribution of a green-sensitive silver halide emulsion layer ($\lambda_G$) preferably satisfies the relationship: 520 nm$<\lambda_G\leqq$580 nm, and the weight-averaged wavelength ($\lambda_{-R}$) of spectral sensitivity distribution of magnitude of interlayer effect exerted on a red-sensitive silver halide emulsion layer by other silver halide emulsion layers at 500 nm to 600 nm satisfies the relationship: 500 nm$<\lambda_{-R}<$560 nm. The difference of $\lambda_G-\lambda_{-R}$ is preferably 5 nm or greater, more preferably 10 nm or greater.

$$\lambda_G = \frac{\int_{500}^{600} \lambda S_G(\lambda)\,d\lambda}{\int_{500}^{600} S_G(\lambda)\,d\lambda}$$

In the formula, $S_G(\lambda)$ represents a spectral sensitivity distribution curve of a green-sensitive silver halide emulsion layer. The $S_G$ at a specific wavelength $\lambda$ is expressed as the inverse number of exposure amount at which the magenta density becomes fog+0.5 at the time of exposure of specific wavelength.

For exerting the above interlayer effect on the red-sensitive layer within a specific wavelength region, it is preferred to dispose a separate interlayer effect-donating layer containing silver halide grains, which has been subjected to given spectral sensitization. For realizing the spectral sensitivity desired in the present invention, the weight-averaged wavelength of the sensitivity of the interlayer effect-donating layer is preferably set at 510 to 540 nm.

The above weight-averaged wavelength ($\lambda_{-R}$) of the distribution of magnitude of interlayer effect exerted on a red-sensitive silver halide emulsion layer by other silver halide emulsion layers in the region of 500 nm to 600 nm can be determined by the method described in Jpn. Pat. Appln. KOKOKU Publication No. (hereinafter referred to as JP-B-) 3-10287.

In the present invention, it is preferred that the weight-averaged wavelength $\lambda_R$ of spectral sensitivity distribution of a red-sensitive layer be 630 nm or less. Herein, the weight-averaged wavelength $\lambda_R$ of a red-sensitive layer is defined by the formula (I).

$$\lambda_R = \frac{\int_{550}^{700} \lambda S_R(\lambda)\,d\lambda}{\int_{550}^{700} S_R(\lambda)\,d\lambda}$$

In the formula, $S_R(\lambda)$ represents a spectral sensitivity distribution curve of a red-sensitive layer. The $S_R$ at specific wavelength $\lambda$ is expressed as the inverse number of exposure amount at which the cyan density becomes fog+0.5 at the time of exposure of specific wavelength.

Compounds which react with developing agent oxidation products obtained by development to thereby release a development inhibitor or a precursor thereof are used as the material for exerting the interlayer effect. For example, use can be made of DIR (development inhibitor-releasing) couplers, DIR hydroquinone and couplers capable of releasing DIR hydroquinone or a precursor thereof. When the development inhibitor has a high diffusivity, the development inhibiting effect can be exerted irrespective of the position of the donor layer in the interlayer multilayer structure. However, there also occurs a development inhibiting effect in unintended directions. Therefore, for correcting this, it is preferred that the donor layer be colored (for example, coloring is made into the same color as that of the layer on which undesirable development inhibitor effect is exerted). For causing the photosensitive material of the present invention to obtain desirable spectral sensitivity, it is preferred that the donor layer capable of exerting the interlayer effect realize magenta color formation.

The emulsion which can be used in the photosensitive material of the present invention (hereinafter also referred to as "emulsion of the present invention") relates to an emulsion of tabular grains of silver iodobromide, silver bromide or silver chloroiodobromide.

In the color photosensitive material of the present invention, preferably, each of the unit lightsensitive layers consists of a plurality of silver halide emulsion layers which are substantially identical with each other in color sensitivity but differ from each other in photographic speed, and 50% or more of the total projected area of silver halide grains contained in at least one layer of the emulsion layers of highest speeds among the silver halide emulsion layers constituting each of the unit lightsensitive layers consists of tabular silver halide grains (hereinafter also referred to as "tabular grains"). In the present invention, the average aspect ratio of the tabular grains is preferably 8 or greater, more preferably 12 or greater, and most preferably 15 or greater.

With respect to the tabular grains, the terminology "aspect ratio" means the ratio of diameter to thickness of silver halides. That is, it is a quotient of the diameter divided by the thickness of each individual silver halide grain. The terminology "diameter" used herein refers to the diameter of a circle having an area equal to the projected area of grain as obtained when observing silver halide grains through a microscope or an electron microscope. Herein, the terminology "average aspect ratio" means an average of the aspect ratios of all the tabular grains of each emulsion.

The method of taking a transmission electron micrograph by the replica technique and measuring the equivalent circular diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the main planes of tabular grains is hexagonal, the adjacent side ratio (maximum side length/minimum side length) thereof being 2 or less. The adjacent side ratio is preferably 1.6 or less, more preferably 1.2 or less. It is needless to mention that the lower limit thereof is 1.0. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito.

The hexagonal tabular grains contained in the photosensitive material of the present invention are formed through the steps of nucleation, Ostwald ripening and growth. Although all of these steps are important for suppressing the spread of grain size distribution, attention should be paid so as to prevent the spread of size distribution at the first nucleation step because the spread of size distribution brought about in a preceding step cannot be narrowed by a previous step. What is important in the nucleation step is the relationship between the temperature of reaction mixture and the period of time of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al. describes that the suitable temperature at nucleation is 60° C. or below.

Gelatin may be further added during the grain formation in order to obtain monodisperse tabular grains of high aspect ratio. The added gelatin preferably consists of a chemically modified gelatin as described in JP-A's-10-148897 and 11-143002, the disclosures of which are incorporated herein by reference. Although this chemically modified gelatin is a gelatin characterized in that at least two carboxyl groups have newly been introduced at a chemical modification of amino groups contained in the gelatin, it is preferred that gelatin trimellitate be used as the same. Also, gelatin succinate is preferably used. The chemically modified gelatin is preferably added prior to the growth step, more preferably immediately after the nucleation. The addition amount thereof is preferably 60% or greater, more preferably 80% or greater, and most preferably 90% or greater, based on the total weight of dispersion medium used in grain formation.

The tabular grain emulsion is constituted of silver iodobromide, silver bromide or silver chloroiodobromide. Although silver chloride may be contained, the silver chloride content is preferably 8 mol % or less, more preferably 3 mol % or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circular diameter of the tabular grain emulsion can be facilitated by lowering the silver iodide content. The variation coefficient of the grain size distribution of the tabular grain emulsion is more preferably 20% or less, and the silver iodide content is more preferably 10 mol % or less.

It is preferred that the tabular grain emulsion has some intragranular structure with respect to the silver iodide distribution. The silver iodide distribution may have a double structure, a treble structure, a quadruple structure or a structure of higher order.

In the present invention, the tabular grains preferably have a dislocation line. The dislocation line of tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from an emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (200 kV or higher on the grains of 0.25 $\mu$m thickness) is preferred for ensuring clearer observation. The thus obtained photograph of grains enables determining the position and number of dislocation lines in each grain viewed in the direction perpendicular to the main planes.

The number of dislocation lines of the tabular grains of the present invention is preferably 10 or greater per grain on the average, more preferably 20 or greater per grain on the average. When dislocation lines are densely present or when dislocation lines are observed in the state of crossing each other, it would occur that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of 100 or more grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of grains. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, but the formation of the dislocation lines may be effected either in the (110) direction or randomly. Further, the length of each dislocation line may be random, and the dislocation lines may be observed as short lines on the main planes or as long lines extending to the side (periphery). The dislocation lines may be straight or often meander. In many instances, the dislocation lines cross each other.

The position of dislocation lines may be localized on the periphery, main planes or local points as mentioned above, or the formation of dislocation lines may be effected on a combination thereof. That is, dislocation lines may be concurrently present on both the periphery and the main planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably in the range of 0 to 20 mol %, more preferably 0 to 15 mol %.

Herein, the terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apexes or on the faces of the base grains in the subsequent step of forming the internal high silver iodide phase.

On the other hand, regulating the pAg at base grain growth to 8.5 or higher, preferably 9 or higher, enables causing the internal high silver iodide phase to be present on the sides of the base grains in the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value. What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. At that time, ammonia, an amine compound, a thiourea derivative or a thiocyanate salt is available as the silver halide solvent. For the formation of the internal high silver iodide phase, use can be made of the so-called conversion methods.

These conversion methods include, for example, one in which, during grain formation, halide ions which exhibit a solubility of silver ion forming salt lower than that of the halide ions forming the grains occurring at the time of grain formation or the vicinity of the surface of these grains are added. In the present invention, it is preferred that the amount of added low-solubility halide ions be some value or higher (relating to halogen composition) relative to the surface area of grains occurring at the time of the addition. For example, it is preferred that, during grain formation, KI be added in an amount of some value or more relative to the surface area of silver halide grains occurring at the time of the grain formation. Specifically, it is preferred that an iodide salt be added in an amount of $8.2\times10^{-5}$ mol/m$^2$ or more.

Preferred process for forming the internal high silver iodide phase comprises adding an aqueous solution of silver salt simultaneously with the addition of an aqueous solution of halide salts containing an iodide salt.

For example, an aqueous solution of $AgNO_3$ is added simultaneously with the addition of an aqueous solution of KI by the double jet. The addition initiation times and addition completion times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably 0.1 or higher, more preferably 0.5 or higher, and most preferably 1 or higher. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility of silver halides of the mixture be as low as possible. Accordingly, the temperature of the mixture at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by adding fine grains of silver iodide. Although these fine grains generally have a size of 0.01 to 0.1 μm, use can also be made of fine grains with a size of 0.01 μm or less or a size of 0.1 μm or more. With respect to the process for preparing these fine grains of silver halides, reference can be made to descriptions of JP-A's-1-183417, 2-44335, 1-183644, 1-183645, 2-43534 and 2-43535. The internal high silver iodide phase can be provided by adding these fine grains of silver halides and conducting a ripening. When the fine grains are dissolved by ripening, use can be made of the aforementioned silver halide solvents. It is not needed that all these added fine grains be immediately dissolved and disappear. It is satisfactory if, when the final grains have been completed, they are dissolved and disappear.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halides constituting this internal high silver iodide phase, in terms of the amount of silver, is 50 mol % or less, preferably 20 mol % or less, based on the amount of silver of the whole grain. With respect to the above high silver iodide phase, there are provided recipe values for the production of silver halide emulsion, which are not values obtained by measuring the halogen composition of final grains according to various analytical methods. The internal high silver iodide phase is often caused to completely disappear in final grains by, for example, recrystallization during the shell covering step, and all the above silver amounts relate to recipe values thereof.

Therefore, although the observation of dislocation lines can be easily performed in the final grains by the aforementioned methods, the internal silver iodide phase introduced for the introduction of dislocation lines often cannot be confirmed as a clear phase because the boundary silver iodide composition is continuously changed. The halogen composition at each grain part can be determined by a combination of the X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase. The silver iodide content of the covering outside phase is preferably in the range of 0 to 30 mol %, more preferably 0 to 20 mol %, and most preferably 0 to 10 mol %, based on the silver halides contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

Another method of introducing dislocation lines in the tabular grains comprises using an iodide ion-releasing agent as described in JP-A-6-11782, which can preferably be employed.

Also, dislocation lines can be introduced by appropriately combining this method of introducing dislocation lines with the aforementioned method of introducing dislocation lines.

The variation coefficient of intergranular iodine distribution of silver halide grains contained in the photosensitive material of the present invention is preferably 20% or less, more preferably 15% or less, and most preferably 10% or less. When the variation coefficient of the iodine content distribution of individual silver halides is greater than 20%, unfavorably, a high contrast is not realized and a speed lowering is intense when a pressure is applied.

Any known processes, such as the process of adding fine grains as described in, for example, JP-A-1-183417 and the process of using an iodide ion-releasing agent as described in JP-A-2-68538, can be employed either individually or in combination for the production of silver halide grains whose intergranular iodine distribution is narrow contained in the photosensitive material of the present invention.

The silver halide grains of the present invention preferably have a variation coefficient of intergranular iodine distribution of 20% or less. The process described in JP-A-3-213845 can be used as the most suitable process for converting the intergranular iodine distribution to a monodispersion. That is, a monodisperse intergranular iodine distribution can be accomplished by a process in which fine silver halide grains containing silver iodide in an amount of 95 mol % or more are formed by mixing together an aqueous solution of a water soluble silver salt and an aqueous solution of a water soluble halide (containing 95 mol % or more of iodide ions) by means of a mixer provided outside a reactor vessel and, immediately after the formation, fed in the reactor vessel. The terminology "reactor vessel" used herein means the vessel in which the nucleation and/or crystal growth of tabular silver halide grains is carried out.

With respect to the method of adding silver halide grains prepared in a mixer and the preparatory means for use therein, the following three techniques can be employed as described in JP-A-3-213845:

(1) immediately after formation of fine grains in a mixer, the fine grains are transferred into a reactor vessel;

(2) powerful and effective agitation is carried out in the mixer; and (3) an aqueous solution of protective colloid is injected into the mixer.

The protective colloid used in the technique (3) above may be injected alone into the mixer, or may be incorporated in the aqueous solution of halide or the aqueous solution of silver nitrate before the injection into the mixer. The concentration of protective colloid is 1% by weight or more, preferably in the range of 2 to 5% by weight. Examples of polymeric compounds capable of exhibiting a protective colloid function on the silver halide grains for use in the present invention include polyacrylamide polymers, amino polymers, polymers having thioether groups, polyvinyl alcohol, acrylic polymers, polymers having hydroxyquinoline, cellulose, starch, acetal, polyvinylpyrrolidone and ternary polymers. Low-molecular-weight gelatins are preferably used as the above polymeric compound. The weight average molecular weight of low-molecular-weight gelatins is preferably 30,000 or less, more preferably 10,000 or less.

The grain formation temperature in the preparation of fine silver halide grains is preferably 35° C. or below, more preferably 25° C. or below. The temperature of the reactor vessel in which fine silver halide grains are incorporated is 50° C. or higher, preferably 60° C. or higher, and more preferably 70° C. or higher.

The grain size of fine-size silver halides employed by the present invention can be determined by placing grains on a mesh and making a direct observation through a transmission electron microscope. The size of fine grains of the present invention is preferably 0.3 μm or less, more preferably 0.1 μm or less, and most preferably 0.01 μm or less. These fine silver halides may be added simultaneously with the addition of other halide ions and silver ions, or may be added alone. The fine silver halide grains are mixed in an amount of 0.005 to 20 mol %, preferably 0.01 to 10 mol %, based on the total silver halide amount.

The silver iodide content of each individual grain can be measured by analyzing the composition of each individual grain by means of an X-ray microanalyzer. The terminology "variation coefficient of intergranular iodine distribution" means a value defined by the formula:

$$\text{variation coefficient}=(\text{standard deviation/av. silver iodide content})\times 100$$

wherein the standard deviation of silver iodide content and the average silver iodide content are obtained by measuring the silver iodide contents of at least 100, preferably at least 200, and more preferably at least 300 emulsion grains. The measuring of the silver iodide content of each individual grain is described in, for example, EP 147,868. There are cases in which a correlation exists between the silver iodide content Yi (mol %) of each individual grain and the equivalent spherical diameter Xi (micron) of each individual grain and cases in which no such correlation exists. It is preferred that no correlation exist therebetween. The structure associated with the silver halide composition of grains of the present invention can be identified by, for example, a combination of the X-ray diffractometry, the EPMA method (in which silver halide grains are scanned by electron beams to thereby detect the silver halide composition) and the ESCA method (in which X rays are irradiated and photoelectrons emitted from grain surface are separated into spectra). In the measuring of silver iodide content in the present invention, the terminology "grain surface" refers to the region whose depth from surface is about 5 nm, and the terminology "grain internal part" refers to the region other than the above surface region. The halogen composition of such a grain surface can generally be measured by the ESCA method.

In the present invention, use can be made of not only the above tabular grains but also regular crystal grains such as cubic, octahedral and tetradecahedral grains and, further, amorphous twinned crystal grains.

The emulsions of the present invention are preferably subjected to selenium sensitization or gold sensitization.

Selenium compounds disclosed in hitherto published patents can be used as the selenium sensitizer in the present invention. In the use of unstable selenium compound and/or nonunstable selenium compound, generally, it is added to an emulsion and the emulsion is agitated at high temperature, preferably 40° C. or above, for a given period of time. Compounds described in, for example, JP-B's-44-15748 and 43-13489, and JP-A's-4-25832 and 4-109240 are preferably used as the unstable selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound used in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or in a single solvent or a mixture of organic solvents selected from methanol and ethanol and added at the time of chemical sensitization. Preferably, the addition is performed prior to the initiation of chemical sensitization. The use of the above selenium sensitizers is not limited to a single kind, but the combined use of two or more kinds may be acceptable. The combined use of a labile selenium compound and an unlabile selenium compound is preferred.

The addition amount of the selenium sensitizer for use in the invention, although varied depending on the activity of employed selenium sensitizer, the type and size of silver halide, the ripening temperature and time, etc., is preferably in the range of $2\times10^{-6}$ to $5\times10^{-6}$. The temperature of chemical ripening in the use of a selenium sensitizer is preferably 40° C. or more and 80° C. or less. The pAg and pH are arbitrary. For example, with respect to pH, the effect of the present invention can be exerted even if it widely ranges from 4 to 9.

Selenium sensitization may effectively be performed in the presence of a silver halide solvent.

Examples of the silver halide solvents which can be employed in the present invention include (a) organic thioethers described in U.S. Pat. Nos. 3,271,157, 3,531,289, and 3,574,628, and JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates, the disclosures of which are incorporated herein by reference.

Thiocyanates and tetramethylthiourea can be mentioned as especially preferred silver halide solvents. The amount of added solvent, although varied depending on the type thereof, is, for example, preferably in the range of $1\times10^{-4}$ to $1\times10^{-2}$ mol per mol of silver halide.

The oxidation number of gold of the gold sensitizer used in the gold sensitization may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion for use in the present invention, it is desired to perform the chemical sensitization in combination with sulfur sensitization.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313, and 3,656,955, and DE No. 1,422,869, JP-B-56-24937 and JP-A-55-45016, the disclosures of which are incorporated herein by reference. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion of the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamines, hydrazine derivatives, formamidinesulfinic acid, silane compounds and borane compounds. In the reduction sensitization according to the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion for use in the photosensitive material of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The emulsion for use in the present invention can effectively exhibit it advantages by subjecting it to a spectral sensitization with a methine dye or the like. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5- or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB Nos. 1,344,281 and 1,507,803, JP-B's-43-4936 and 53-12375, and JP-A's-52-110618 and 52-109925, the disclosures of which are incorporated herein by reference. The emulsion used in the present invention may contain with a dye which itself exerts no spectral sensitizing effect or a substance which absorbs substantially none of visible radiation and exhibits supersensitization, together with the above spectral sensitizing dye.

Further, the present invention is preferably used together with a technique of increasing light absorptivity by a spectrum sensitizing dye. For example, there is a method, by utilizing an intermolecular force, of causing more sensitizing dyes to adsorb to silver halide grain surfaces in comparison with those in a single-layer saturated absorption (that is, one-layer adsorption), or a method of adsorbing, to silver halide grains, a coupling dye having two or more chromophores which are not separately conjugated but coupled by a covalent bond. Among them, the present invention is preferably used together with the techniques disclosed in the following patent documents:

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, and E.P. Nos. 985965A, 985964A, 985966A, 985967A, 1085372A, 1085373A, 1172688A, 1199595A, and 887700A1, the disclosures of which are incorporated herein by reference.

In particular, the present invention is preferably used together with the following patent documents: JP-A's-10-239789, 2001-75222, and 10-171058.

The time at which the sensitizing dye can be added at any stage of emulsion preparation which is known to be useful. Most usually, the addition of the sensitizing dye is performed in a time period after the completion of the chemical sensitization but before coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

When a plurality of sensitizing dyes are added, any suitable method can be selected, depending on the selected type of the sensitizing dyes and desired spectral sensitivity, from a method in which each dye is added separately with an interval or is mixed together, or a method in which a part of one kind of sensitizing dye is antecedently added, and the rest of the sensitizing dye is added in combination with other sensitizing dyes.

The addition amount of the sensitizing dye is preferably $4\times10^{-6}$ to $8\times10^{-3}$ mol per mol of silver halide, more effectively, about $5\times10^{-5}$ to $2\times10^{-3}$ mol per mol of silver halide in the case where for more preferable silver halide grain size of 0.2 to 1.2 $\mu$m.

The silver halide grain preferably has a distance between twin planes of 0.017 $\mu$m or less. More preferably, the distance is 0.007 $\mu$m to 0.017 $\mu$m, and especially preferably 0.007 to 0.015 $\mu$m.

The fogging during aging of the silver halide emulsion for use in the present invention can be improved by adding and dissolving a previously prepared silver iodobromide emulsion at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 $\mu$m or less, more preferably 0.05 $\mu$m or less. Although the addition amount of silver iodobromide emulsion depends on employed host grains, basically, it preferably ranges from 0.005 to 5 mol %, more preferably from 0.1 to 1 mol %, based on the mole of silver.

In the emulsion for use in the present invention a conventional dopant that is known as useful for a silver halide emulsion may be used. The conventional dopant, for example, includes Fe, Co, Ni, Ru, Rh, Pd, Re, Os, Ir, Pt, Au, Hg, Pb, or Tl. In the present invention, hexacyanoiron (II) complex or hexacyanoruthenium complex (hereinafter also referred to simply as "metal complex") is preferably used.

The addition amount of the metal complex is preferably in the range of $10^{-7}$ to $10^{-3}$ mol per mol of silver halide, more preferably $1.0\times10^{-5}$ to $5\times10^{-4}$ mol per mol of silver halide.

The addition and incorporation of the metal complex for use in the present invention may be performed at any stage through the process of preparing silver halide grains which consists of nucleation, growth, physical ripening and chemical sensitization. Also, the addition and incorporation may be performed in some divisions. However, it is preferred that at least 50% of the total content of metal complex contained in each silver halide grain be contained in a layer underlying the outermost surface of silver halide grain where ½ or less of the silver content from the surface is present. The layer containing the metal complex may be overlaid with a layer which does not contain any metal complex.

The incorporation of the above metal complex is preferably accomplished by dissolving the metal complex in water or a suitable solvent and directly adding the solution to the reaction mixture during the formation of silver halide grains, or by adding the metal complex solution to the aqueous solution of halide, aqueous solution of silver salt or other solution for preparation of silver halide grains and thereafter conducting grain formation. Alternatively, the incorporation of metal complex is also preferably accomplished by adding silver halide grains in which the metal complex has been introduced in advance, dissolving them and depositing them on other silver halide grains.

With respect to the hydrogen ion concentration of the reaction mixture to which the metal complex is added, the pH value is preferably in the range of 1 to 10, more preferably 3 to 7.

In a multilayered silver halide color photosensitive material, the unit lightsensitive layers are generally arranged in the order of red-, green- and blue-sensitive layers from a support side. However, according to the intended use, this arrangement order may be reversed, or an arrangement order can be employed in which a different lightsensitive layer is interposed between layers of the same color sensitivity. Nonlightsensitive layers can be provided between the silver halide lightsensitive layers and as the uppermost layer and the lowermost layer. These may contain, for example, couplers, DIR compounds and color mixing inhibitors as described later. With respect to a plurality of silver halide emulsion layers constituting each unit lightsensitive layer, it is preferred that two layers consisting of a high-speed emulsion layer and a low-speed emulsion layer be arranged so that the speed is sequentially decreased toward a support as described in DE 1,121,470 or GB 923,045. Also, as described in JP-A's-57-112751, 62-200350, 62-206541 and 62-206543, layers can be arranged so that a low-speed emulsion layer is formed on a side remote from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), or the order of BH/BL/GL/GH/RH/RL, or the order of BH/BL/GH/GL/RL/RH. or the like.

In addition, as described in JP-B-55-34932, layers can be arranged, from the farthest side from a support, in the order of blue-sensitive layer/GH/RH/GL/RL. Furthermore, as described in JP-A's-56-25738 and 62-63936, layers can be arranged, from the farthest side from a support, in the order of blue-sensitive layer/GL/RL/GH/RH.

As described in JP-B-49-15495, three layers can be arranged so that a silver halide emulsion layer having the highest speed is arranged as an upper layer, a silver halide emulsion layer having a speed lower than that of the upper layer is arranged as an interlayer, and a silver halide emulsion layer having a speed lower than that of the interlayer is arranged as a lower layer; i.e., three layers having different sensitivities can be arranged so that the speed is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in layers of the same color sensitivity as described in JP-A-59-202464.

In addition, the layer arrangement can be made in the order of high-speed emulsion layer/low-speed emulsion layer/medium-speed emulsion layer, or in the order of low-speed emulsion layer/medium-speed emulsion layer/high-speed emulsion layer.

Furthermore, the layer arrangement can be changed as mentioned above even when four or more layers are formed.

It is preferable to utilize an interlayer inhibitory effect as means for improving a color reproduction.

With respect to the silver halide grains for use in layers capable of exerting an interlayer effect on a red-sensitive layer, although, for example, the size and configuration thereof are not particularly limited, it is preferred to use so-called tabular grains of high aspect ratio, a monodisperse emulsion having uniform grain size, or silver iodobromide grains having an iodine layer structure. Further, for expanding an exposure latitude, it is preferred to mix a plurality of emulsions whose grain sizes are different from each other.

Although a donor layer capable of exerting the interlayer effect on a red-sensitive layer may be provided by coating on any position on a support, it is preferred that the donor layer be provided by coating at a position which is closer to the support than the blue-sensitive layer and which is more remote from the support than the red-sensitive layer. It is further preferred that the donor layer be positioned closer to the support than the yellow filter layer.

It is more preferred that the donor layer capable of exerting the interlayer effect on a red-sensitive layer be provided at a position which is closer to the support than the green-sensitive layer and which is more remote from the support than the red-sensitive layer. The donor layer is most preferably arranged at a position adjacent to a side of the green-sensitive layer close to the support. The terminology "adjacent" used herein means that an intermediate layer or the like is not interposed therebetween.

There may be a plurality of layers capable of exerting the interlayer effect on a red-sensitive layer. These layers may be positioned so that they are adjacent to each other or are apart from each other.

In the present invention, use can be made of solid disperse dyes described in JP-A-11-305396, the disclosures of which are incorporated herein by reference.

The emulsions for use in the photosensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose preparation method is described in JP-A-59-133542, the disclosures of which are incorporated herein by reference. The thickness of the shell of this emulsion, although varied depending on development processing, etc., is preferably in the range of 3 to 40 nm, more preferably 5 to 20 nm.

The silver halide emulsions are generally subjected to physical ripening, chemical sensitization and spectral sensitization before use. Additives employed-in these steps are described in RD Nos. 17643, 18716 and 307105. Positions where the description is made are listed in the following table.

In the photosensitive material of the present invention, two or more emulsions which are different from each other in at least one of the characteristics, specifically the grain size, grain size distribution, halogen composition, grain configuration and speed of lightsensitive silver halide emulsion, can be mixed together and used in the same layer.

It is preferred that silver halide grains having a grain surface fogged as described in U.S. Pat. No. 4,082,553 and silver halide grains or colloidal silver having a grain internal portion fogged as described in U.S. Pat. No. 4,626,498 and JP-A-59-214852, the disclosures of which are incorporated herein by reference, be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of photosensitive material. The process for producing them is described in U.S. Pat. No. 4,626,498 and JP-A-59-214852, the disclosures of which are incorporated herein by reference. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 $\mu$m, more preferably 0.05 to 0.6 $\mu$m. With respect to the grain configuration, although both regular grains and a polydisperse emulsion can be used, monodispersity (at least 95% of the weight or number of silver halide grains have grain diameters falling within ±40% of the average grain diameter) is preferred.

In the present invention, it is preferred to use nonlightsensitive fine-grain silver halides. The expression "nonlightsensitive fine-grain silver halides" refers to silver halide fine grains which are not sensitive to light at the time of imagewise exposure for obtaining dye images and which are substantially not developed at the time of development processing thereof. Those not having been fogged in advance are preferred. The fine-grain silver halides have a silver bromide content of 0 to 100 mol %, and, if necessary, may contain silver chloride and/or silver iodide. Preferably, silver iodide is contained in an amount of 0.5 to 10 mol %. The average grain diameter (average of equivalent circular diameters of projected areas) of fine-grain silver halides is preferably in the range of 0.01 to 0.5 $\mu$m, more preferably 0.02 to 0.2 $\mu$m.

The fine-grain silver halides can be prepared by the same process as used in the preparation of common lightsensitive silver halides. It is not needed to optically sensitize the surface of silver halide grains. Further, any spectral sensitization thereof is also not needed. However, it is preferred to add known stabilizers, such as triazole, azaindene, benzothiazolium and mercapto compounds or zinc compounds, thereto prior to the addition of fine-grain silver halides to a coating liquid. Colloidal silver can be incorporated in layers containing fine-grain silver halides.

Various additives mentioned above are used in the photosensitive material regarding the technique of the invention, and other various additives may be used depending on purposes.

The additives are described in detail in Research Disclosure Item 17643 (December 1978), Item 18716 (November 1979) and Item 308119 (December 1989). A summary of the locations where they are described will be listed in the following table.

| | | Types of additives | | |
|---|---|---|---|---|
| | | RD17643 | RD18716 | RD308119 |
| 1 | Chemical sensitizers | page 23 | page 648 right column | page 996 |
| 2 | Sensitivity-increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |

-continued

| | | Types of additives | | |
|---|---|---|---|---|
| | | RD17643 | RD18716 | RD308119 |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

With respect to the photosensitive material of the present invention and the emulsion suitable for use in the photosensitive material and also with respect to layer arrangement and related techniques, silver halide emulsions, dye forming couplers, DIR couplers and other functional couplers, various additives and development processing which can be used in the photographic photosensitive material, reference can be made to EP 0565096A1 (published on Oct. 13, 1993) and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect donating layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion preparation methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Nonlightsensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc.-releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator-releasing couplers: page 65 lines 49 to 53,
29. Other DIR couplers: page 65 line 54 to page 66 to line 4,
30. Method of dispersing couplers: page 66 lines 5 to 28,
31. Antiseptic and mildewproofing agents: page 66 lines 29 to 33,
32. Types of photosensitive materials: page 66 lines 34 to 36,
33. Thickness of lightsensitive layer and swelling speed: page 66 line 40 to page 67 line 1,
34. Back layers: page 67 lines 3 to 8,
35. Development processing summary: page 67 lines 9 to 11,
36. Developing solution and developing agents: page 67 lines 12 to 30,
37. Developing solution additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and recycling: page 70 lines 19 to 23,
45. Developing agent built-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP No. 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter is referred to as "L", and milliliter is referred to as "mL".).

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as SBET.

The saturation magnetization ($\sigma s$) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosures of which are incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosures of which are incorporated herein by reference.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 μm, preferably 0.2 to 5 μm, and more preferably 0.3 to 3 μm. The weight ratio of the magnetic grains to the binder is preferably 0.5:100 to 60:100, and more preferably 1:100 to 30:100. The coating amount of the magnetic grains is 0.005 to 3 g/m$^2$, preferably 0.01 to 2 g/m$^2$, and more preferably 0.02 to 0.5 g/m$^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP466,130, the disclosures of which are incorporated herein by reference.

A polyester support used in the present invention will be described below. Details of the polyester support and sensitive materials, processing, cartridges, and examples (to be described later) are described in Journal of Technical Disclosure No. 94-6023 (JIII; 1994, March 15), the disclosures of which are incorporated herein by reference.

Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg −20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ $\Omega$·cm or less, more preferably $10^5$ $\Omega$·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides.

The content in a sensitive material is preferably 5 to 500 mg/m$^2$, and especially preferably 10 to 350 mg/m$^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid=9/1 or 5/5 (molar ratio)) grains, and polystyrene grains. The grain size is preferably 0.8 to 10 $\mu$m, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 $\mu$m or smaller. Examples are polymethylmethacrylate grains (0.2 $\mu$m), poly(methylmethacrylate/methacrylic acid=9/1 (molar ratio, 0.3 $\mu$m) grains, polystyrene grains (0.25 $\mu$m), and colloidal silica grains (0.03 $\mu$m).

The support used in Example of this specification may be prepared by the method described in Example 1 of JP-A-2001-281815.

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference.

It is particularly preferable that the resistance be $10^{12}\Omega$ or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 cm$^3$ or less, preferably 25 cm$^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color light sensitive film of the present invention is also suited as a film-fitted lens such as FUJICOLOR UTSURUNDESU (Quick Snap) SUPER SLIM and UTSURUNNDESU ACE800 produces by Fuji Photo Film Co., Ltd.

FIG. 1 illustrates an example of a lens-fitted photo film unit, as a single-use camera, with a color photosensitive material of the present invention. The lens-fitted photo film unit 10 consists of a unit body 11 that contains photography mechanisms and an outer label 12 to partially cover the outer surface of the unit body 11. A taking lens 13, a viewfinder objective lens 14, a flashlight emitter 15 and a flash charge button 16 are provided in the front side of the unit body 11. A shutter button 17 and a frame counter indication window 18 to indicate the number of remaining frames are provided in the top side of the unit body 11. A winding dial 19 is partially appeared in the rear side of the unit body 11.

Figure 2:
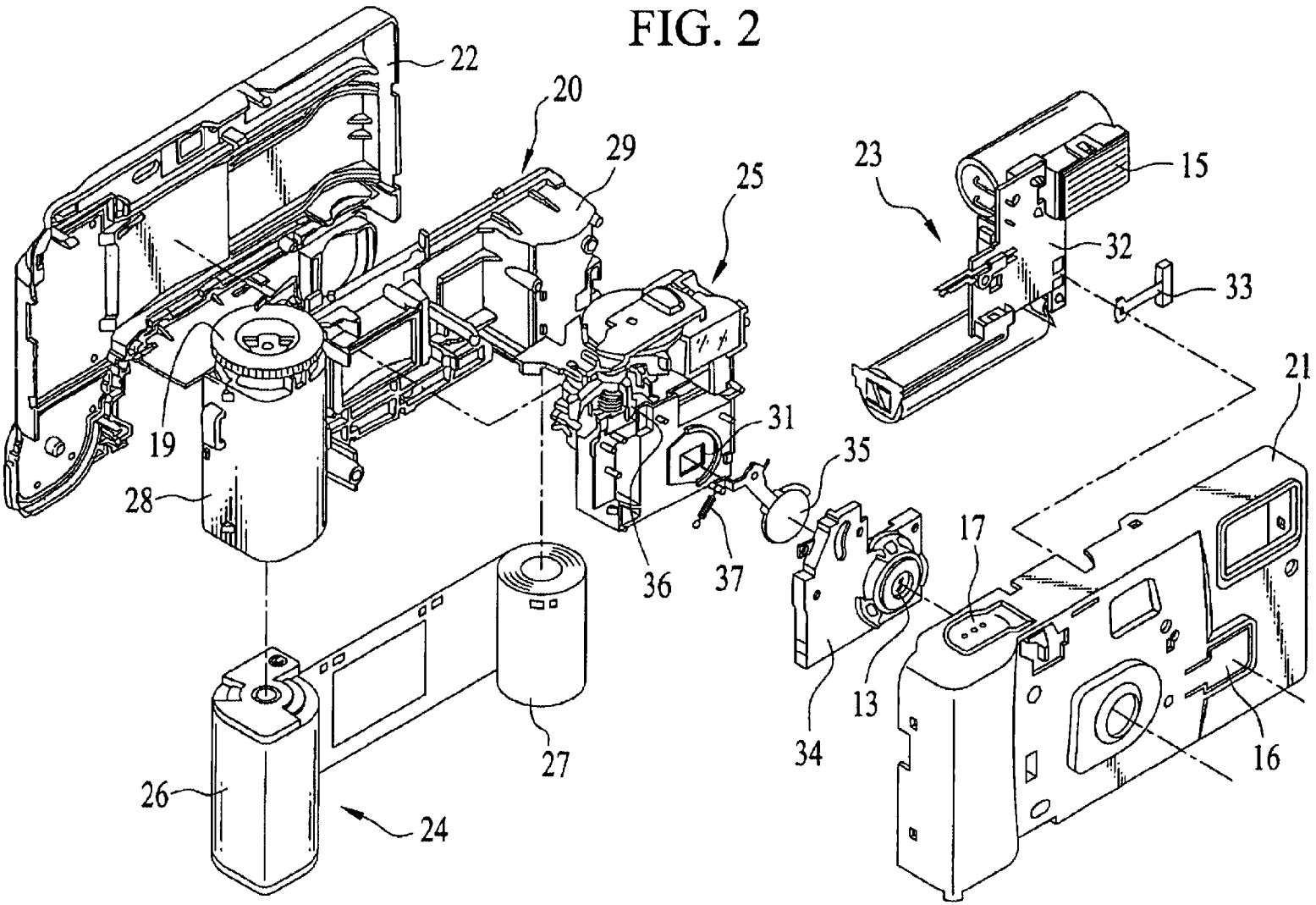
FIG. 2 is an exploded perspective view of the lens-fitted photo film unit.

In FIG. 2, the unit body 11 has a base portion 20, a front cover 21, a rear cover 22, a flash device 23 and a photo film cartridge 24. The photo film cartridge 24 for AP system consists of a cartridge body 26 and a photo filmstrip 27 as the color photosensitive material of the present invention. The photo filmstrip 27 is contained in the cartridge body 26 and drawn therefrom. The film type of the photo filmstrip 27 is not limited to the AP system type. Other film type, such as ISO-135 type, may be applicable to the lens-fitted photo film unit.

An exposure device 25 is assembled in the center area of the base portion 20. A cartridge chamber 28 to contain the cartridge body 26 and a film roll chamber 29 to contain the rolled photo filmstrip 27 are provided in both lateral portion of the base portion 20. The winding dial 19, rotatably assembled on the top side of the cartridge chamber 28, has a shaft that is engaged with a spool of the cartridge body 26. When the winding dial 19 is rotated counterclockwise in the drawing, the photo filmstrip 27 is wound toward the cartridge body 26 so that an unexposed frame is set behind a shutter aperture 31 formed in the exposure device 25.

The flash device 23 has electrical parts, such as a flashlight emitter 15, that are soldered on a print circuit board 30 to form a flash circuit. When the flash charge button 16 is depressed, a switch plate 33 between the flash device 23 and the front cover 21 is deformed to turn on a flash charge switch on the print circuit board 30. Then, the flash circuit is activated to charge a main capacitor for flashlight photography.

The exposure device 25 has various photography mechanisms, such as a shutter cover 34, a shutter blade 35 and a shutter drive mechanism 36. The shutter cover 34 to cover the shutter blade 35 holds the taking lens 13. The shutter blade 35 is rotatably provided between the shutter aperture 31 and the shutter cover 34, and held at an initial position to cover the shutter aperture 31 by the bias of the coil spring 37.

When the shutter drive mechanism 36 is charged by the rotation of the winding dial 19, the shutter button 17 is pressed down to carry out photography. The shutter drive mechanism 36 is actuated to strike the shutter blade 35. The shutter blade 35 is rotated against the bias of the coil spring 37 so as to open the shutter aperture 31 for a predetermined time. Then, the shutter blade 35 is moved to the initial position by the bias of the coil spring 37. The photo filmstrip 27 is exposed to subject light during the rotation of the shutter blade 35.

The lens-fitted photo film unit having the color photosensitive material of the present invention is not limited to the example above. For instance, the color photosensitive material of the present invention may be loaded with various types of the lens-fitted photo film unit, such as the lens-fitted photo film units with a stop changeover device and a data recording device.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINILABO CHAMPION SUPER FA-298, FA-278, FA-258, FA-238 and Fuji Film DIGITALLABO SYSTEM, FRONTIER are preferable. Examples of a film processor for the MINILABO CHAMPION are the FP922AL/FP562B/FP562B, AL/FP362B/FP362BL AL and a recommended processing chemical is the FUJICOLOR JUST-IT CN-16L and CN-16Q. Examples of a printer processor are the PP3008AR/PP3008A/PP1828AR/PP1828A/PP1258AR/PP1258A/PP728AR/PP728A, and a recommended processing chemical is the FUJICOLOR JUST-IT CP-47L and CP-40FAII.

In the FRONTIER SYSTEM, SCANNER & IMAGE-PROCESSOR SP-1000/SP-1500/SP-800 and LASER PRINTER & PAPER PROCESSOR LP-1000P/LP-1500/LP, or LASER PRINTER LP-1000W are used. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

Most of the compact type cameras on the market are set in an automatic flashlight mode in which an internal flashlight device is automatically driven to emit the flashlight in photographing a low brightness scene. One of the purposes of the present invention, however, is to obtain a high-quality picture without auxiliary light such as the flashlight. If the camera is initially set in the automatic flashlight mode upon being powered, a photographer has to change the operation mode into a flashlight prohibition mode from the automatic flashlight mode even when the color negative film of the present invention is loaded in the camera.

For the purpose of reducing the burden to change the operation mode, it is preferable to provide the camera with a function to automatically change the operation mode upon powering the camera in accordance with the kind of the photo film.

For instance, the camera is initially set in the automatic flashlight mode to emit the flashlight in a low brightness scene and prohibit flashlight emission in a high brightness scene. In loading a photo film with a predetermined mark to indicate that the indicated film speed is lower than the ISO speed, the camera automatically carries out an operation to set in the flashlight prohibition mode just after being powered.

The function to change the operation mode automatically may be provided with a conventional camera products as well as the compact camera. Moreover, the camera products may have a function to change the operation mode manually. It is possible to provide the negative film of the present invention with the lens-fitted photo film unit with no flashlight device.

Image processing apparatuses including a printer preferably have a function to change the different printing mode when the photo film of the present invention is used. In photographing images without the flashlight, scene images recorded in the photo film have a wide color temperature range. If the image processing apparatus performs image correction process by use of lowered image correction algorism with small correction parameters, the printed image is not satisfactory because the large difference in the color temperature is affected to the printed image.

An ordinary image processing apparatus is set in a lowered image correction mode to correct the image with small correction parameters. The operation mode of the image processing apparatus is preferably set in a high or full correction mode automatically when the photo film of the present invention is used to make a print. Note that the correction parameter is dynamically increased in the high or full correction mode.

For the purpose of changing the operation mode automatically, it is preferable to provide a photo film with a machine readable mark to indicate that the indicated film speed is lower than the ISO speed. For instance, such machine readable mark is a one or two dimensional bar code recorded in an area outside the image recording area of the developed negative film. The image processing apparatuses including the printer are possible to recognize the photo film with the machine readable mark.

Since the negative film of the present invention may record images with various color temperatures, it is preferable to set a special operation mode to carry out a substantially strong set-up automatically. For instance, a conventional digital printer performs a pre-scan to scan the recorded images in the whole negative film, and creates one dimensional gray LUT (look-up table) to compensate fluctuation in base density and gradation. Since the negative film of the present invention may have images with various color temperatures, printed images after image correction tends to have color failure when the set-up is carried out by use of strongly weighed LUT. Thus, it is preferable to set in the special image correction mode to correct the recorded images by use of a weakly weighed LUT, when the printer scans a photo film with a machine readable mark to indicate that the indicated film speed is lower than the ISO speed.

Note that the term "set-up" stands for the process to perform density, gradation and color conversion to the images input from the negative film. The set-up may be automatically carried out by the image processing apparatus or manually carried out by an operator.

Any known methods and devices may be used to realize the special image correction mode to prevent color failure. An example to realize such special image correction mode is a weakly weighed LUT created by the pre-scan described above.

EXAMPLE

Examples of the present invention will be described below, which, however, in no way limit the scope of the present invention.

Example 1

Silver halide (silver iodobromide) emulsions Em-A to Em-O specified in Table 1 were prepared with reference to the process for preparing emulsions Em-A to Em-O described in Example 1 of JP-A-2001-281815.

TABLE 1

| Emulsion | Average iodide (mol %) | Equivalent sphere diameter (μm) | Aspect ratio | Equivalent circle diameter (μm) | Grain thickness (μm) | Shape |
|---|---|---|---|---|---|---|
| A | 4 | 1.0 | 25 | 2.8 | 0.11 | Tabular |
| B | 5 | 0.7 | 15 | 1.6 | 0.11 | Tabular |
| C | 4.7 | 0.51 | 7 | 0.85 | 0.12 | Tabular |
| D | 1 | 0.51 | 11 | 1.0 | 0.09 | Tabular |
| E | 5 | 1.0 | 25 | 2.8 | 0.11 | Tabular |
| F | 5.5 | 0.75 | 15 | 1.6 | 0.11 | Tabular |
| G | 4.7 | 0.73 | 9.9 | 1.39 | 0.14 | Tabular |
| H | 2.5 | 0.51 | 9 | 0.42 | 0.10 | Tabular |
| I | 1.5 | 0.37 | 9 | 0.67 | 0.074 | Tabular |
| J | 5 | 0.8 | 12 | 1.6 | 0.13 | Tabular |
| K | 3.7 | 0.47 | 3 | 0.53 | 0.18 | Tabular |
| L | 5.5 | 1.6 | 12 | 3.2 | 0.27 | Tabular |
| M | 8.8 | 0.64 | 5.2 | 0.85 | 0.16 | Tabular |
| N | 3.7 | 0.37 | 4.6 | 0.55 | 0.12 | Tabular |
| O | 1.8 | 0.19 | — | — | — | Cubic |

Referring to Table 1, dislocation lines as described in JP-A-3-237450 were observed in the tabular grains when the observation was conducted through a high-voltage electron microscope.

(Preparation of Sample 001)

A triacetylcellulose support were coated with a plurality of layers of the following respective compositions, thereby obtaining a color negative film (sample 001).

(Composition of Lightsensitive Layer)

Main materials used in each of the layers are classified as follows:

| | |
|---|---|
| ExC: cyan coupler, | UV: ultraviolet absorber, |
| ExM: magenta coupler, | HBS: high b.p. org. solvent, |
| ExY: yellow coupler, | H: gelatin hardener |

(For each specific compound, in the following description, numeral is assigned after the character, and the chemical formula thereof is shown later).

The numeric value given beside the description of each component is for the coating amount expressed in the unit of $g/m^2$. With respect to the silver halides, the coating amount is in terms of silver quantity.

1st layer (First antihalation layer)

| | | |
|---|---|---|
| Black colloidal silver | silver | 0.122 |
| 0.07 μm silver iodobromide emulsion | silver | 0.01 |
| Gelatin | | 0.919 |
| ExC-1 | | 0.002 |
| ExC-3 | | 0.002 |
| Cpd-2 | | 0.001 |
| HBS-1 | | 0.005 |
| HBS-2 | | 0.002 |
| F-8 | | 0.001 |

2nd layer (Second antihalation layer)

| | | |
|---|---|---|
| Black colloidal silver | silver | 0.055 |
| Gelatin | | 0.425 |
| ExF-1 | | 0.002 |
| Solid disperse dye ExF-9 | | 0.120 |
| HBS-1 | | 0.074 |
| F-8 | | 0.001 |

3rd layer (Interlayer)

| | | |
|---|---|---|
| Cpd-1 | | 0.080 |
| HBS-1 | | 0.042 |
| Gelatin | | 0.300 |

4th layer (Low-speed red-sensitive emulsion layer)

| | | |
|---|---|---|
| Em-D | silver | 0.577 |
| Em-C | silver | 0.347 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |
| HBS-5 | | 0.038 |
| Gelatin | | 1.474 |

5th layer (Medium-speed red-sensitive emulsion layer)

| | | |
|---|---|---|
| Em-B | silver | 0.731 |
| Em-C | silver | 0.181 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.050 |
| Cpd-2 | | 0.036 |
| Cpd-4 | | 0.028 |
| Cpd-6 | | 0.060 |
| ExC-7 | | 0.010 |
| HBS-1 | | 0.129 |
| Gelatin | | 1.086 |

6th layer (High-speed red-sensitive emulsion layer)

| | | |
|---|---|---|
| Em-A | silver | 1.050 |
| ExC-1 | | 0.072 |
| ExC-3 | | 0.035 |
| ExC-10 | | 0.080 |
| Cpd-2 | | 0.064 |
| Cpd-4 | | 0.077 |
| Cpd-6 | | 0.060 |
| ExC-7 | | 0.040 |
| HBS-1 | | 0.329 |
| HBS-2 | | 0.120 |
| Gelatin | | 1.245 |

7th layer (Interlayer)

| | | |
|---|---|---|
| Cpd-1 | | 0.094 |
| Cpd-7 | | 0.369 |
| Solid disperse dye ExF-4 | | 0.030 |
| HBS-1 | | 0.049 |
| Polyethyl acrylate latex | | 0.088 |
| Gelatin | | 0.886 |

-continued

8th layer (Layer capable of exerting interlayer effect on red-sensitive layer)

| | | |
|---|---|---|
| Em-J | silver | 0.400 |
| Em-K | silver | 0.100 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |
| HBS-1 | | 0.090 |
| HBS-3 | | 0.003 |
| HBS-5 | | 0.030 |
| Gelatin | | 0.610 |

9th layer (Low-speed green-sensitive emulsion layer)

| | | |
|---|---|---|
| Em-H | silver | 0.200 |
| Em-G | silver | 0.120 |
| Em-I | silver | 0.230 |
| ExM-2 | | 0.378 |
| ExM-3 | | 0.047 |
| ExY-1 | | 0.009 |
| ExC-9 | | 0.007 |
| HBS-1 | | 0.098 |
| HBS-3 | | 0.077 |
| HBS-5 | | 0.548 |
| Cpd-5 | | 0.010 |
| Gelatin | | 1.470 |

10th layer (Medium-speed green-sensitive emulsion layer)

| | | |
|---|---|---|
| Em-F | silver | 0.336 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.007 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |

11th layer (High-speed green-sensitive emulsion layer)

| | | |
|---|---|---|
| Em-E | silver | 0.593 |
| Em-G | silver | 0.240 |
| ExC-7 | | 0.010 |
| ExM-1 | | 0.022 |
| ExM-2 | | 0.045 |
| ExM-3 | | 0.014 |
| ExM-4 | | 0.010 |
| ExM-5 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |

12th layer (Yellow filter layer)

| | | |
|---|---|---|
| Cpd-1 | | 0.094 |
| Solid disperse dye ExF-2 | | 0.150 |
| Solid disperse dye ExF-5 | | 0.010 |
| Oil soluble dye ExF-7 | | 0.010 |
| HBS-1 | | 0.049 |
| Gelatin | | 0.630 |

13th layer (Low-speed blue-sensitive emulsion layer)

| | | |
|---|---|---|
| Em-O | silver | 0.060 |
| Em-M | silver | 0.404 |
| Em-N | silver | 0.076 |
| ExC-1 | | 0.048 |
| ExY-1 | | 0.012 |

-continued

| | | |
|---|---|---|
| ExY-2 | | 0.350 |
| ExY-6 | | 0.060 |
| ExY-7 | | 0.300 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| Em-L | silver | 0.464 |
| ExY-2 | | 0.100 |
| ExY-7 | | 0.100 |
| Cpd-2 | | 0.075 |
| Cpd-3 | | 0.001 |
| HBS-1 | | 0.071 |
| Gelatin | | 0.678 |
| 15th layer (First protective layer) | | |
| 0.07 μm silver iodobromide emulsion | silver | 0.280 |
| UV-1 | | 0.100 |
| UV-2 | | 0.060 |
| UV-3 | | 0.095 |
| UV-4 | | 0.013 |
| UV-5 | | 0.200 |
| F-11 | | 0.009 |
| S-1 | | 0.086 |
| HBS-1 | | 0.175 |
| HBS-4 | | 0.050 |
| Gelatin | | 1.984 |
| 16th layer (Second protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750 |

In addition to the above components, W-1 to W-9, B-4 to B-6, F-1 to F-17, a lead salt, platinum salt, iridium salt and rhodium salt were appropriately added to the individual layers in order to improve the storage life, processability, resistance to pressure, antiseptic and mildewproofing properties, antistatic properties and applicability thereof.

Preparation of dispersion of organic solid disperse dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total | 7.210 kg |
| (adjusted to pH = 7.2 with NaOH). | |

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-9 were obtained in the same manner. The average particle diameters of these dye particulates were 0.28 μm and 0.49 μm, respectively. ExF-5 was dispersed by the microprecipitation dispersion method described in Example 1 of EP 549,489A. The average particle diameter thereof was 0.06 μm.

The compounds used in the preparation of each of the layers will be listed below.

ExC-1

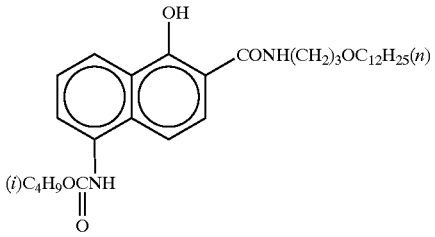

ExC-2

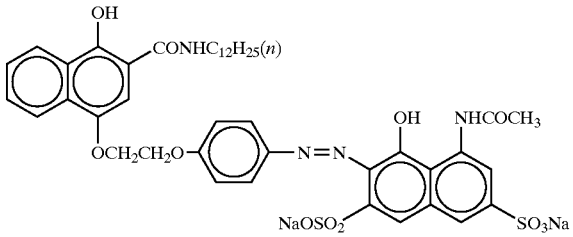

ExC-3

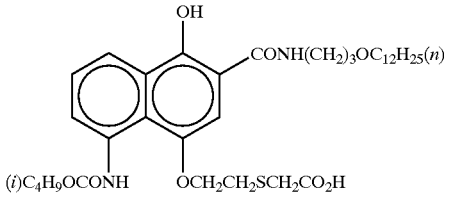

ExC-4

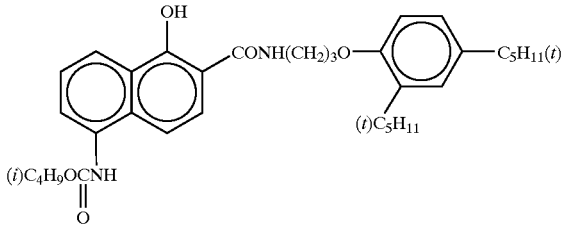

-continued
ExC-5
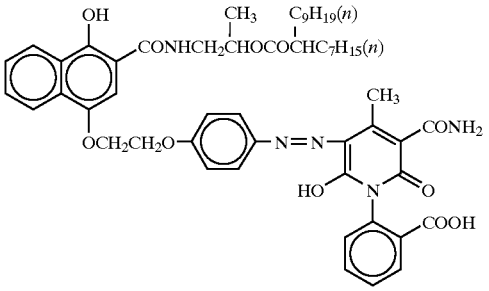
ExC-6
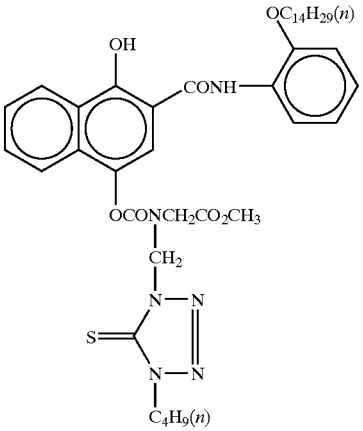
ExC-7
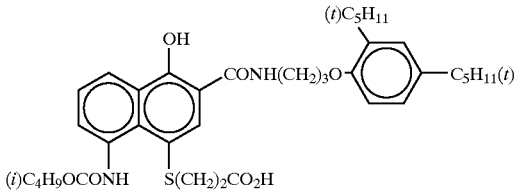
ExC-8
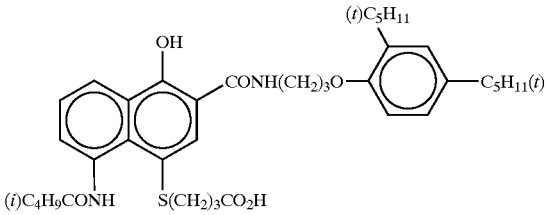
ExC-9
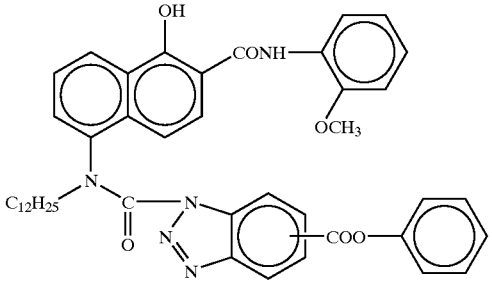
ExC-10
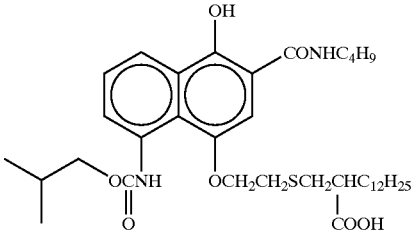
ExM-1
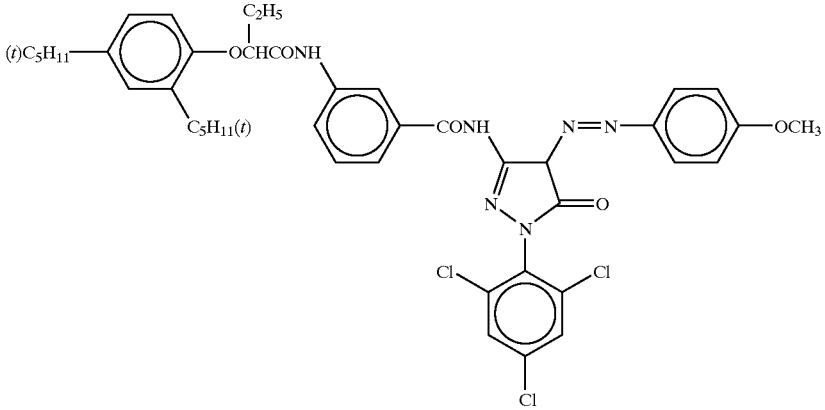

-continued
ExM-2
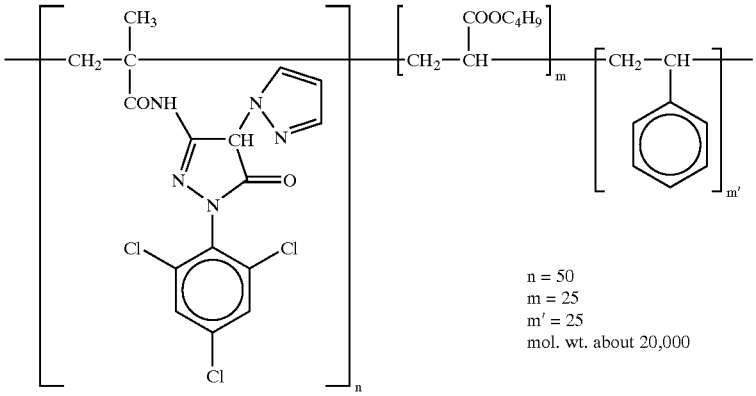
ExM-3
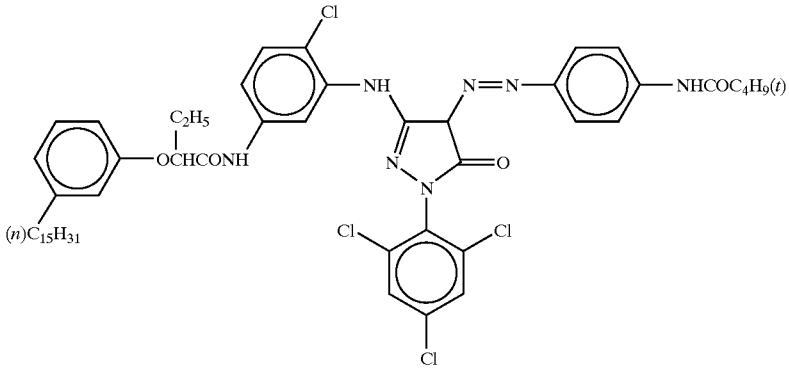
ExM-4
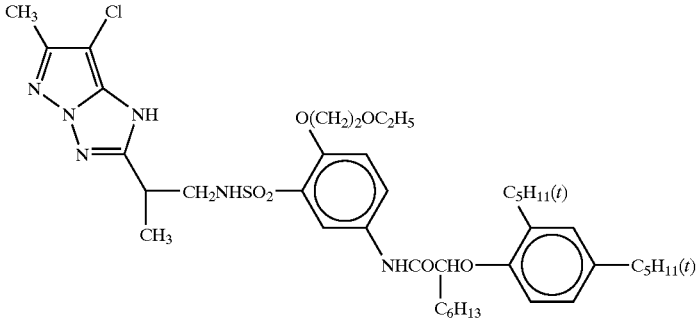
ExM-5
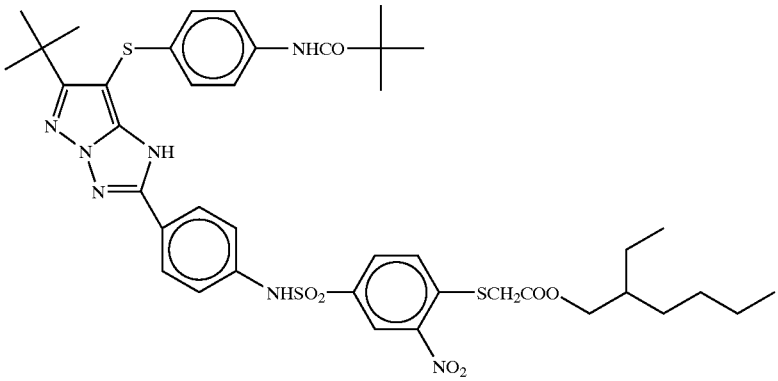

-continued
ExY-1
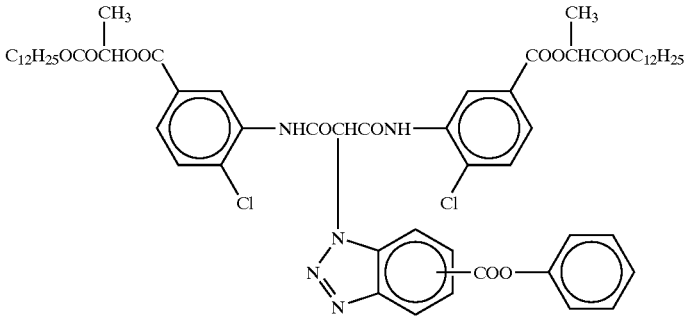
ExY-2
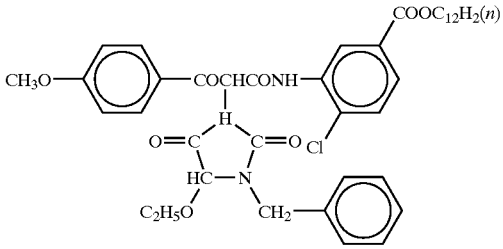
ExY-5
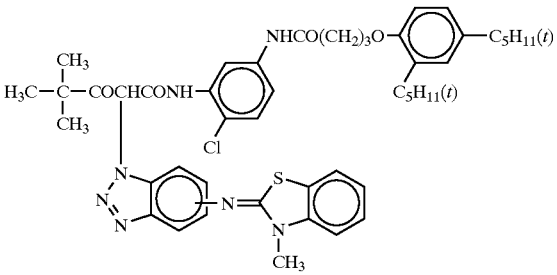
ExY-6
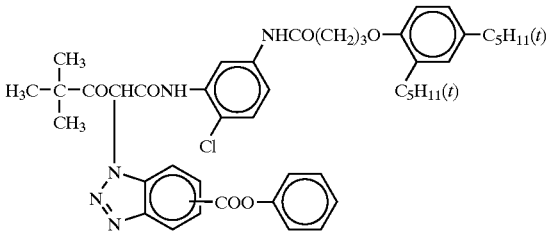
ExY-7
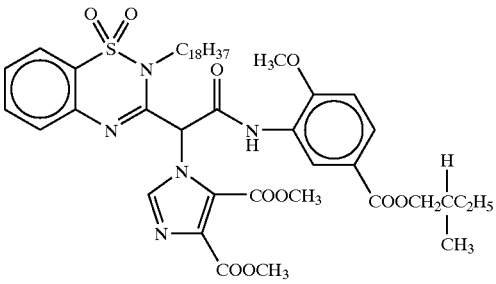
Cpd-1
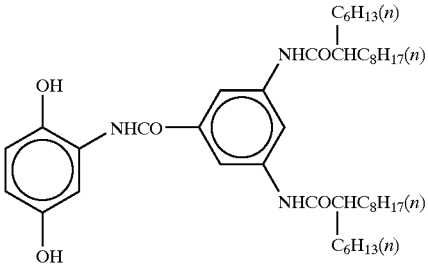
Cpd-2
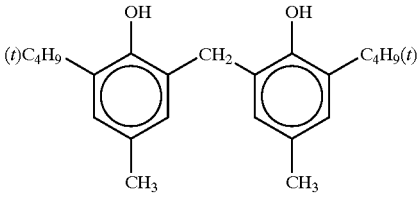
Cpd-3
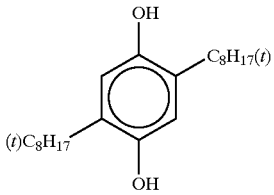
Cpd-4
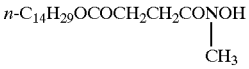
Cpd-5
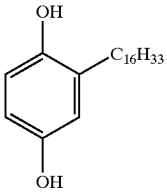
Cpd-6
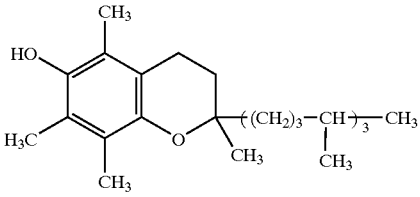

-continued
Cpd-7
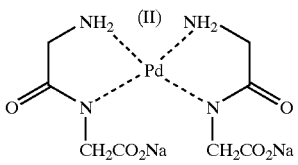
UV-1
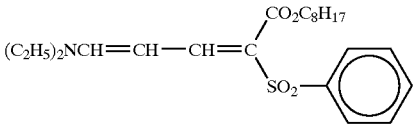
UV-2
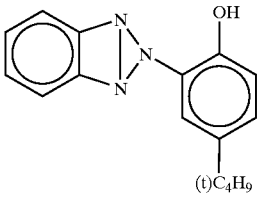
UV-3
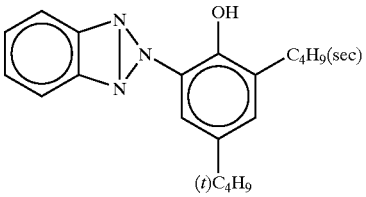
UV-4
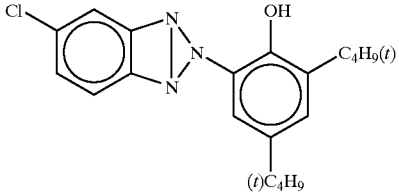
UV-5
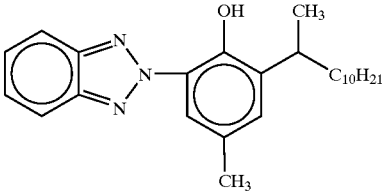
H-1
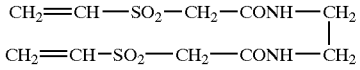
S-1
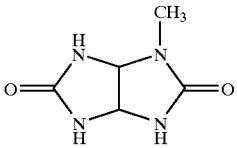
B-1
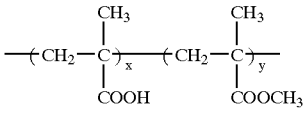
x/y = 10/90 (Weight ratio)
Weight-average molecular
weight: about 35,000
B-2
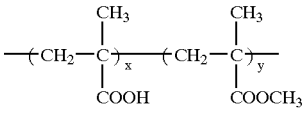
x/y = 40/60 (Weight ratio)
Weight-average molecular
weight: about 20,000
B-3
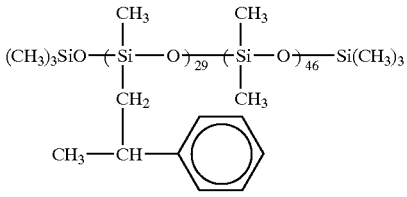
(Molar ratio)
Weight-average molecular
weight: about 8,000
B-4
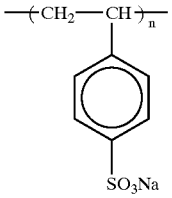
Weight-average molecular
weight: about 750,000
B-5
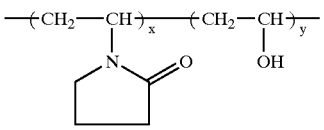
x/y = 70/30 (Weight ratio)
Weight-average molecular
weight: about 17,000
B-6
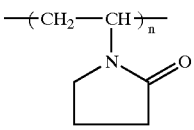
Weight-average molecular
weight: about 10,000

-continued
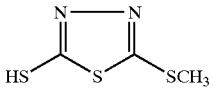
F-1
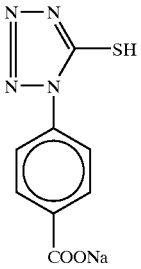
F-2
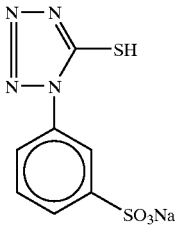
F-3
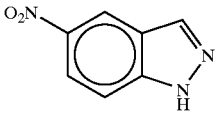
F-4
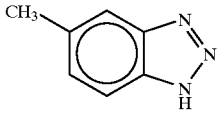
F-5
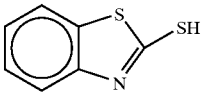
F-6
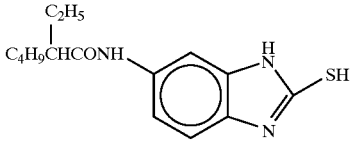
F-7
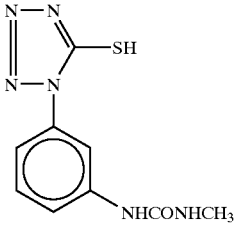
F-8
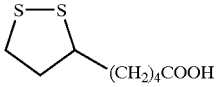
F-9
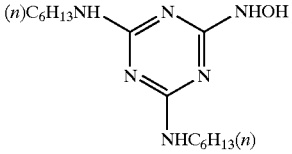
F-10
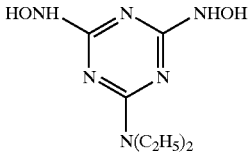
F-11
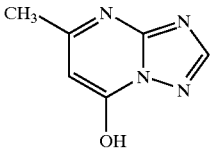
F-12
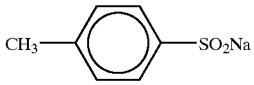
F-13
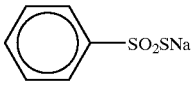
F-14
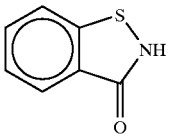
F-15
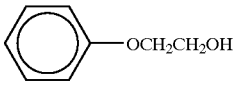
F-16
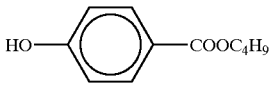
F-17
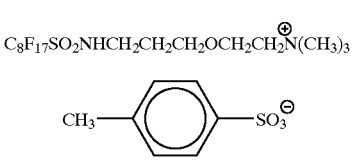
W-1

-continued
W-2
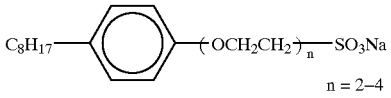
W-3
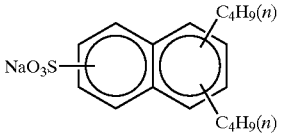
W-4
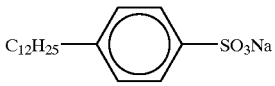
W-5
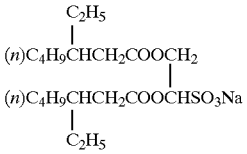
W-6
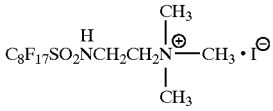
W-7
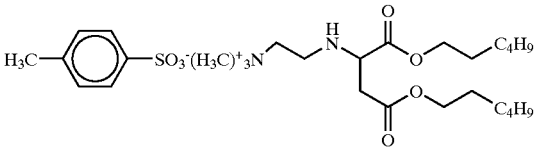
W-8
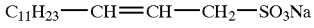
W-9
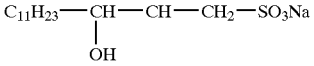
HBS-1
Tricresyl phosphate
HBS-2
Di-n-butyl phthalate
HBS-3
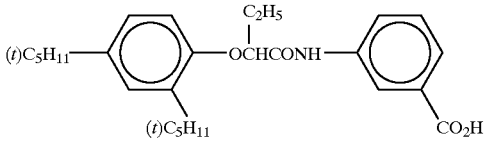
HBS-4
Tri(2-ethylhexyl) phosphate
HBS-5
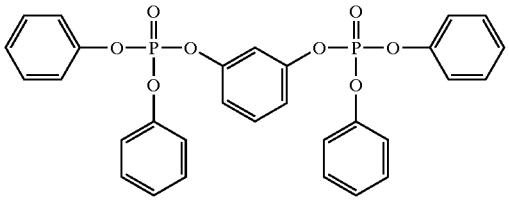
ExF-1
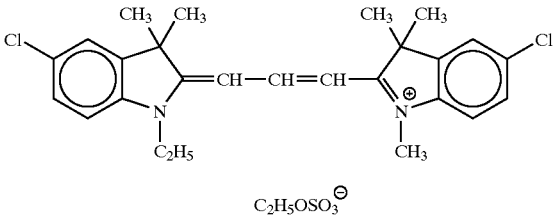
ExF-2
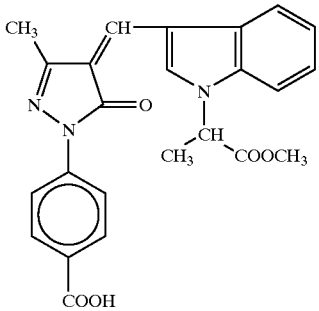
ExF-4
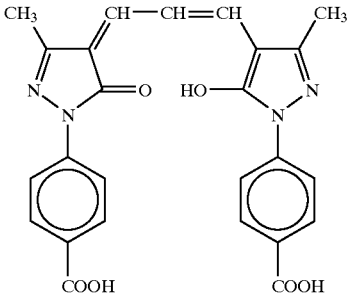

-continued

ExF-5

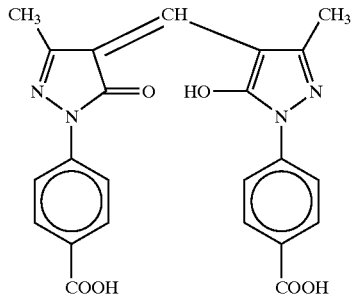

ExF-7

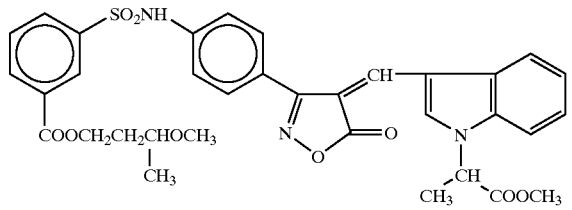

ExF-9

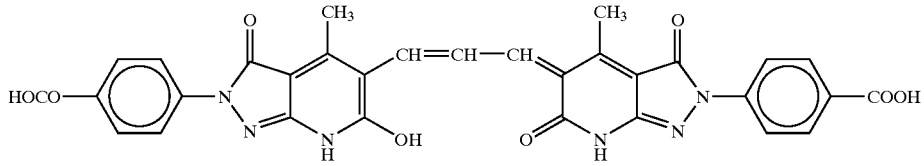

The thus prepared color negative photosensitive material is designated sample 001.

The sample 001 was exposed, and subjected to the following development, and the ISO speed thereof was calculated. The ISO speed was 1620. Further, the difference ($\lambda_G-\lambda_{-R}$) between the weight-averaged wavelength ($\lambda_{-R}$) of spectral sensitivity of the interlayer effect exerted upon the red-sensitive layer and the weight-averaged wavelength ($\lambda_G$) of spectral sensitivity of the green-sensitive layer was 13 nm.

Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing steps)

| Step | Time | Temperature | Replenishing rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (controlled by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |

-continued

| | Tank solution (g) | Replenisher (g) |
|---|---|---|
| Water to make | 1.0 L | 1.0 L |
| pH (controlled by ammonia water) | 4.6 | 4.0 |

(Fixing (1) Tank Solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (controlled by ammonia water and acetic acid) | 7.4 | 7.45 |

(Washing Water) Common to Tank Solution and Replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one.sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

(Preparation of Sample 002)

The following changes were effected to the sample 001.

The grain size of emulsion Em-A of the 6th layer (high-speed red-sensitive emulsion layer) was changed to an equivalent circle diameter of 2.5 μm and a grain thickness of 0.11 μm.

The grain size of emulsion Em-E of the 11th layer (high-speed green-sensitive emulsion layer) was changed to an equivalent circle diameter of 2.5 μm and a grain thickness of 0.11 μm.

The grain size of emulsion Em-L of the 14th layer (high-speed blue-sensitive emulsion layer) was changed to an equivalent circle diameter of 3.0 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 002 was 1250.

(Preparation of Sample 003)

The following changes were effected to the sample 001.

The grain size of emulsion Em-A of the 6th layer (high-speed red-sensitive emulsion layer) was changed to an equivalent circle diameter of 2.3 μm and a grain thickness of 0.11 μm.

The grain size of emulsion Em-E of the 11th layer (high-speed green-sensitive emulsion layer) was changed to an equivalent circle diameter of 2.3 μm and a grain thickness of 0.11 μm.

The grain size of emulsion Em-L of the 14th layer (high-speed blue-sensitive emulsion layer) was changed to an equivalent circle diameter of 2.8 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 003 was 1025.

(Preparation of Sample 004)

The following changes were effected to the sample 001.

The grain size of emulsion Em-A of the 6th layer (high-speed red-sensitive emulsion layer) was changed to an equivalent circle diameter of 2.1 μm and a grain thickness of 0.11 μm.

The grain size of emulsion Em-E of the 11th layer (high-speed green-sensitive emulsion layer) was changed to an equivalent circle diameter of 2.1 μm and a grain thickness of 0.11 μm.

The grain size of emulsion Em-L of the 14th layer (high-speed blue-sensitive emulsion layer) was changed to an equivalent circle diameter of 2.6 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 004 was 840.

(Preparation of Sample 005)

The following changes were effected to the sample 001.

The 8th layer (layer exerting an interlayer effect on the red-sensitive layer) was removed. The components ExY-1, ExY-6 and ExC-9 which had been incorporated in the 8th layer were added to the 9th and 10th layers so as to regulate the interlayer effect on the red-sensitive layer. Further, the emulsion amount and coupler amount were regulated so as to conform the characteristic curve of the green-sensitive layer to the sample 001.

Moreover, regulations were effected so as to conform the characteristic curves to the sample 001. The ISO speed was calculated to obtain 1625. The difference ($\lambda_G-\lambda_{-R}$) between the weight-averaged wavelength ($\lambda_{-R}$) of spectral sensitivity of the interlayer effect exerted upon the red-sensitive layer and the weight-averaged wavelength ($\lambda_G$) of spectral sensitivity of the green-sensitive layer was 3 nm.

(Preparation of Sample 006)

The same changes as in Sample 005 was conducted to Sample 004. As a result of calculation of ISO speed, it was 835. The difference ($\lambda_G-\lambda_{-R}$) between the weight-averaged wavelength ($\lambda_{-R}$) of spectral sensitivity of the interlayer effect exerted upon the red-sensitive layer and the weight-averaged wavelength ($\lambda_G$) Of spectral sensitivity of the green-sensitive layer was 3 nm.

(Preparation of Sample 007)

The following changes were effected to the sample 001.

ExC-6 was added in an amount of 0.029 g/m$^2$ to the 6th layer (high-speed red-sensitive emulsion layer), and regulations were effected so as to conform the characteristic curves to the sample 001.

(Preparation of Sample 008)

The following changes were effected to the sample 007.

ExC-6 and ExY-5 were added in an amount of 0.002 g/m$^2$ and 0.003 g/m$^2$, respectively, to the 11th layer (high-speed green-sensitive emulsion layer), and regulations were effected so as to conform the characteristic curves to the sample 001.

The thus prepared samples 001 to 008 were each charged into a patrone of CAS code 800, and the resultant samples were designated samples 101 to 108, respectively.

Further, the sample 001 was charged into a patrone of CAS code 1600, and the resultant sample was designated sample 109.

(Preparation of Sample 110)

The following changes were effected to the sample 001.

The grain size of emulsion Em-A of the 6th layer (high-speed red-sensitive emulsion layer) was changed to an equivalent circle diameter of 4.0 $\mu$m and a grain thickness of 0.11 $\mu$m.

The grain size of emulsion Em-E of the 11th layer (high-speed green-sensitive emulsion layer) was changed to an equivalent circle diameter of 4.0 $\mu$m and a grain thickness of 0.11 $\mu$m.

The grain size of emulsion Em-L of the 14th layer (high-speed blue-sensitive emulsion layer) was changed to an equivalent circle diameter of 4.0 $\mu$m and a grain thickness of 0.27 $\mu$m.

Furthermore, the emulsion grain size, emulsion amount, etc. of low-speed and medium-speed layers were regulated so as to adjust the characteristic curves.

The ISO speed of the thus prepared sample 110 was 3205. This sample was charged into a patrone of CAS code 1600.

(Preparation of Sample 111)

The sample 004 was charged into a patrone of CAS code 400.

A compact camera was loaded with each of the samples 101 to 111, and used for an actual test photographing of a human subject standing in front of moored vessel Nihonmaru having been lighted up after sunset in Yokohama. In photography, the flashlight is illuminated under the condition that is calculated on the basis of the indicated speed recorded on the patrone of the samples, such that proper amount of the flashlight is illuminated to the human subject. The samples after photographing were subjected to the above color negative development, printed into a 8×10 inch size, and evaluated. Evaluation was effected with respect to the graininess (5 marks), background depiction (5 marks) and color tint (2 marks) (with respect to all of these characteristics, the higher the score, the greater the superiority), and the obtained results are listed in Table 2. Further, 100 general users were inquired of about the degree of satisfaction on the actual test photographs. Three-grade estimation into satisfaction, dissatisfaction and intermediate therebetween was conducted, and the number of users who answered "satisfied" was added to Table 2.

TABLE 2

| Sample | Indicated speed | ISO speed | Graininess | Background depiction | Tint | Total | Satisfaction (number of users) | Remarks |
|---|---|---|---|---|---|---|---|---|
| 101 | 800 | 1620 | 4 | 3 | 2 | 9 | 83 | Invention |
| 102 | 800 | 1250 | 4.5 | 2.5 | 2 | 9 | 87 | Invention |
| 103 | 800 | 1025 | 4 | 2 | 2 | 8 | 75 | Invention |
| 104 | 800 | 840 | 4 | 1 | 2 | 7 | 45 | Comparison |
| 105 | 800 | 1625 | 4 | 3 | 1 | 8 | 75 | Invention |
| 106 | 800 | 835 | 4 | 1 | 1 | 6 | 41 | Comparison |
| 107 | 800 | 1620 | 3.5 | 3 | 2 | 8.5 | 76 | Invention |
| 108 | 800 | 1620 | 3 | 3 | 2 | 8 | 72 | Invention |
| 109 | 1600 | 1620 | 1 | 3 | 2 | 6 | 35 | Comparison |
| 110 | 1600 | 3250 | 2.5 | 5 | 2 | 9.5 | 91 | Invention |
| 111 | 400 | 840 | 4 | 1 | 2 | 7 | 42 | Comparison |

It is apparent from a comparative study between samples 101 and 109 that excellent background depiction and graininess can be simultaneously attained by charging the color negative of ISO 1620 in a patrone of CAS code 800 and realizing a use as 800.

Example 2

Fuji Color single-use camera "Utsurundesu. Simple Eye 800" was loaded with each of the samples 101 to 108, and tested in the same manner as in Example 1. The same excellent results as in Example 1 were attained by the color negative photosensitive materials of the present invention.

Example 3

The emulsions used in this example are silver halide (silver iodobromide) emulsions Em-A to Em-O described in Table 1 of Example 1.

(Preparation of Sample 1001)

A triacetylcellulose support were coated with a plurality of layers of the following respective compositions, thereby obtaining a color negative film (sample 1001).

(Composition of Lightsensitive Layer)

Main materials used in each of the layers are classified as follows:

| | |
|---|---|
| ExC: cyan coupler, | UV: ultraviolet absorber, |
| ExM: magenta coupler, | HBS: high b.p. org. solvent, |
| ExY: yellow coupler, | H: gelatin hardener |

(For each specific compound, in the following description, numeral is assigned after the character, and the chemical formula thereof is shown later).

The numeric value given beside the description of each component is for the coating amount expressed in the unit of $g/m^2$. With respect to the silver halides, the coating amount is in terms of silver quantity.

| | | |
|---|---|---|
| **1st layer (First antihalation layer)** | | |
| Black colloidal silver | silver | 0.122 |
| 0.07 μm silver iodobromide emulsion | silver | 0.01 |
| Gelatin | | 0.919 |
| ExC-1 | | 0.002 |
| ExC-3 | | 0.002 |
| Cpd-2 | | 0.001 |
| HBS-1 | | 0.005 |
| HBS-2 | | 0.002 |
| F-8 | | 0.001 |
| **2nd layer (Second antihalation layer)** | | |
| Black colloidal silver | silver | 0.055 |
| Gelatin | | 0.425 |
| ExF-1 | | 0.002 |
| Solid disperse dye ExF-9 | | 0.120 |
| HBS-1 | | 0.074 |
| F-8 | | 0.001 |
| **3rd layer (Interlayer)** | | |
| Cpd-1 | | 0.080 |
| HBS-1 | | 0.042 |
| Gelatin | | 0.300 |
| **4th layer (Low-speed red-sensitive emulsion layer)** | | |
| Em-D | silver | 0.577 |
| Em-C | silver | 0.347 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |
| HBS-5 | | 0.038 |
| Gelatin | | 1.474 |
| **5th layer (Medium-speed red-sensitive emulsion layer)** | | |
| Em-B | silver | 0.731 |
| Em-C | silver | 0.181 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.050 |
| Cpd-2 | | 0.036 |
| Cpd-4 | | 0.028 |
| Cpd-6 | | 0.060 |
| ExC-7 | | 0.010 |
| HBS-1 | | 0.129 |
| Gelatin | | 1.086 |
| **6th layer (High-speed red-sensitive emulsion layer)** | | |
| Em-A | silver | 0.630 |
| ExC-1 | | 0.072 |
| ExC-3 | | 0.035 |
| ExC-10 | | 0.080 |
| Cpd-2 | | 0.064 |
| Cpd-4 | | 0.077 |
| Cpd-6 | | 0.060 |
| ExC-7 | | 0.040 |
| HBS-1 | | 0.329 |
| HBS-2 | | 0.120 |
| Compound example 24 | | $2.8 \times 10^{-6}$ |
| Gelatin | | 1.245 |
| **7th layer (Interlayer)** | | |
| Cpd-1 | | 0.094 |
| Cpd-7 | | 0.369 |

-continued

| | | |
|---|---|---|
| Solid disperse dye ExF-4 | | 0.030 |
| HBS-1 | | 0.049 |
| Polyethyl acrylate latex | | 0.088 |
| Gelatin | | 0.886 |
| **8th layer (Layer capable of exerting interlayer effect on red-sensitive layer)** | | |
| Em-J | silver | 0.240 |
| Em-K | silver | 0.100 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |
| HBS-1 | | 0.090 |
| HBS-3 | | 0.003 |
| HBS-5 | | 0.030 |
| Compound example 24 | | $1.4 \times 10^{-6}$ |
| Gelatin | | 0.610 |
| **9th layer (Low-speed green-sensitive emulsion layer)** | | |
| Em-H | silver | 0.200 |
| Em-G | silver | 0.120 |
| Em-I | silver | 0.230 |
| ExM-2 | | 0.378 |
| ExM-3 | | 0.047 |
| ExY-1 | | 0.009 |
| ExC-9 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| **10th layer (Medium-speed green-sensitive emulsion layer)** | | |
| Em-F | silver | 0.336 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.007 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |
| **11th layer (High-speed green-sensitive emulsion layer)** | | |
| Em-E | silver | 0.356 |
| Em-G | silver | 0.144 |
| ExC-7 | | 0.010 |
| ExM-1 | | 0.022 |
| ExM-2 | | 0.045 |
| ExM-3 | | 0.014 |
| ExM-4 | | 0.010 |
| ExM-5 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Compound example 24 | | $2.38 \times 10^{-6}$ |
| Polyethyl acrylate latex | | 0.099 |
| Gelatin | | 0.939 |
| **12th layer (Yellow filter layer)** | | |
| Cpd-1 | | 0.094 |
| Solid disperse dye ExF-2 | | 0.150 |
| Solid disperse dye ExF-5 | | 0.010 |
| Oil soluble dye ExF-7 | | 0.010 |
| HBS-1 | | 0.049 |
| Gelatin | | 0.630 |

-continued

| | | |
|---|---|---|
| **13th layer (Low-speed blue-sensitive emulsion layer)** | | |
| Em-O | silver | 0.060 |
| Em-M | silver | 0.404 |
| Em-N | silver | 0.076 |
| ExC-1 | | 0.048 |
| ExY-1 | | 0.012 |
| ExY-2 | | 0.350 |
| ExY-6 | | 0.060 |
| ExY-7 | | 0.300 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |
| **14th layer (High-speed blue-sensitive emulsion layer)** | | |
| Em-L | silver | 0.464 |
| ExY-2 | | 0.100 |
| ExY-7 | | 0.100 |
| Cpd-2 | | 0.075 |
| Cpd-3 | | 0.001 |
| HBS-1 | | 0.071 |
| Compound example 24 | | $2.2 \times 10^{-6}$ |
| Gelatin | | 0.678 |
| **15th layer (First protective layer)** | | |
| 0.07 μm silver iodobromide emulsion | silver | 0.280 |
| UV-1 | | 0.100 |
| UV-2 | | 0.060 |
| UV-3 | | 0.095 |
| UV-4 | | 0.013 |
| UV-5 | | 0.200 |
| F-11 | | 0.009 |
| S-1 | | 0.086 |
| HBS-1 | | 0.175 |
| HBS-4 | | 0.050 |
| Gelatin | | 1.984 |
| **16th layer (Second protective layer)** | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750. |

In addition to the above components, W-1 to W-9, B-4 to B-6, F-1 to F-17, a lead salt, platinum salt, iridium salt and rhodium salt were appropriately added to the individual layers in order to improve the storage life, processability, resistance to pressure, antiseptic and mildewproofing properties, antistatic properties and applicability thereof.

Preparation of Dispersion of Organic Solid Disperse Dye:

The ExF-2 of the 12th layer was dispersed by the following method. Specifically,

| | |
|---|---|
| Wet cake of ExF-2 (contg. 17.6 wt. % water) | 2.800 kg |
| Sodium octylphenyldiethoxymethanesulfonate (31 wt. % aq. soln.) | 0.376 kg |
| F-15 (7% aq. soln.) | 0.011 kg |
| Water | 4.020 kg |
| Total | 7.210 kg |
| (adjusted to pH = 7.2 with NaOH). | |

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-9 were obtained in the same manner. The average particle diameters of these dye particulates were 0.28 μm and 0.49 μm, respectively. ExF-5 was dispersed by the microprecipitation dispersion method described in Example 1 of EP 549,489A. The average particle diameter thereof was 0.06 μm.

The compounds used in the preparation of each of the layers are the same as those used in Example 1.

The thus prepared color negative photosensitive material is designated sample 1001.

The sample 1001 was exposed, and subjected to the following development, and the ISO speed thereof was calculated. The ISO speed was 1630. Further, the difference ($\lambda_G - \lambda_{-R}$) between the weight-averaged wavelength ($\lambda_{-R}$) of spectral sensitivity of the interlayer effect exerted upon the red-sensitive layer and the weight-averaged wavelength ($\lambda_G$) of spectral sensitivity of the green-sensitive layer was 13 nm.

The development was conducted using the same conditions as in Example 1.

(Preparation of Sample 1002)

The following changes were effected to the sample 1001.

The grain size of emulsion Em-A of the 6th layer (high-speed red-sensitive emulsion layer) was changed to an equivalent circle diameter of 2.5 μm and a grain thickness of 0.11 μm.

The grain size of emulsion Em-E of the 11th layer (high-speed green-sensitive emulsion layer) was changed to an equivalent circle diameter of 2.5 μm and a grain thickness of 0.11 μm.

The grain size of emulsion Em-L of the 14th layer (high-speed blue-sensitive emulsion layer) was changed to an equivalent circle diameter of 3.0 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 1002 was 1260.

(Preparation of Sample 1003)

The following changes were effected to the sample 1001.

The grain size of emulsion Em-A of the 6th layer (high-speed red-sensitive emulsion layer) was changed to an equivalent circle diameter of 2.3 μm and a grain thickness of 0.11 μm.

The grain size of emulsion Em-E of the 11th layer (high-speed green-sensitive emulsion layer) was changed to an equivalent circle diameter of 2.3 μm and a grain thickness of 0.11 μm.

The grain size of emulsion Em-L of the 14th layer (high-speed blue-sensitive emulsion layer) was changed to an equivalent circle diameter of 2.8 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 1003 was 1030.

(Preparation of Sample 1004)

The following changes were effected to the sample 1001.

The grain size of emulsion Em-A of the 6th layer (high-speed red-sensitive emulsion layer) was changed to an equivalent circle diameter of 2.1 μm and a grain thickness of 0.11 μm.

The grain size of emulsion Em-E of the 11th layer (high-speed green-sensitive emulsion layer) was changed to an equivalent circle diameter of 2.1 μm and a grain thickness of 0.11 μm.

The grain size of emulsion Em-L of the 14th layer (high-speed blue-sensitive emulsion layer) was changed to an equivalent circle diameter of 2.6 μm and a grain thickness of 0.27 μm.

Furthermore, the emulsion grain size, emulsion amount, etc. of low-speed and medium-speed layers were regulated so as to adjust the characteristic curves.

The ISO speed of the thus prepared sample 1004 was 845.

(Preparation of Sample 1005)

The following changes were effected to the sample 1001.

The 8th layer (layer exerting an interlayer effect on the red-sensitive layer) was removed. The components ExY-1, ExY-6 and ExC-9 which had been incorporated in the 8th layer were added to the 9th and 10th layers so as to regulate the interlayer effect on the red-sensitive layer. Further, the emulsion amount and coupler amount were regulated so as to conform the characteristic curve of the green-sensitive layer to the sample 1001.

Moreover, regulations were effected so as to conform the characteristic curves to the sample 1001. The ISO speed was calculated, to obtain 1630. The difference ($\lambda_G-\lambda_{-R}$) between the weight-averaged wavelength ($\lambda_{-R}$) of spectral sensitivity of the interlayer effect exerted upon the red-sensitive layer and the weight-averaged wavelength ($\lambda_G$) of spectral sensitivity of the green-sensitive layer was 3 nm.

(Preparation of Sample 1006)

The following changes were effected to the sample 1001.

With respect to the 6th layer (high-speed red-sensitive emulsion layer), the coating silver quantity of emulsion Em-A was increased to 1.05 g/m$^2$, and the compound example 24 was removed.

With respect to the 8th layer (layer exerting an interlayer effect on the red-sensitive layer), the coating silver quantity of emulsion Em-J was increased to 0.40 g/m$^2$, and the compound example 24 was removed.

With respect to the 11th layer (high-speed green-sensitive emulsion layer), the coating silver quantity of emulsion Em-E was increased to 0.593 g/m$^2$, the coating silver quantity of emulsion Em-G was increased to 0.240 g/m$^2$, and the compound example 24 was removed.

With respect to the 14th layer (high-speed blue-sensitive emulsion layer), the coating silver quantity of emulsion Em-L was increased to 0.774 g/m$^2$, and the compound example 24 was removed.

(Preparation of Sample 1007)

The following changes were effected to the sample 1001.

In each of the 6th layer (high-speed red-sensitive emulsion layer), the 8th layer (layer exerting an interlayer effect on the red-sensitive layer), the 11th layer (high-speed green-sensitive emulsion layer) and the 14th layer (high-speed blue-sensitive emulsion layer), the compound example 24 was replaced by an equimolar amount of compound example G-1.

(Preparation of Sample 1008)

The following changes were effected to the sample 1001.

In each of the 6th layer (high-speed red-sensitive emulsion layer), the 8th layer (layer exerting an interlayer effect on the red-sensitive layer), the 11th layer (high-speed green-sensitive emulsion layer) and the 14th layer (high-speed blue-sensitive emulsion layer), the compound example 24 was replaced by an equimolar amount of compound example 11.

(Preparation of Sample 1009)

The following changes were effected to the sample 1001.

In each of the 6th layer (high-speed red-sensitive emulsion layer), the 8th layer (layer exerting an interlayer effect on the red-sensitive layer), the 11th layer (high-speed green-sensitive emulsion layer) and the 14th layer (high-speed blue-sensitive emulsion layer), the compound example 24 was replaced by an equimolar amount of compound example 34.

(Preparation of Sample 1010)

The following changes were effected to the sample 1001.

In each of the 6th layer (high-speed red-sensitive emulsion layer), the 8th layer (layer exerting an interlayer effect on the red-sensitive layer), the 11th layer (high-speed green-sensitive emulsion layer) and the 14th layer (high-speed blue-sensitive emulsion layer), the compound example 24 was replaced by an equimolar amount of compound example 41.

(Preparation of Sample 1011)

The following changes were effected to the sample 1001.

In each of the 6th layer (high-speed red-sensitive emulsion layer), the 8th layer (layer exerting an interlayer effect on the red-sensitive layer), the 11th layer (high-speed green-sensitive emulsion layer) and the 14th layer (high-speed blue-sensitive emulsion layer), the compound example 24 was replaced by an equimolar amount of compound example 46.

(Preparation of Samples 1101 to 1113)

The thus prepared samples 1001 to 1011 were each charged into a patrone of CAS code 800, and designated samples 1101 to 1111, respectively. Further, the sample 1001 was charged into a patrone of CAS code 1600, and designated sample 1112. The sample 1004 was charged into a patrone of CAS code 400, and designated sample 1113.

A compact camera was loaded with each of the samples 1101 to 1113, and used for an actual test photographing of a human subject standing in front of moored vessel Nihon-maru having been lighted up after sunset in Yokohama. The samples after photographing were subjected to the above color negative development. At the development, the film transport speed was doubled. Printing was performed according to the following procedure into a 8×10 inch size.

In advance, the characteristic curves and color processing coefficient of standard processing sample of the sample 1101 were read into an image processing unit by means of a memory scanner. Thereafter, a gradation processing for conversion to the gradation of standard processing sample of the sample 1101 was performed. Color space conversion for outputting to a printer capable of laser exposure onto a color paper was performed with the use of a three-dimensional table, and printing was carried out.

Estimation was effected with respect to the graininess (5 marks), background depiction (5 marks) and color tint (2 marks) (with respect to all of these characteristics, the higher the score, the greater the superiority), and the obtained results are listed in Table 3. Further, 100 general users were inquired of about the degree of satisfaction on the actual test photographs. Three-grade estimation into satisfaction, dissatisfaction and intermediate therebetween was conducted, and the number of users who answered "satisfied" was added to Table 3.

TABLE 3

| Sample | Indicated speed | ISO speed | Graininess | Background depiction | Tint | Total | Satisfaction (number of users) | Remarks |
|---|---|---|---|---|---|---|---|---|
| 1101 | 800 | 1630 | 4 | 3 | 2 | 9 | 85 | Invention |
| 1102 | 800 | 1260 | 4.5 | 2.5 | 2 | 9 | 80 | Invention |
| 1103 | 800 | 1030 | 4 | 2 | 2 | 8 | 71 | Invention |
| 1104 | 800 | 845 | 4 | 1 | 2 | 7 | 52 | Comparison |
| 1105 | 800 | 1630 | 4 | 3 | 1 | 8 | 83 | Invention |
| 1106 | 800 | 1620 | 3 | 2 | 1 | 6 | 25 | Comparison |
| 1107 | 800 | 1620 | 4 | 3 | 2 | 9 | 82 | Invention |
| 1108 | 800 | 1615 | 4 | 3 | 2 | 9 | 84 | Invention |
| 1109 | 800 | 1625 | 4 | 3 | 2 | 9 | 86 | Invention |
| 1110 | 800 | 1630 | 4 | 3 | 2 | 9 | 83 | Invention |
| 1111 | 800 | 1620 | 4 | 3 | 2 | 9 | 84 | Invention |
| 1112 | 400 | 845 | 4 | 1 | 2 | 7 | 54 | Comparison |
| 1113 | 1600 | 1630 | 1 | 3 | 2 | 6 | 35 | Comparison |

It was found from a comparative study of the samples 1101, 1106 and 1113 that high user satisfaction could be obtained by charging the color negative of ISO 1620 in a patrone of CAS code 800 and realizing a use as 800 and by introducing compounds according to the present invention.

Example 4

Fuji Color single-use camera "Utsurundesu. Simple Eye 800" was loaded with each of the samples 1101 to 1113, and tested in the same manner as in Example 1. The same excellent results as in Example 1 were attained by the color negative photosensitive materials of the present invention.

Example 5

The samples prepared in Example 3 were subjected to the following development processing in place of the doubled speed processing. Technical evaluation thereof was effected in the same manner as in Example 1, and as a result it was found that the samples of the present invention exhibited high image quality points and were excellent in rapid processing compatibility.

The processing steps and the processing solution compositions are presented below.

(Processing steps)

| Step | Time | Temperature | Replenishing ate* | Tank volum |
|---|---|---|---|---|
| Color development | 2 min 10 sec | 41.0° C. | 15 mL | 10.3 L |

-continued (Processing steps)

| Step | Time | Temperature | Replenishing ate* | Tank volum |
|---|---|---|---|---|
| Bleaching | 35 sec | 41.0° C. | 5 mL | 3.6 L |
| Fixing (1) | 35 sec | 41.0° C. | — | 3.6 L |
| Fixing (2) | 35 sec | 41.0° C. | 7.5 mL | 3.6 L |
| Stabilization (1) | 20 sec | 41.0° C. | — | 1.9 L |
| Stabilization (2) | 20 sec | 41.0° C. | — | 1.9 L |
| Stabilization (3) | 20 sec | 41.0° C. | 30 mL | 1.9 L |
| Drying | 60 sec | 70.0° C. | | |

*The replenishment rate was per 1.1 m of a 35-mm wide sensitized material (equivalent to one 24 Ex. 1)

The stabilizer and fixer are counterflowed from (3)→(2)→(1), and the stabilization solutions are also connected from stabilization (2) to (1) in a counter flow manner. Also, the tank solution of stabilization (2) is flowed into stabilization (2) in an amount of 15 mL corresponding to a replenishment amount. Note that the amounts of the developer, bleaching solution, and fixer carried over to the bleaching step, fixing step, and washing step were all 2.0 mL per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 2.0 | 4.0 |
| Sodium 4,5-dihydroxybenzene-1,3-disulfonate | 0.4 | 0.5 |
| Sodium sulfite | 4.0 | 9.0 |
| Potassium carbonate | 39.0 | 59.0 |
| Disodium-N,N-bis (sulfonatoethyl) droxylamine | 10.0 | 15.0 |
| Potassium bromide | 1.4 | — |
| Diethyleneglycole | 10.0 | 17.0 |

-continued

| | Tank solution (g) | Replenisher (g) |
|---|---|---|
| Hydroxylamine sulfate | 2.0 | 4.0 |
| Ethyleneurea | 3.0 | 5.5 |
| 4-amino-3-methyl-N-ethyl-N-(β-hydroxyethyl) aniline sulfate | 4.7 | 11.4 |
| Poly(ethylene glycol) 2000 | 1.0 | 1.0 |
| Compound A (see below) | 2.0 | 3.0 |
| Water to make | 1.0 L | 1.0 L |
| pH (controlled by potassium hydroxide and sulfuric acid) | 10.10 | 11.20 |
| (Bleaching solution) | | |
| Ferric ammonium 1,3-diaminopropanetetra acetate monohydrate | 120 | 180 |
| Ammonium bromide | 50 | 70 |
| Succinic acid | 25 | 40 |
| Imidazole | 60 | 90 |
| Water to make | 1.0 L | 1.0 L |
| pH (controlled by ammonia water and nitric acid) | 4.6 | 3.8 |
| (Fixing solution) | | |
| Aqueous ammmonium thiosulfate solution (750 g/L) | 280 mL | 750 mL |
| Aqueous ammonium bisulfite (72%) | 20 | 80 |
| Imidazole | 3 | 30 |
| Ethylenediamine tetraacetic acid | 8 | 12 |
| Water to make | 1.0 L | 1.0 L |
| pH (controlled by ammonia water and nitic acid) | 7.0 | 7.0 |
| (Stabilizer) common to tank solution and replenisher (g) | | |
| Sodium p-toluenesulfinate | 0.03 | |
| $C_{10}H_{21}(OC_2H_4)_{15}OH$ | 0.2 | |
| 1,2-benzoisothiazoline-3-one-sodium | 0.10 | |
| Water to make | 1.0 L | |
| pH | 8.5 | |

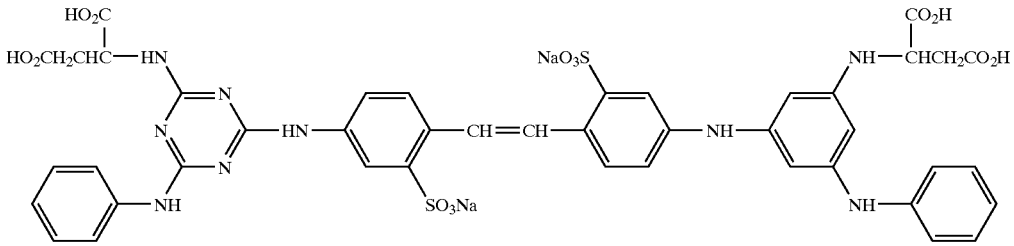

Compound A

Example 6

The samples 021 to 024 were prepared by following the process described in Example 1.

(Preparation of Sample 021)

The following changes were effected to the sample 001.

The grain size of emulsion Em-L of the 14th layer (high-speed blue-sensitive emulsion layer) was changed to an equivalent circle diameter of 4.7 μm and a grain thickness of 0.27 μm.

Furthermore, the emulsion grain size, emulsion amount, etc. of low-speed and medium-speed layers were regulated so as to adjust the characteristic curves.

The ISO speed of the sample 021 was measured as follows. The measurement adapts the regulation in ISO 5800-1987. The ISO daylight illuminant with the color temperature of about 5500K was used as the illuminant. Exposure for 1/100 sec was carried out through a gray scale with no density step. After 5 days under the conditions regulated by ISO since exposure, development was carried out by the process described in Embodiment 1. Then, the characteristic curves were obtained by measuring blue, green and red diffuse transmission density (ISO status M). The exposure amounts $H_B$, $H_G$, $H_R$ were determined as the exposure amounts at the speed points whose diffuse density of each color is (minimum density+0.15). The maximum value $H_S$ was obtained from the three exposure amounts $H_B$, $H_G$, $H_R$. The calculated ISO speed of the sample, defined as $\{2/(H_G+H_S)^{1/2}\}$, was 1625. This measurement adapts the measurement method for the color negative film for still photography that is regulated by ISO 5800-1987. The value $\log_{10}H_B-\log_{10}H_G$ was −0.30. Note that the ISO speeds of the following samples were measured by the same method.

(Preparation of Sample 022)

The following changes were effected to the sample 001.

The grain size of emulsion Em-A of the 6th layer (high-speed red-sensitive emulsion layer) was changed to an equivalent circle diameter of 2.5 μm and a grain thickness of 0.11 μm.

The grain size of emulsion Em-E of the 11th layer (high-speed green-sensitive emulsion layer) was changed to an equivalent circle diameter of 2.5 μm and a grain thickness of 0.11 μm.

Furthermore, the emulsion grain size, emulsion amount, etc. of low-speed and medium-speed layers were regulated so as to adjust the characteristic curves.

The ISO speed of the sample was 1250, and the value $\log_{10}H_B-\log_{10}H_G$ was −0.22.

Furthermore, the emulsion grain size, emulsion amount, etc. of low-speed and medium-speed layers were regulated so as to adjust the characteristic curves.

The ISO speed of the sample was 3220, and the value $\log_{10}H_B-\log_{10}H_G$ was −0.30.

In addition to the samples 021 to 024, the sample 001 is prepared. The value $\log_{10}H_B-\log_{10}H_G$ of sample 001 was −0.12.

(Preparation of Samples 2001 to 2009)

The samples 001, 021 to 024 were cut into negative films of ISO-135 format and charged into patones, so that the samples 2001 to 2009 were prepared for photography experiment. The particulars of the samples 2001 to 2009 including each photographic speed indicated by CAS code are listed in the following Table 4.

TABLE 4

| Sample | Original Sample | ISO speed | $\log_{10}H_B - \log_{10}H_G$ | Indicated speed | Average point | Major comment of observers | Remarks |
|---|---|---|---|---|---|---|---|
| 2001 | 001 | 1620 | −0.12 | 1600 | 2.1 | Dull, dark image | Comparison |
| 2002 | 001 | 1620 | −0.12 | 400 | 3.6 | Natural image, yellow | Invention (Claim 2) |
| 2003 | 021 | 1625 | −0.30 | 400 | 4.3 | Natural image | Invention (Claim 3) |
| 2004 | 022 | 1250 | −0.22 | 400 | 3.9 | Natural image, Slight camera shake | Invention (Claim 3) |
| 2005 | 022 | 1250 | −0.22 | 800 | 2.6 | Dull, rough | Invention (Claim 1) |
| 2006 | 023 | 840 | −0.30 | 200 | 2.2 | Camera shake, Out of focus | Comparison |
| 2007 | 024 | 3205 | −0.30 | 1600 | 3.6 | Natural image, Dull, dark | Invention (Claim 1) |
| 2008 | 024 | 3205 | −0.30 | 800 | 4.5 | Natural image No camera shake | Invention (Claim 3) |
| 2009 | 024 | 3205 | −0.30 | 3200 | 2.8 | Dull, rough | Comparison |

(Preparation of Sample 023)

The following changes were effected to the sample 001.

The grain size of emulsion Em-A of the 6th layer (high-speed red-sensitive emulsion layer) was changed to an equivalent circle diameter of 2.1 μm and a grain thickness of 0.11 μm.

The grain size of emulsion Em-E of the 11th layer (high-speed green-sensitive emulsion layer) was changed to an equivalent circle diameter of 2.1 μm and a grain thickness of 0.11 μm.

Furthermore, the emulsion grain size, emulsion amount, etc. of low-speed and medium-speed layers were regulated so as to adjust the characteristic curves.

The ISO speed of the sample was 840, and the value $\log_{10}H_B-\log_{10}H_G$ was −0.30.

(Preparation of Sample 024)

The following changes were effected to the sample 001.

The grain size of emulsion Em-A of the 6th layer (high-speed red-sensitive emulsion layer) was changed to an equivalent circle diameter of 4.0 μm and a grain thickness of 0.11 μm.

The grain size of emulsion Em-E of the 11th layer (high-speed green-sensitive emulsion layer) was changed to an equivalent circle diameter of 4.0 μm and a grain thickness of 0.11 μm.

The grain size of emulsion Em-L of the 14th layer (high-speed blue-sensitive emulsion layer) was changed to an equivalent circle diameter of 4.7 μm and a grain thickness of 0.30 μm.

(Photography Experiment)

In the following conditions, human subjects of 16 scenes were photographed without auxiliary light in a room that shields outer daylight. Printed pictures were evaluated by five observers. The 16 scenes were recorded in each of the samples 2001 to 2009.

Development was performed by using an negative film developer FUJI COLOR JUST-IT CN-16Q manufactured by Fuji Photo Film Co., Ltd. Printing was carried out to make the Lc size prints (89 mm×127 mm) by using a digital MINI-LAB system FRONTIER 330. Image correction was manually carried out by an operator to correct density and color balance. Print images were performed in an environment free from ambient light and under illumination of daylight fluorescent lamp for color evaluation (FL20S•N-EDL, color rendering AAA), manufactured by Toshiba Corporation.

Photography in this experiment is carried out by use of a conventional auto-focus, auto-exposure and lens-shutter camera for ISO-135 film format, which has a function to set the speed automatically by reading CAS code of the patrone. The camera has a fixed-focal lens with the focal distance of 35 mm and F-value of 2.8. The camera has a center weighed photometry device, and has a mode to prohibit emission of the flashlight as auxiliary light.

(Evaluation)

All of the scenes printed from the samples 2001 to 2009 were subject to six graded evaluation (point 0-5) by five observers. Average point and major comments (30 percent or more in the comments) were included in Table 4.

Compared to the sample 2002 with the same speed, the sample 2003 has better evaluation. Moreover, there are less comment of dull and dark image, and more comment of natural image. This result shows that the sample 2003 with higher blue sensitivity makes it possible to photograph a low temperature image without causing under-exposure.

The samples corresponding to the present invention (claims 2, 3) generally have more average point than the samples corresponding to the comparison and the present invention (claim 1). This result shows that the negative film of the present invention can solve the problem of the dull and dark image caused by under-exposure of the main subject.

It has found that the color photosensitive material according to claims 2, 3 make it possible to obtain a satisfactory picture even in photographing a dim image without the flashlight by use of a conventional compact camera, although the color photosensitive material according to claim 1 is not sufficient for obtaining a satisfactory image in indoor photography.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

(Effect of the Invention)

The present invention has enabled obtaining a color negative photosensitive material from which a photograph of excellent graininess, background depiction and light source compatibility can be obtained by the use of a compact camera or a single-use camera. Moreover, the present invention has enabled obtaining a color negative photosensitive material that can prevent under-exposure of a main subject without using an auxiliary light.

What is claimed is:

1. A silver halide color photosensitive material comprising at least one red-sensitive silver halide emulsion layer, at least one green-sensitive silver halide emulsion layer and at least one blue-sensitive silver halide emulsion layer, on a support, wherein the silver halide color photosensitive material has an ISO speed of 1000 or higher, and has the ISO speed of 1.25 times an indicated speed or higher.

2. The silver halide color photosensitive material according to claim 1, wherein the ISO speed is 1250 or higher and 2.8 times the indicated speed or higher.

3. The silver halide color photosensitive material according to claim 2, wherein the following formula is satisfied;

$$\log_{10}H_B-\log_{10}H_G\leqq-0.20$$

wherein $H_B$, $H_G$ are exposure amounts corresponding to the points whose diffuse densities are (minimum density+0.15) in characteristic curves for blue and green;

wherein the characteristic curves for blue and green are obtained by gray exposure for 1/100 sec to an emulsion side surface by use of an ISO daylight illuminant under the condition regulated by ISO 5800, by measuring blue and green diffuse density (ISO status M) after development.

4. The silver halide color photosensitive material according to claim 1, wherein each of the red-sensitive silver halide emulsion layer, the green-sensitive silver halide emulsion layer and the blue-sensitive silver halide emulsion layer is composed of at least two layers having different speeds comprising a highest speed and a lowest speed, and at least one of the layers having the highest speeds do not substantially contain a DIR compound capable of releasing a development inhibitor and/or a precursor of a development inhibitor.

5. The silver halide color photosensitive material according to claim 1, wherein the photosensitive material contains a compound capable of undergoing a one-electron oxidation to thereby form a one-electron oxidation product thereof, wherein the one-electron oxidation product is capable of releasing further one or more electrons.

6. The silver halide color photosensitive material according to claim 4, wherein the photosensitive material contains a compound capable of undergoing a one-electron oxidation to thereby form a one-electron oxidation product thereof, wherein the one-electron oxidation product is capable of releasing further one or more electrons.

7. The silver halide color photosensitive material according to claim 3, wherein the photosensitive material contains a compound capable of undergoing a one-electron oxidation to thereby form a one-electron oxidation product thereof, wherein the one-electron oxidation product is capable of releasing further one or more electrons.

8. The silver halide color photosensitive material according to claim 1, wherein the green-sensitive silver halide emulsion layer has a weight-averaged wavelength ($\lambda_G$) of spectral sensitivity distribution satisfying the relationship 520 nm$<\lambda_G\leqq$580 nm, and wherein the red-sensitive silver halide emulsion layer has a weight-averaged wavelength ($\lambda_{-R}$) of spectral sensitivity distribution of magnitude of interlayer effect exerted thereupon, in the range of 500 nm to 600 nm, by other silver halide emulsion layers satisfying the relationship 500 nm$<\lambda_{-R}\leqq$560 nm, and wherein $\lambda_G-\lambda_{-R}$ is 5 nm or greater.

9. The silver halide color photosensitive material according to claim 4, wherein the green-sensitive silver halide emulsion layer has a weight-averaged wavelength ($\lambda_G$) of spectral sensitivity distribution satisfying the relationship 520 nm$<\lambda_G\leqq$580 nm, and wherein the red-sensitive silver halide emulsion layer has a weight-averaged wavelength ($\lambda_{-R}$) of spectral sensitivity distribution of magnitude of interlayer effect exerted thereupon, in the range of 500 nm to 600 nm, by other silver halide emulsion layers satisfying the relationship 500 nm$<\lambda_{-R}\leqq$560 nm, and wherein $\lambda_G-\lambda_{-R}$ is 5 nm or greater.

10. The silver halide color photosensitive material according to claim 5, wherein the green-sensitive silver halide emulsion layer has a weight-averaged wavelength ($\lambda_G$) of spectral sensitivity distribution satisfying the relationship 520 nm$<\lambda_G\leqq$580 nm, and wherein the red-sensitive silver halide emulsion layer has a weight-averaged wavelength ($\lambda_{-R}$) of spectral sensitivity distribution of magnitude of interlayer effect exerted thereupon, in the range of 500 nm to 600 nm, by other silver halide emulsion layers satisfying the relationship 500 nm$<\lambda_{-R}\leqq$560 nm, and wherein $\lambda_G-_{-R}$ is 5 nm or greater.

11. The silver halide color photosensitive material according to claim 6, wherein the green-sensitive silver halide emulsion layer has a weight-averaged wavelength ($\lambda_G$) of spectral sensitivity distribution satisfying the relationship 520 nm$<\lambda_G\leqq$580 nm, and wherein the red-sensitive silver halide emulsion layer has a weight-averaged wavelength ($\lambda_{-R}$) of spectral sensitivity distribution of magnitude of interlayer effect exerted thereupon, in the range of 500 nm to 600 nm, by other silver halide emulsion layers satisfying the relationship 500 nm<$_{-R}$≦560 nm, and wherein $\lambda_G$−$_{-R}$ is 5 nm or greater.

12. The silver halide color photosensitive material according to claim 2, wherein the silver halide color photosensitive material is a color negative film for still photography.

13. The silver halide color photosensitive material according to claim 3, wherein the silver halide color photosensitive material is a color negative film for still photography.

14. A photographic product into which the silver halide color photosensitive material according to claim 1 is built, and which comprises an exposure mechanism including a photographic lens and a shutter.

15. A photographic product into which the silver halide color photosensitive material according to claim 1 is built, and which comprises an exposure mechanism including a photographic lens and a shutter, wherein the following formula is satisfied;

$$\log_{10}H_B-\log_{10}H_G\leqq-0.20$$

wherein $H_B$, $H_G$ are exposure amounts corresponding to the points whose diffuse densities are (minimum density+0.15) in characteristic curves for blue and green;

wherein the characteristic curves for blue and green are obtained by gray exposure for 1/100 sec to an emulsion side surface by use of an ISO daylight illuminant under the condition regulated by ISO 5800, by measuring blue and green diffuse density (ISO status M) after development.

16. A photographic product into which the silver halide color photosensitive material according to claim 4 is built, and which comprises an exposure mechanism including a photographic lens and a shutter.

17. A photographic product into which the silver halide color photosensitive material according to claim 5 is built, and which comprises an exposure mechanism including a photographic lens and a shutter.

18. A photographic product into which the silver halide color photosensitive material according to claim 8 is built, and which comprises an exposure mechanism including a photographic lens and a shutter.

19. A photographic product into which the silver halide color photosensitive material according to claim 11 is built, and which comprises an exposure mechanism including a photographic lens and a shutter.

* * * * *